US011764523B2

(12) United States Patent
Gailus et al.

(10) Patent No.: US 11,764,523 B2
(45) **Date of Patent: *Sep. 19, 2023**

(54) VERY HIGH SPEED, HIGH DENSITY ELECTRICAL INTERCONNECTION SYSTEM WITH IMPEDANCE CONTROL IN MATING REGION

(71) Applicant: Amphenol Corporation, Wallingford, CT (US)

(72) Inventors: Mark W. Gailus, Concord, MA (US); John Robert Dunham, Windham, NH (US); Marc B. Cartier, Jr., Dover, NH (US); Donald A. Girard, Jr., Bedford, NH (US)

(73) Assignee: Amphenol Corporation, Wallingford, CT (US)

( * ) Notice: Subject to any disclaimer, the term of this patent is extended or adjusted under 35 U.S.C. 154(b) by 354 days.

This patent is subject to a terminal disclaimer.

(21) Appl. No.: 17/107,761

(22) Filed: Nov. 30, 2020

(65) Prior Publication Data

US 2021/0083434 A1 Mar. 18, 2021

Related U.S. Application Data

(63) Continuation of application No. 16/235,683, filed on Dec. 28, 2018, now Pat. No. 10,855,034, which is a (Continued)

(51) Int. Cl.
*H01R 13/6586* (2011.01)
*H01R 12/58* (2011.01)
(Continued)

(52) U.S. Cl.
CPC ..... *H01R 13/6586* (2013.01); *H01R 12/585* (2013.01); *H01R 12/7076* (2013.01);
(Continued)

(58) Field of Classification Search
CPC ..... H01R 13/6585; H01R 13/6586; H01R 12/7076; H01R 13/6461; H01R 13/6473; H01R 13/6474
See application file for complete search history.

(56) References Cited

U.S. PATENT DOCUMENTS 2,124,207 A 7/1938 Carl
2,996,710 A 8/1961 Pratt
(Continued)

FOREIGN PATENT DOCUMENTS

CN 2519434 Y 10/2002
CN 1127783 C 11/2003
(Continued)

OTHER PUBLICATIONS

CN 201580069567.7, Jun. 17, 2019, Chinese Office Action.
(Continued)

*Primary Examiner* — Hae Moon Hyeon
(74) *Attorney, Agent, or Firm* — Wolf, Greenfield & Sacks, P.C.

(57) ABSTRACT

A modular electrical connector with separately shielded signal conductor pairs. In some embodiments, the connector is may be assembled from modules, each containing a pair of signal conductors with surrounding partially or fully conductive material. In some embodiments, the modules may have projecting portions, of conductive and/or dielectric material, that are shaped and positioned to reduce changes in impedance along the signal paths as a function of separation of conductive elements, when the connectors are separated by less than the functional mating range.

20 Claims, 23 Drawing Sheets

Related U.S. Application Data continuation of application No. 15/627,063, filed on Jun. 19, 2017, now Pat. No. 10,170,869, which is a continuation of application No. 14/940,049, filed on Nov. 12, 2015, now Pat. No. 9,685,736.

(60) Provisional application No. 62/078,945, filed on Nov. 12, 2014.

(51) Int. Cl.

| | |
|---|---|
| ***H01R 13/6474*** | (2011.01) |
| ***H01R 12/70*** | (2011.01) |
| ***H01R 13/6461*** | (2011.01) |
| ***H01R 13/6473*** | (2011.01) |
| ***H01R 13/6585*** | (2011.01) |

(52) U.S. Cl.

CPC ..... *H01R 13/6461* (2013.01); *H01R 13/6473* (2013.01); *H01R 13/6474* (2013.01); *H01R 13/6585* (2013.01)

(56) References Cited

U.S. PATENT DOCUMENTS

| | | | |
|---|---|---|---|
| 3,002,162 | A | 9/1961 | Garstang |
| 3,007,131 | A | 10/1961 | Dahlgren et al. |
| 3,134,950 | A | 5/1964 | Cook |
| 3,229,240 | A | 1/1966 | Harrison et al. |
| 3,322,885 | A | 5/1967 | May et al. |
| 3,594,613 | A | 7/1971 | Prietula |
| 3,715,706 | A | 2/1973 | Michel et al. |
| 3,786,372 | A | 1/1974 | Epis et al. |
| 3,825,874 | A | 7/1974 | Peverill |
| 3,863,181 | A | 1/1975 | Glance et al. |
| 4,083,615 | A | 4/1978 | Volinskie |
| 4,155,613 | A | 5/1979 | Brandeau |
| 4,157,612 | A | 6/1979 | Rainal |
| 4,195,272 | A | 3/1980 | Boutros |
| 4,276,523 | A | 6/1981 | Boutros et al. |
| 4,307,926 | A | 12/1981 | Smith |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,615,578 | A | 10/1986 | Stadler et al. |
| 4,632,476 | A | 12/1986 | Schell |
| 4,636,752 | A | 1/1987 | Saito |
| 4,639,054 | A | 1/1987 | Kersbergen |
| 4,682,129 | A | 7/1987 | Bakermans et al. |
| 4,697,862 | A | 10/1987 | Hasircoglu |
| 4,708,660 | A | 11/1987 | Claeys et al. |
| 4,724,409 | A | 2/1988 | Lehman |
| 4,728,762 | A | 3/1988 | Roth et al. |
| 4,751,479 | A | 6/1988 | Parr |
| 4,761,147 | A | 8/1988 | Gauthier |
| 4,795,375 | A | 1/1989 | Williams |
| 4,806,107 | A | 2/1989 | Arnold et al. |
| 4,826,443 | A | 5/1989 | Lockard |
| 4,846,724 | A | 7/1989 | Sasaki et al. |
| 4,846,727 | A | 7/1989 | Glover et al. |
| 4,871,316 | A | 10/1989 | Herrell et al. |
| 4,878,155 | A | 10/1989 | Conley |
| 4,889,500 | A | 12/1989 | Lazar et al. |
| 4,913,667 | A | 4/1990 | Muz |
| 4,924,179 | A | 5/1990 | Sherman |
| 4,948,922 | A | 8/1990 | Varadan et al. |
| 4,949,379 | A | 8/1990 | Cordell |
| 4,970,354 | A | 11/1990 | Iwasa et al. |
| 4,975,084 | A | 12/1990 | Redder et al. |
| 4,990,099 | A | 2/1991 | Marin et al. |
| 4,992,060 | A | 2/1991 | Meyer |
| 5,000,700 | A | 3/1991 | Masubuchi et al. |
| 5,066,236 | A | 11/1991 | Broeksteeg |
| 5,141,454 | A | 8/1992 | Garrett et al. |
| 5,150,086 | A | 9/1992 | Ito |
| 5,168,252 | A | 12/1992 | Naito |
| 5,168,432 | A | 12/1992 | Murphy et al. |
| 5,176,538 | A | 1/1993 | Hansell, III et al. |
| 5,197,893 | A | 3/1993 | Morlion et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,306,171 | A | 4/1994 | Marshall |
| 5,332,979 | A | 7/1994 | Roskewitsch et al. |
| 5,334,050 | A | 8/1994 | Andrews |
| 5,340,334 | A | 8/1994 | Nguyen |
| 5,346,410 | A | 9/1994 | Moore, Jr. |
| 5,387,130 | A | 2/1995 | Redder et al. |
| 5,402,088 | A | 3/1995 | Pierro et al. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,435,757 | A | 7/1995 | Fedder et al. |
| 5,441,424 | A | 8/1995 | Morlion et al. |
| 5,456,619 | A | 10/1995 | Belopolsky et al. |
| 5,461,392 | A | 10/1995 | Mott et al. |
| 5,484,310 | A | 1/1996 | McNamara et al. |
| 5,487,673 | A | 1/1996 | Hurtarte |
| 5,496,183 | A | 3/1996 | Soes et al. |
| 5,499,935 | A | 3/1996 | Powell |
| 5,509,827 | A | 4/1996 | Huppenthal et al. |
| 5,551,893 | A | 9/1996 | Johnson |
| 5,554,038 | A | 9/1996 | Morlion et al. |
| 5,562,497 | A | 10/1996 | Yagi et al. |
| 5,597,328 | A | 1/1997 | Mouissie |
| 5,598,627 | A | 2/1997 | Saka et al. |
| 5,632,634 | A | 5/1997 | Soes |
| 5,651,702 | A | 7/1997 | Hanning et al. |
| 5,669,789 | A | 9/1997 | Law |
| 5,691,506 | A | 11/1997 | Miyazaki et al. |
| 5,702,258 | A | 12/1997 | Provencher et al. |
| 5,733,148 | A | 3/1998 | Kaplan et al. |
| 5,743,765 | A | 4/1998 | Andrews et al. |
| 5,781,759 | A | 7/1998 | Kashiwabara |
| 5,796,323 | A | 8/1998 | Uchikoba et al. |
| 5,831,491 | A | 11/1998 | Buer et al. |
| 5,924,899 | A | 7/1999 | Paagman |
| 5,981,869 | A | 11/1999 | Kroger |
| 5,982,253 | A | 11/1999 | Perrin et al. |
| 6,019,616 | A | 2/2000 | Yagi et al. |
| 6,053,770 | A | 4/2000 | Blom |
| 6,083,046 | A | 7/2000 | Wu et al. |
| 6,095,825 | A | 8/2000 | Liao |
| 6,095,872 | A | 8/2000 | Lang et al. |
| 6,116,926 | A | 9/2000 | Ortega et al. |
| 6,144,559 | A | 11/2000 | Johnson et al. |
| 6,146,202 | A | 11/2000 | Ramey et al. |
| 6,152,747 | A | 11/2000 | McNamara |
| 6,168,466 | B1 | 1/2001 | Chiou |
| 6,168,469 | B1 | 1/2001 | Lu |
| 6,174,203 | B1 | 1/2001 | Asao |
| 6,174,944 | B1 | 1/2001 | Chiba et al. |
| 6,203,376 | B1 | 3/2001 | Magajne et al. |
| 6,217,372 | B1 | 4/2001 | Reed |
| 6,273,753 | B1 | 8/2001 | Ko |
| 6,273,758 | B1 | 8/2001 | Lloyd et al. |
| 6,285,542 | B1 | 9/2001 | Kennedy, III et al. |
| 6,293,827 | B1 | 9/2001 | Stokoe |
| 6,299,438 | B1 | 10/2001 | Sahagian et al. |
| 6,299,483 | B1 | 10/2001 | Cohen et al. |
| 6,322,379 | B1 | 11/2001 | Ortega et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,364,711 | B1 | 4/2002 | Berg et al. |
| 6,364,718 | B1 | 4/2002 | Polgar et al. |
| 6,366,471 | B1 | 4/2002 | Edwards et al. |
| 6,371,788 | B1 | 4/2002 | Bowling et al. |

(56) References Cited

U.S. PATENT DOCUMENTS 6,375,510 B2 4/2002 Asao
6,379,188 B1 4/2002 Cohen et al.
6,398,588 B1 6/2002 Bickford
6,409,543 B1 6/2002 Astbury, Jr. et al.
6,452,789 B1 9/2002 Pallotti et al.
6,482,017 B1 11/2002 Van Doorn
6,489,563 B1 12/2002 Zhao et al.
6,503,103 B1 1/2003 Cohen et al.
6,506,076 B2 1/2003 Cohen et al.
6,517,360 B1 2/2003 Cohen
6,530,790 B1 3/2003 McNamara et al.
6,535,367 B1 3/2003 Carpenter et al.
6,537,086 B1 3/2003 Mac Mullin
6,537,087 B2 3/2003 McNamara et al.
6,551,140 B2 4/2003 Billman et al.
6,554,647 B1 4/2003 Cohen et al.
6,565,387 B2 5/2003 Cohen
6,574,115 B2 6/2003 Asano et al.
6,575,772 B1 6/2003 Soubh et al.
6,579,116 B2 6/2003 Brennan et al.
6,582,244 B2 6/2003 Fogg et al.
6,592,390 B1 7/2003 Davis et al.
6,592,401 B1 7/2003 Gardner et al.
6,595,802 B1 7/2003 Watanabe et al.
6,602,095 B2 8/2003 Astbury, Jr. et al.
6,607,402 B2 8/2003 Cohen et al.
6,616,864 B1 9/2003 Jiang et al.
6,652,296 B2 11/2003 Kuroda et al.
6,652,318 B1 11/2003 Winings et al.
6,655,966 B2 12/2003 Rothermel et al.
6,685,501 B1 2/2004 Wu et al.
6,692,262 B1 2/2004 Loveless
6,705,893 B1 3/2004 Ko
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,797,891 B1 9/2004 Blair et al.
6,814,619 B1 11/2004 Stokoe et al.
6,824,426 B1 11/2004 Spink, Jr.
6,830,489 B2 12/2004 Aoyama
6,843,657 B2 1/2005 Driscoll et al.
6,872,085 B1 3/2005 Cohen et al.
6,903,934 B2 6/2005 Lo et al.
6,916,183 B2 7/2005 Alger et al.
6,932,649 B1 8/2005 Rothermel et al.
6,955,565 B2 10/2005 Lloyd et al.
6,971,887 B1 12/2005 Trobough
6,979,226 B2 12/2005 Otsu et al.
7,044,794 B2 5/2006 Consoli et al.
7,056,128 B2 6/2006 Driscoll et al.
7,057,570 B2 6/2006 Irion, II et al.
7,070,446 B2 7/2006 Henry et al.
7,074,086 B2 7/2006 Cohen et al.
7,077,658 B1 7/2006 Ashman et al.
7,094,102 B2 8/2006 Cohen et al.
7,108,556 B2 9/2006 Cohen et al.
7,148,428 B2 12/2006 Meier et al.
7,163,421 B1 1/2007 Cohen et al.
7,214,097 B1 5/2007 Hsu et al.
7,223,915 B2 5/2007 Hackman
7,234,944 B2 6/2007 Nordin et al.
7,244,137 B2 7/2007 Renfro et al.
7,267,515 B2 9/2007 Lappohn
7,280,372 B2 10/2007 Grundy et al.
7,285,018 B2 10/2007 Kenny et al.
7,307,293 B2 12/2007 Fjelstad et al.
7,331,816 B2 2/2008 Krohn et al.
7,331,830 B2 2/2008 Minich
7,335,063 B2 2/2008 Cohen et al.
7,354,274 B2 4/2008 Minich
7,371,117 B2 5/2008 Gailus
7,384,275 B2 6/2008 Ngo
7,402,048 B2 7/2008 Meier et al.
7,422,483 B2 9/2008 Avery et al.
7,431,608 B2 10/2008 Sakaguchi et al.
7,445,471 B1 11/2008 Scherer et al.
7,462,942 B2 12/2008 Tan et al.
7,485,012 B2 2/2009 Daugherty et al.
7,494,383 B2 2/2009 Cohen et al.
7,534,142 B2 5/2009 Avery et al.
7,540,781 B2 6/2009 Kenny et al.
7,549,897 B2 6/2009 Fedder et al.
7,581,990 B2 9/2009 Kirk et al.
7,588,464 B2 9/2009 Kim
7,613,011 B2 11/2009 Grundy et al.
7,621,779 B2 11/2009 Laurx et al.
7,652,381 B2 1/2010 Grundy et al.
7,654,831 B1 2/2010 Wu
7,658,654 B2 2/2010 Ohyama et al.
7,686,659 B2 3/2010 Peng
7,690,930 B2 4/2010 Chen et al.
7,690,946 B2 4/2010 Knaub et al.
7,713,077 B1 5/2010 McGowan et al.
7,719,843 B2 5/2010 Dunham
7,722,401 B2 5/2010 Kirk et al.
7,731,537 B2 6/2010 Amleshi et al.
7,744,414 B2 6/2010 Scherer et al.
7,753,731 B2 7/2010 Cohen et al.
7,771,233 B2 8/2010 Gailus
7,775,802 B2 8/2010 Defibaugh et al.
7,789,676 B2 9/2010 Morgan et al.
7,794,240 B2 9/2010 Cohen et al.
7,794,278 B2 9/2010 Cohen et al.
7,811,129 B2 10/2010 Glover et al.
7,819,675 B2 10/2010 Ko et al.
7,824,197 B1 11/2010 Westman et al.
7,857,630 B2 12/2010 Hermant et al.
7,862,344 B2 1/2011 Morgan et al.
7,871,296 B2 1/2011 Fowler et al.
7,874,873 B2 1/2011 Do et al.
7,887,371 B2 2/2011 Kenny et al.
7,906,730 B2 3/2011 Atkinson et al.
7,914,304 B2 3/2011 Cartier et al.
7,967,637 B2 6/2011 Fedder et al.
7,976,318 B2 7/2011 Fedder et al.
7,985,097 B2 7/2011 Gulla
8,002,581 B1 8/2011 Whiteman, Jr. et al.
8,016,616 B2 9/2011 Glover et al.
8,018,733 B2 9/2011 Jia
8,036,500 B2 10/2011 McColloch
8,057,267 B2 11/2011 Johnescu
8,083,553 B2 12/2011 Manter et al.
8,100,699 B1 1/2012 Costello
8,157,573 B2 4/2012 Tanaka
8,162,675 B2 4/2012 Regnier et al.
8,167,651 B2 5/2012 Glover et al.
8,182,289 B2 5/2012 Stokoe et al.
8,192,222 B2 6/2012 Kameyama
8,197,285 B2 6/2012 Farmer
8,210,877 B2 7/2012 Droesbeke
8,215,968 B2 7/2012 Cartier et al.
8,226,441 B2 7/2012 Regnier et al.
8,251,745 B2 8/2012 Johnescu
8,272,877 B2 9/2012 Stokoe et al.
8,308,491 B2 11/2012 Nichols et al.
8,308,512 B2 11/2012 Ritter et al.
8,337,243 B2 12/2012 Elkhatib et al.
8,338,713 B2 12/2012 Fjelstad et al.
8,371,875 B2 2/2013 Gailus
8,371,876 B2 2/2013 Davis
8,382,524 B2 2/2013 Khilchenko et al.
8,398,433 B1 3/2013 Yang
8,419,472 B1 4/2013 Swanger et al.
8,439,704 B2 5/2013 Reed
8,449,312 B2 5/2013 Lang et al.
8,449,329 B1 * 5/2013 Schroll ..... H01R 13/6586 439/607.05
8,449,330 B1 * 5/2013 Schroll ..... H01R 13/514 439/607.06
8,465,302 B2 6/2013 Regnier et al.
8,469,745 B2 6/2013 Davis et al.
8,475,209 B1 7/2013 Whiteman, Jr. et al.

(56) References Cited

U.S. PATENT DOCUMENTS 8,535,065 B2 9/2013 Costello
8,540,525 B2 9/2013 Regnier et al.
8,550,861 B2 10/2013 Cohen et al.
8,553,102 B2 10/2013 Yamada
8,556,657 B1 10/2013 Nichols
8,588,561 B2 11/2013 Zbinden et al.
8,588,562 B2 11/2013 Zbinden et al.
8,597,055 B2 12/2013 Regnier et al.
8,657,627 B2 2/2014 McNamara et al.
8,662,924 B2 3/2014 Davis et al.
8,672,707 B2 3/2014 Nichols et al.
8,678,860 B2 3/2014 Minich et al.
8,690,604 B2 4/2014 Davis
8,715,003 B2 5/2014 Buck et al.
8,740,644 B2 6/2014 Long
8,753,145 B2 6/2014 Lang et al.
8,758,051 B2 6/2014 Nonen et al.
8,771,016 B2 7/2014 Atkinson et al.
8,787,711 B2 7/2014 Zbinden et al.
8,804,342 B2 8/2014 Behziz et al.
8,814,595 B2 8/2014 Cohen et al.
8,845,364 B2 9/2014 Wanha et al.
8,864,521 B2 10/2014 Atkinson et al.
8,888,531 B2 11/2014 Jeon
8,888,533 B2 11/2014 Westman et al.
8,911,255 B2 12/2014 Scherer et al.
8,926,377 B2 1/2015 Kirk et al.
8,944,831 B2 2/2015 Stoner et al.
8,992,236 B2 3/2015 Wittig et al.
8,992,237 B2 3/2015 Regnier et al.
8,998,642 B2 4/2015 Manter et al.
9,004,942 B2 4/2015 Paniauqa
9,011,177 B2 4/2015 Lloyd et al.
9,022,806 B2 5/2015 Cartier, Jr. et al.
9,028,201 B2 5/2015 Kirk et al.
9,028,281 B2 5/2015 Kirk et al.
9,035,183 B2 5/2015 Kodama et al.
9,040,824 B2 5/2015 Guetig et al.
9,071,001 B2 6/2015 Scherer et al.
9,118,151 B2 8/2015 Tran et al.
9,119,292 B2 8/2015 Gundel
9,124,009 B2 9/2015 Atkinson et al.
9,142,921 B2 9/2015 Wanha et al.
9,203,171 B2 12/2015 Yu et al.
9,214,768 B2 12/2015 Pao et al.
9,219,335 B2 12/2015 Atkinson et al.
9,225,085 B2 12/2015 Cartier, Jr. et al.
9,232,676 B2 1/2016 Sechrist et al.
9,246,251 B2 1/2016 Regnier et al.
9,257,794 B2 2/2016 Wanha et al.
9,312,618 B2 4/2016 Regnier et al.
9,350,108 B2 5/2016 Long
9,356,401 B1 5/2016 Horning et al.
9,362,678 B2 6/2016 Wanha et al.
9,373,917 B2 6/2016 Sypolt et al.
9,374,165 B2 6/2016 Zbinden et al.
9,385,455 B2 7/2016 Regnier et al.
9,391,407 B1 7/2016 Bucher et al.
9,413,112 B2 8/2016 Helster et al.
9,450,344 B2 9/2016 Cartier, Jr. et al.
9,490,558 B2 11/2016 Wanha et al.
9,509,101 B2 11/2016 Cartier, Jr. et al.
9,520,689 B2 12/2016 Cartier, Jr. et al.
9,531,133 B1 12/2016 Horning et al.
9,553,381 B2 1/2017 Regnier
9,559,446 B1 1/2017 Wetzel et al.
9,564,696 B2 2/2017 Gulla
9,608,348 B2 3/2017 Wanha et al.
9,651,752 B2 5/2017 Zbinden et al.
9,660,364 B2 5/2017 Wig et al.
9,666,961 B2 5/2017 Horning et al.
9,685,736 B2 6/2017 Gailus et al.
9,774,144 B2 9/2017 Cartier, Jr. et al.
9,801,301 B1 10/2017 Costello
9,841,572 B2 12/2017 Zbinden et al.
9,843,135 B2 12/2017 Guetig et al.
9,876,319 B2 1/2018 Zhao et al.
9,929,512 B1 3/2018 Trout et al.
9,985,367 B2 5/2018 Wanha et al.
9,985,389 B1 5/2018 Morgan et al.
10,056,706 B2 8/2018 Wanha et al.
10,062,984 B2 8/2018 Regnier
10,069,225 B2 9/2018 Wanha et al.
10,096,945 B2 10/2018 Cartier, Jr. et al.
10,170,869 B2 * 1/2019 Gailus ..... H01R 13/6461
10,181,663 B2 1/2019 Regnier
10,205,286 B2 2/2019 Provencher et al.
RE47,342 E 4/2019 Lloyd et al.
10,305,224 B2 5/2019 Girard, Jr.
RE48,230 E 9/2020 Lloyd et al.
10,840,649 B2 11/2020 Gailus et al.
10,855,034 B2 12/2020 Gailus et al.
10,931,062 B2 2/2021 Cohen et al.
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0088628 A1 7/2002 Chen
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0157865 A1 10/2002 Noda
2002/0187688 A1 12/2002 Marvin et al.
2003/0073331 A1 4/2003 Peloza et al.
2003/0119362 A1 6/2003 Nelson et al.
2004/0005815 A1 1/2004 Mizumura et al.
2004/0018757 A1 1/2004 Lang et al.
2004/0020674 A1 2/2004 McFadden et al.
2004/0094328 A1 5/2004 Fjelstad et al.
2004/0110421 A1 6/2004 Broman et al.
2004/0115968 A1 6/2004 Cohen
2004/0121633 A1 6/2004 David et al.
2004/0121652 A1 6/2004 Gailus
2004/0155328 A1 8/2004 Kline
2004/0196112 A1 10/2004 Welbon et al.
2004/0224559 A1 11/2004 Nelson et al.
2004/0229510 A1 11/2004 Lloyd et al.
2004/0259419 A1 12/2004 Payne et al.
2004/0264894 A1 12/2004 Cooke et al.
2005/0006126 A1 1/2005 Aisenbrey
2005/0032430 A1 2/2005 Otsu et al.
2005/0070160 A1 3/2005 Cohen et al.
2005/0093127 A1 5/2005 Fjelstad et al.
2005/0118869 A1 6/2005 Evans
2005/0133245 A1 6/2005 Katsuyama et al.
2005/0142944 A1 6/2005 Ling et al.
2005/0176835 A1 8/2005 Kobayashi et al.
2005/0233610 A1 10/2005 Tutt et al.
2005/0239339 A1 10/2005 Pepe
2005/0283974 A1 12/2005 Richard et al.
2005/0287869 A1 12/2005 Kenny et al.
2006/0001163 A1 1/2006 Kolbehdari et al.
2006/0068640 A1 3/2006 Gailus
2006/0079119 A1 4/2006 Wu
2006/0091507 A1 5/2006 Fjelstad et al.
2006/0216969 A1 9/2006 Bright et al.
2006/0228922 A1 10/2006 Morriss
2007/0004282 A1 1/2007 Cohen et al.
2007/0021001 A1 1/2007 Laurx et al.
2007/0021002 A1 1/2007 Laurx et al.
2007/0032104 A1 2/2007 Yamada et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappohn
2007/0197095 A1 8/2007 Feldman et al.
2007/0207641 A1 9/2007 Minich
2007/0218765 A1 9/2007 Cohen et al.
2007/0243741 A1 10/2007 Yang
2007/0254517 A1 11/2007 Olson et al.
2008/0026638 A1 1/2008 Cohen et al.
2008/0194146 A1 8/2008 Gailus

(56) References Cited

U.S. PATENT DOCUMENTS

| | | | |
|---|---|---|---|
| 2008/0200955 | A1 | 8/2008 | Tepic |
| 2008/0207023 | A1 | 8/2008 | Tuin et al. |
| 2008/0246555 | A1 | 10/2008 | Kirk et al. |
| 2008/0248658 | A1 | 10/2008 | Cohen et al. |
| 2008/0248659 | A1 | 10/2008 | Cohen et al. |
| 2008/0248660 | A1 | 10/2008 | Kirk et al. |
| 2008/0264673 | A1 | 10/2008 | Chi et al. |
| 2008/0267620 | A1 | 10/2008 | Cole et al. |
| 2008/0297988 | A1 | 12/2008 | Chau |
| 2008/0305689 | A1 | 12/2008 | Zhang et al. |
| 2009/0011641 | A1 | 1/2009 | Cohen et al. |
| 2009/0011645 | A1 | 1/2009 | Laurx et al. |
| 2009/0011664 | A1 | 1/2009 | Laurx et al. |
| 2009/0017682 | A1 | 1/2009 | Amleshi et al. |
| 2009/0023330 | A1 | 1/2009 | Stoner et al. |
| 2009/0051558 | A1 | 2/2009 | Dorval |
| 2009/0098767 | A1 | 4/2009 | Long |
| 2009/0117386 | A1 | 5/2009 | Vacanti et al. |
| 2009/0130913 | A1 | 5/2009 | Yi et al. |
| 2009/0130918 | A1 | 5/2009 | Nguyen et al. |
| 2009/0166082 | A1 | 7/2009 | Liu et al. |
| 2009/0176400 | A1 | 7/2009 | Davis et al. |
| 2009/0205194 | A1 | 8/2009 | Semba et al. |
| 2009/0215309 | A1 | 8/2009 | Mongold et al. |
| 2009/0227141 | A1 | 9/2009 | Pan |
| 2009/0239395 | A1 | 9/2009 | Cohen et al. |
| 2009/0247012 | A1 | 10/2009 | Pan |
| 2009/0291593 | A1 | 11/2009 | Atkinson et al. |
| 2009/0305533 | A1 | 12/2009 | Feldman et al. |
| 2009/0311908 | A1 | 12/2009 | Fogg et al. |
| 2010/0009571 | A1 | 1/2010 | Scherer et al. |
| 2010/0029105 | A1 | 2/2010 | Knaub et al. |
| 2010/0081302 | A1 | 4/2010 | Atkinson et al. |
| 2010/0099299 | A1 | 4/2010 | Moriyama et al. |
| 2010/0112850 | A1 | 5/2010 | Rao et al. |
| 2010/0144167 | A1 | 6/2010 | Fedder et al. |
| 2010/0144168 | A1 | 6/2010 | Glover et al. |
| 2010/0144175 | A1 | 6/2010 | Heister et al. |
| 2010/0144201 | A1 | 6/2010 | Defibaugh et al. |
| 2010/0144203 | A1 | 6/2010 | Glover et al. |
| 2010/0144204 | A1 | 6/2010 | Knaub et al. |
| 2010/0177489 | A1 | 7/2010 | Yagisawa |
| 2010/0183141 | A1 | 7/2010 | Arai et al. |
| 2010/0203768 | A1 | 8/2010 | Kondo et al. |
| 2010/0221951 | A1 | 9/2010 | Pepe et al. |
| 2010/0291806 | A1 | 11/2010 | Minich et al. |
| 2010/0294530 | A1 | 11/2010 | Atkinson et al. |
| 2010/0330851 | A1 | 12/2010 | Costello |
| 2011/0003509 | A1 | 1/2011 | Gailus |
| 2011/0074213 | A1 | 3/2011 | Schaffer et al. |
| 2011/0104948 | A1 | 5/2011 | Girard, Jr. et al. |
| 2011/0130038 | A1 | 6/2011 | Cohen et al. |
| 2011/0177699 | A1 | 7/2011 | Crofoot et al. |
| 2011/0212632 | A1 | 9/2011 | Stokoe et al. |
| 2011/0212633 | A1 | 9/2011 | Regnier et al. |
| 2011/0212649 | A1 | 9/2011 | Stokoe et al. |
| 2011/0212650 | A1 | 9/2011 | Amleshi et al. |
| 2011/0223807 | A1 | 9/2011 | Jeon et al. |
| 2011/0230095 | A1 | 9/2011 | Atkinson et al. |
| 2011/0230096 | A1 | 9/2011 | Atkinson et al. |
| 2011/0230104 | A1 | 9/2011 | Lang et al. |
| 2011/0263156 | A1 | 10/2011 | Ko |
| 2011/0287663 | A1 | 11/2011 | Gailus et al. |
| 2011/0300757 | A1 | 12/2011 | Regnier et al. |
| 2012/0003848 | A1 | 1/2012 | Casher et al. |
| 2012/0034820 | A1 | 2/2012 | Lang et al. |
| 2012/0077369 | A1 | 3/2012 | Andersen |
| 2012/0077380 | A1 | 3/2012 | Minich et al. |
| 2012/0094536 | A1 | 4/2012 | Khilchenko et al. |
| 2012/0135643 | A1 | 5/2012 | Lange et al. |
| 2012/0156929 | A1 | 6/2012 | Manter et al. |
| 2012/0184136 | A1 | 7/2012 | Ritter |
| 2012/0202363 | A1 | 8/2012 | McNamara et al. |
| 2012/0202386 | A1 | 8/2012 | McNamara et al. |
| 2012/0214344 | A1 | 8/2012 | Cohen et al. |
| 2012/0329294 | A1 | 12/2012 | Raybold et al. |
| 2013/0012038 | A1 | 1/2013 | Kirk et al. |
| 2013/0017715 | A1 | 1/2013 | Laarhoven et al. |
| 2013/0017733 | A1 | 1/2013 | Kirk et al. |
| 2013/0078870 | A1 | 3/2013 | Milbrand, Jr. |
| 2013/0092429 | A1 | 4/2013 | Ellison |
| 2013/0109232 | A1 | 5/2013 | Paniaqua |
| 2013/0143442 | A1 | 6/2013 | Cohen et al. |
| 2013/0178107 | A1 | 7/2013 | Costello et al. |
| 2013/0196553 | A1 | 8/2013 | Gailus |
| 2013/0210246 | A1 | 8/2013 | Davis et al. |
| 2013/0223036 | A1 | 8/2013 | Herring et al. |
| 2013/0225006 | A1 | 8/2013 | Khilchenko et al. |
| 2013/0273781 | A1 | 10/2013 | Buck et al. |
| 2013/0288521 | A1 | 10/2013 | McClellan et al. |
| 2013/0288525 | A1 | 10/2013 | McClellan et al. |
| 2013/0288539 | A1 | 10/2013 | McClellan et al. |
| 2013/0340251 | A1 | 12/2013 | Regnier et al. |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0041937 | A1 | 2/2014 | Lloyd et al. |
| 2014/0057493 | A1 | 2/2014 | De Geest et al. |
| 2014/0057494 | A1 | 2/2014 | Cohen |
| 2014/0057498 | A1 | 2/2014 | Cohen |
| 2014/0065883 | A1 | 3/2014 | Cohen et al. |
| 2014/0073174 | A1 | 3/2014 | Yang |
| 2014/0073181 | A1 | 3/2014 | Yang |
| 2014/0194004 | A1 | 7/2014 | Picket et al. |
| 2014/0242844 | A1 | 8/2014 | Wanha et al. |
| 2014/0273551 | A1 | 9/2014 | Resendez et al. |
| 2014/0273557 | A1 | 9/2014 | Cartier, Jr. et al. |
| 2014/0273627 | A1 | 9/2014 | Cartier, Jr. et al. |
| 2014/0287627 | A1 | 9/2014 | Cohen |
| 2014/0308852 | A1 | 10/2014 | Gulla |
| 2014/0335707 | A1 | 11/2014 | Johnescu et al. |
| 2014/0335736 | A1 | 11/2014 | Regnier et al. |
| 2015/0031238 | A1 | 1/2015 | Davis et al. |
| 2015/0056856 | A1 | 2/2015 | Atkinson et al. |
| 2015/0079829 | A1 | 3/2015 | Brodsgaard |
| 2015/0079845 | A1 | 3/2015 | Wanha et al. |
| 2015/0180578 | A1 | 6/2015 | Leigh et al. |
| 2015/0194751 | A1 | 7/2015 | Herring |
| 2015/0200496 | A1 | 7/2015 | Simpson et al. |
| 2015/0207247 | A1 | 7/2015 | Regnier et al. |
| 2015/0236450 | A1 | 8/2015 | Davis |
| 2015/0236451 | A1 | 8/2015 | Cartier, Jr. et al. |
| 2015/0236452 | A1 | 8/2015 | Cartier, Jr. et al. |
| 2015/0255926 | A1 | 9/2015 | Paniagua |
| 2015/0280351 | A1 | 10/2015 | Bertsch |
| 2015/0303608 | A1 | 10/2015 | Zerebilov et al. |
| 2015/0357736 | A1 | 12/2015 | Tran et al. |
| 2015/0357761 | A1 | 12/2015 | Wanha et al. |
| 2016/0013594 | A1 | 1/2016 | Costello et al. |
| 2016/0013596 | A1 | 1/2016 | Regnier |
| 2016/0028189 | A1 | 1/2016 | Resendez et al. |
| 2016/0104956 | A1 | 4/2016 | Santos et al. |
| 2016/0111825 | A1 | 4/2016 | Wanha et al. |
| 2016/0141807 | A1 | 5/2016 | Gailus et al. |
| 2016/0149343 | A1 | 5/2016 | Atkinson et al. |
| 2016/0149362 | A1 | 5/2016 | Ritter et al. |
| 2016/0150633 | A1 | 5/2016 | Cartier, Jr. |
| 2016/0150639 | A1 | 5/2016 | Gailus et al. |
| 2016/0150645 | A1 | 5/2016 | Gailus et al. |
| 2016/0181713 | A1 | 6/2016 | Peloza et al. |
| 2016/0181732 | A1 | 6/2016 | Laurx et al. |
| 2016/0190747 | A1 | 6/2016 | Regnier et al. |
| 2016/0197423 | A1 | 7/2016 | Regnier |
| 2016/0218455 | A1 | 7/2016 | Sayre et al. |
| 2016/0233598 | A1 | 8/2016 | Wittig |
| 2016/0240946 | A1 | 8/2016 | Evans et al. |
| 2016/0268714 | A1 | 9/2016 | Wanha et al. |
| 2016/0274316 | A1 | 9/2016 | Verdiell |
| 2016/0308296 | A1 | 10/2016 | Pitten et al. |
| 2016/0322770 | A1 | 11/2016 | Zerebilov |
| 2016/0344141 | A1 | 11/2016 | Cartier, Jr. et al. |
| 2017/0025783 | A1 | 1/2017 | Astbury et al. |
| 2017/0033478 | A1 | 2/2017 | Wanha et al. |
| 2017/0042070 | A1 | 2/2017 | Baumler et al. |

(56) References Cited

U.S. PATENT DOCUMENTS

| | | | | |
|---|---|---|---|---|
| 2017/0047692 | A1 | 2/2017 | Cartier, Jr. et al. | |
| 2017/0077643 | A1 | 3/2017 | Zbinden et al. | |
| 2017/0093093 | A1 | 3/2017 | Cartier, Jr. et al. | |
| 2017/0098901 | A1 | 4/2017 | Regnier | |
| 2017/0162960 | A1 | 6/2017 | Wanha et al. | |
| 2017/0294743 | A1* | 10/2017 | Gailus | H01R 12/585 |
| 2017/0302011 | A1 | 10/2017 | Wanha et al. | |
| 2017/0338595 | A1 | 11/2017 | Girard, Jr. | |
| 2017/0365942 | A1 | 12/2017 | Regnier | |
| 2017/0365943 | A1 | 12/2017 | Wanha et al. | |
| 2018/0006416 | A1 | 1/2018 | Lloyd et al. | |
| 2018/0034175 | A1 | 2/2018 | Lloyd et al. | |
| 2018/0034190 | A1 | 2/2018 | Ngo | |
| 2018/0040989 | A1 | 2/2018 | Chen | |
| 2018/0109043 | A1 | 4/2018 | Provencher et al. | |
| 2018/0145438 | A1 | 5/2018 | Cohen | |
| 2018/0219331 | A1 | 8/2018 | Cartier, Jr. et al. | |
| 2018/0219332 | A1 | 8/2018 | Brungard et al. | |
| 2018/0366880 | A1 | 12/2018 | Zerebilov et al. | |
| 2019/0013625 | A1 | 1/2019 | Gailus et al. | |
| 2019/0020155 | A1 | 1/2019 | Trout et al. | |
| 2019/0044284 | A1 | 2/2019 | Dunham | |
| 2019/0044285 | A1 | 2/2019 | Dunham | |
| 2019/0157812 | A1 | 5/2019 | Gailus et al. | |
| 2019/0173236 | A1 | 6/2019 | Provencher et al. | |

FOREIGN PATENT DOCUMENTS

| | | | |
|---|---|---|---|
| CN | 101124697 | A | 2/2008 |
| CN | 101164204 | A | 4/2008 |
| CN | 101312275 | A | 11/2008 |
| CN | 101667686 | A | 3/2010 |
| CN | 101752700 | A | 6/2010 |
| CN | 101783449 | A | 7/2010 |
| CN | 201562814 | U | 8/2010 |
| CN | 101958477 | A | 1/2011 |
| CN | 102509956 | A | 6/2012 |
| CN | 102570105 | A | 7/2012 |
| CN | 102598430 | A | 7/2012 |
| CN | 202678544 | U | 1/2013 |
| CN | 103915727 | A | 7/2014 |
| DE | 3447556 | A1 | 7/1986 |
| EP | 1 207 587 | A2 | 5/2002 |
| EP | 1 779 472 | A1 | 5/2007 |
| EP | 2 169 770 | A2 | 3/2010 |
| GB | 1272347 | A | 4/1972 |
| JP | 02-079571 | U | 6/1990 |
| JP | 7302649 | A2 | 11/1995 |
| JP | 2000-311749 | A2 | 11/2000 |
| JP | 2006-108115 | A2 | 4/2006 |
| JP | 2011-018651 | A | 1/2011 |
| JP | 2012-516021 | A | 7/2012 |
| JP | 2016-528688 | A | 9/2016 |
| TW | M357771 | U | 5/2009 |
| WO | WO 88/05218 | A1 | 7/1988 |
| WO | WO 99/56352 | A2 | 11/1999 |
| WO | WO 2004/059794 | A2 | 7/2004 |
| WO | WO 2004/059801 | A1 | 7/2004 |
| WO | WO 2006/002356 | A1 | 1/2006 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/072322 | A1 | 6/2008 |
| WO | WO 2008/124057 | A1 | 10/2008 |
| WO | WO 2010/039188 | A1 | 4/2010 |
| WO | WO 2012/078434 | A2 | 6/2012 |
| WO | WO 2013/006592 | A2 | 1/2013 |
| WO | WO 2015/013430 | A1 | 1/2015 |
| WO | WO 2015/112717 | A1 | 7/2015 |

OTHER PUBLICATIONS

CN 201580069567.7, Oct. 9, 2019, Chinese Office Action.
CN 202010397391.0, Apr. 1, 2021, Chinese Office Action.
CN 202010397224.6, Apr. 28, 2021, Chinese Office Action.
EP 11166820.8, Jan. 24, 2012, Extended European Search Report.
PCT/US2005/034605, Jan. 26, 2006, International Search Report and Written Opinion.
PCT/US2006/025562, Oct. 31, 2007, International Search Report and Written Opinion.
PCT/US2010/056482, Mar. 14, 2011, International Search Report and Written Opinion.
PCT/US2010/056495, Jan. 25, 2011, International Search Report and Written Opinion.
PCT/US2011/026139, Nov. 22, 20211, International Search Report and Written Opinion.
PCT/US2011/034747, Jul. 28, 2011, International Search Report and Written Opinion.
PCT/US2012/023689, Sep. 12, 2012, International Search Report and Written Opinion.
PCT/US2012/060610, Mar. 29, 2013, International Search Report and Written Opinion.
PCT/US2014/026381, Aug. 12, 2014, International Search Report and Written Opinion.
PCT/US2014/026381, Sep. 24, 2015, International Preliminary Report on Patentability.
PCT/US2015/012463, May 13, 2015, International Search Report and Written Opinion.
PCT/US2015/012542, Apr. 30, 2015, International Search Report and Written Opinion.
PCT/US2015/060472, May 26, 2017, International Preliminary Report on Patentability.
PCT/US2015/060472, Mar. 11, 2016, International Search Report and Written Opinion.
PCT/US2016/043358, Nov. 3, 2016, International Search Report and Written Opinion.
PCT/US2017/033122, Aug. 8, 2017, International Search Report and Written Opinion.
PCT/US2017/033122, Nov. 29, 2018, International Preliminary Report on Patentability.
PCT/US2017/057402, Jan. 19, 2018, International Search Report and Written Opinion.
PCT/US2017/057402, May 2, 2019, International Preliminary Report on Patentability.
PCT/US2018/045207, Nov. 29, 2018, International Search Report and Written Opinion.
Chinese Office Action for Application No. CN201580069567.7 dated Jun. 17, 2019.
Chinese Office Action for Application No. CN201580069567.7 dated Oct. 9, 2019.
Chinese Office Action for Chinese Application No. 202010397391.0 dated Apr. 1, 2021.
Chinese Office Action for Chinese Application No. 202010397224.6 dated Apr. 28, 2021.
Extended European Search Report for European Application No. EP 11166820.8 dated Jan. 24, 2012.
International Preliminary Report on Patentability for International Application No. PCT/US2014/026381 dated Sep. 24, 2015.
International Preliminary Report on Patentability for International Application No. PCT/US2015/060472 dated May 26, 2017.
International Preliminary Report on Patentability for International Application No. PCT/US2017/033122 dated Nov. 29, 2018.
International Preliminary Report on Patentability for International Application No. PCT/US2017/057402 dated May 2, 2019.
International Search Report and Written Opinion for International Application No. PCT/US2005/034605 dated Jan. 26, 2006.
International Search Report and Written Opinion for International Application No. PCT/US2006/25562 dated Oct. 31, 2007.
International Search Report and Written Opinion for International Application No. PCT/US2010/056482 dated Mar. 14, 2011.
International Search Report and Written Opinion for International Application No. PCT/US2010/056495 dated Jan. 25, 2011.
International Search Report and Written Opinion for International Application No. PCT/US2011/026139 dated Nov. 22, 2011.
International Search Report and Written Opinion for International Application No. PCT/US2011/034747 dated Jul. 28, 2011.

(56) References Cited

OTHER PUBLICATIONS

International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2014/026381 dated Aug. 12, 2014.
International Search Report and Written Opinion for International Application No. PCT/US2015/012463 dated May 13, 2015.
International Search Report and Written Opinion for International Application No. PCT/US2015/012542 dated Apr. 30, 2015.
International Search Report and Written Opinion for International Application No. PCT/US2015/060472 dated Mar. 11, 2016.
International Search Report and Written Opinion for International Application No. PCT/US2016/043358 dated Nov. 3, 2016.
International Search Report and Written Opinion for International Application No. PCT/US2017/033122 dated Aug. 8, 2017.
International Search Report and Written Opinion for International Application No. PCT/US2017/057402 dated Jan. 19, 2018.
International Search Report and Written Opinion for International Application No. PCT/US2018/045207 dated Nov. 29, 2018.
[No Author Listed], Amphenol TCS expands the Xcede Platform with 85 Ohm Connectors and High-Speed Cable Solutions. Press Release. Published Feb. 25, 2009. http://www.amphenol.com/about/news_archive/2009/58 [Retrieved on Mar. 26, 2019 from Wayback Machine]. 4 pages.
[No Author Listed], Agilent. Designing Scalable 10G Backplane Interconnect Systems Utilizing Advanced Verification Methodologies. White Paper, Published May 5, 2012. 24 pages.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013. 2 pages.
[No Author Listed], File:Wrt54gl-layout.jpg Sep. 8, 2006. Retrieved from the Internet: https://xinu.mscs.mu.edU/File:Wrt54gl-layout.jpg [retrieved on Apr. 9, 2019]. 2 pages.
[No Author Listed], Hitachi Cable America Inc. Direct Attach Cables. 8 pages. Retrieved Aug. 10, 2017 from http://www.hca.hitachi-cable.com/products/hca/catalog/pdfs/direct-attach-cable-assemblies.pdf [last accessed Mar. 6, 2019].
[No Author Listed], Size 8 High Speed Quadrax and Differential Twinax Contacts for Use in MIL-DTL-38999 Special Subminiature Cylindrical and ARINC 600 Rectangular Connectors. Published May 2008. 10 pages. Retrieved from https://www.peigenesis.com/images/content/news/amphenol_quadrax.pdf.
Beaman, High Performance Mainframe Computer Cables. 1997 Electronic Components and Technology Conference. 1997;911-7.
Fjelstad, Flexible Circuit Technology. Third Edition. BR Publishing, Inc. Sep. 2006. 226 pages. ISBN 0-9667075-0-8.
Shi et al., Improving Signal Integrity in Circuit Boards by Incorporating Absorbing Materials. 2001 Proceedings. 51st Electronic Components and Technology Conference, Orlando FL. 2001:1451-56.

* cited by examiner 314A
1042A
1552
452
1550
450
410
1912

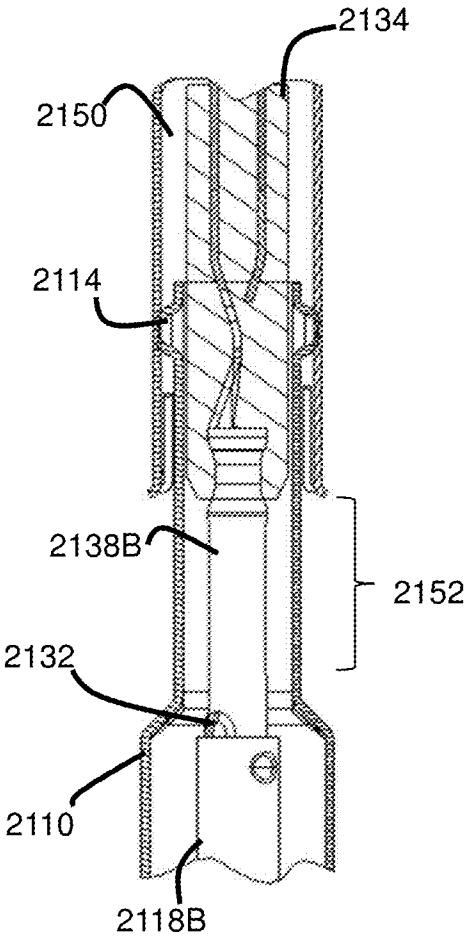
FIG. 21C
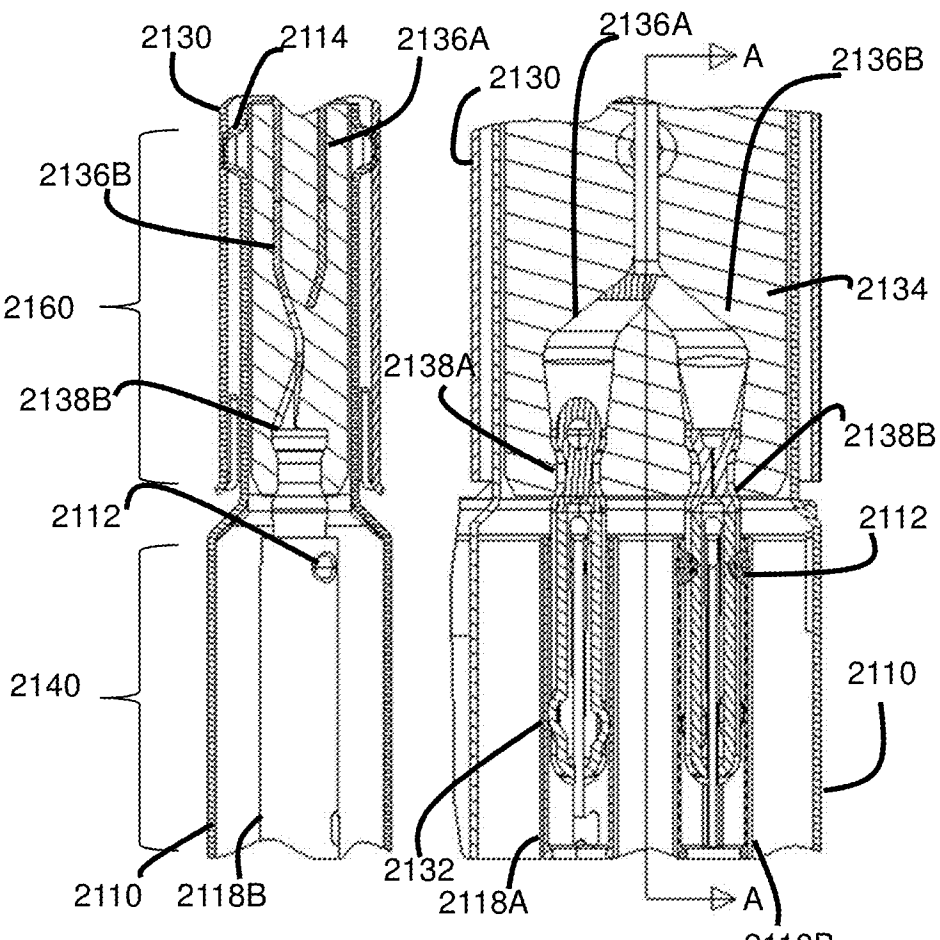
FIG. 21B
FIG. 21A

VERY HIGH SPEED, HIGH DENSITY ELECTRICAL INTERCONNECTION SYSTEM WITH IMPEDANCE CONTROL IN MATING REGION

CROSS REFERENCE TO RELATED APPLICATIONS

This application is a continuation of and claims priority to U.S. patent application Ser. No. 16/235,683, filed Dec. 28, 2018, entitled "VERY HIGH SPEED, HIGH DENSITY ELECTRICAL INTERCONNECTION SYSTEM WITH IMPEDANCE CONTROL IN MATING REGION," which is a continuation of and claims priority to U.S. patent application Ser. No. 15/627,063, filed Jun. 19, 2017, entitled "VERY HIGH SPEED, HIGH DENSITY ELECTRICAL INTERCONNECTION SYSTEM WITH IMPEDANCE CONTROL IN MATING REGION," which is a continuation of and claims priority to U.S. patent application Ser. No. 14/940,049, filed on Nov. 12, 2015, entitled "VERY HIGH SPEED, HIGH DENSITY ELECTRICAL INTERCONNECTION SYSTEM WITH IMPEDANCE CONTROL IN MATING REGION," which claims the benefit under 35 U.S.C. § 119(e) to U.S. Provisional Patent Application Ser. No. 62/078,945, filed on Nov. 12, 2014, entitled "VERY HIGH SPEED, HIGH DENSITY ELECTRICAL INTERCONNECTION SYSTEM WITH IMPEDANCE CONTROL IN MATING REGION," which is incorporated herein by reference in its entirety.

BACKGROUND

This patent application relates generally to interconnection systems, such as those including electrical connectors, used to interconnect electronic assemblies.

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards is to have one printed circuit board serve as a backplane. Other printed circuit boards, called "daughterboards" or "daughtercards," may be connected through the backplane.

A known backplane is a printed circuit board onto which many connectors may be mounted. Conducting traces in the backplane may be electrically connected to signal conductors in the connectors so that signals may be routed between the connectors. Daughtercards may also have connectors mounted thereon. The connectors mounted on a daughtercard may be plugged into the connectors mounted on the backplane. In this way, signals may be routed among the daughtercards through the backplane. The daughtercards may plug into the backplane at a right angle. The connectors used for these applications may therefore include a right angle bend and are often called "right angle connectors."

Connectors may also be used in other configurations for interconnecting printed circuit boards and for interconnecting other types of devices, such as cables, to printed circuit boards. Sometimes, one or more smaller printed circuit boards may be connected to another larger printed circuit board. In such a configuration, the larger printed circuit board may be called a "mother board" and the printed circuit boards connected to it may be called daughterboards. Also, boards of the same size or similar sizes may sometimes be aligned in parallel. Connectors used in these applications are often called "stacking connectors" or "mezzanine connectors."

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Examples of shielding can be found in U.S. Pat. Nos. 4,632,476 and 4,806,107, which show connector designs in which shields are used between columns of signal contacts. These patents describe connectors in which the shields run parallel to the signal contacts through both the daughterboard connector and the backplane connector. Cantilevered beams are used to make electrical contact between the shield and the backplane connectors. U.S. Pat. Nos. 5,433,617, 5,429,521, 5,429,520, and 5,433,618 show a similar arrangement, although the electrical connection between the backplane and shield is made with a spring type contact. Shields with torsional beam contacts are used in the connectors described in U.S. Pat. No. 6,299,438. Further shields are shown in U.S. Pre-grant Publication 2013-0109232.

Other connectors have the shield plate within only the daughterboard connector. Examples of such connector designs can be found in U.S. Pat. Nos. 4,846,727, 4,975,084, 5,496,183, and 5,066,236. Another connector with shields only within the daughterboard connector is shown in U.S. Pat. No. 5,484,310. U.S. Pat. No. 7,985,097 is a further example of a shielded connector.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals. Examples of differential electrical connectors are shown in U.S. Pat. Nos. 6,293,827, 6,503,103, 6,776,659, 7,163,421, and 7,794,278.

Another modification made to connectors to accommodate changing requirements is that connectors have become much larger in some applications. Increasing the size of a connector may lead to manufacturing tolerances that are much tighter. For instance, the permissible mismatch between the conductors in one half of a connector and the receptacles in the other half may be constant, regardless of the size of the connector. However, this constant mismatch, or tolerance, may become a decreasing percentage of the connector's overall length as the connector gets longer. Therefore, manufacturing tolerances may be tighter for larger connectors, which may increase manufacturing costs. One way to avoid this problem is to use connectors that are constructed from modules to extend the length of the connector. Teradyne Connection Systems of Nashua, N.H., USA pioneered a modular connector system called HD-F®. This system has multiple modules, each having multiple columns of signal contacts, such as 15 or 20 columns. The modules are held together on a metal stiffener to enable construction of a connector of any desired length.

Another modular connector system is shown in U.S. Pat. Nos. 5,066,236 and 5,496,183. Those patents describe "module terminals" each having a single column of signal contacts. The module terminals are held in place in a plastic housing module. The plastic housing modules are held together with a one-piece metal shield member. Shields may be placed between the module terminals as well.

SUMMARY

Embodiments of a high speed, high density interconnection system are described. Very high speed performance may be achieved by the shape and/or position of conductive and/or dielectric portions of one connector which are positioned in an impedance affecting relationship with respect to signal conductors of a mating connector over some or all of the functional mating range of the interconnection system.

In some embodiments, an interconnection system is provided, comprising: a plurality of signal conductors, each signal conductor of the plurality of signal conductors comprising a contact tail adapted to be attached to a printed circuit board, a mating contact portion, and an intermediate portion electrically coupling the contact tail and the mating contact portion; and a housing portion holding at least one signal conductor of the plurality of signal conductors, the housing portion comprising a mating region, wherein: a first mating contact portion of the at least one signal conductor is disposed in the mating region of the housing portion; the housing portion comprises a mating interface surface having an opening therein, wherein the opening is sized and positioned to receive a second mating contact portion from a mating component for mating with the first mating contact portion; and the mating region of the housing portion comprises at least one projecting member, the at least one projecting member extending along a mating direction beyond the mating interface surface and beyond a distal end of the first mating contact portion of the at least one signal conductor.

In some embodiments, an interconnection system is provided, comprising: a plurality of signal conductors, each signal conductor of the plurality of signal conductors comprising a contact tail adapted to be attached to a printed circuit board, a mating contact portion, and an intermediate portion electrically coupling the contact tail and the mating contact portion; and at least one reference conductor surrounding, on at least two sides, the mating contact portion of at least one signal conductor of the plurality of signal conductors, wherein; the at least one reference conductor extends along a mating direction beyond a distal end of the mating contact portion of the at least one signal conductor such that the at least one reference conductor has a first region adjacent the mating contact portion and a second region extending beyond the distal end of the mating contact portion; and the at least one reference conductor has a first separation from the mating contact portion in the first region and a second separation from the mating contact portion in the second region.

In some embodiments, an interconnection system is provided, comprising a first component comprising a first plurality of conductive elements held by a first dielectric housing and a second component comprising a second plurality of conductive elements held by a second dielectric housing, the interconnection system comprising a separable interface between the first plurality of conductive elements and the second plurality of conductive elements, wherein: the first plurality of conductive elements are configured to provide first signal paths within the first component, the first signal paths having a first impedance; the second plurality of conductive elements are configured to provide second signal paths within the second component, the second signal paths having the first impedance; and the first plurality of conductive elements, the second plurality of conductive elements, the first dielectric housing, and the second dielectric housing are configured to provide a mating region having a length that varies in relation to separation between the first component and the second component, and when the first plurality of conductive elements are mated with the second plurality of conductive elements, the impedance varies across the mating region to an inflection point with a second characteristic impedance such that a change in impedance from the first impedance at the first signal paths within the first component to the second impedance at the inflection point and from the second impedance at the inflection point to the first impedance at the second signal paths within the second component is distributed across the mating region.

In some embodiments, an interconnection system is provided, comprising a first component comprising a first plurality of conductive elements held by a first housing and a second component comprising a second plurality of conductive elements held by a second housing, the interconnection system comprising a separable interface between the first plurality of conductive elements and the second plurality of conductive elements, wherein: the first plurality of conductive elements, the second plurality of conductive elements, the first housing and the second housing are configured to provide a mating region having a length that varies in relation to separation between the first component and the second component; the first plurality of conductive elements comprises signal conductors, each signal conductor comprising: an intermediate portion disposed within the first housing; a mating portion extending from the first housing; and a transition portion between the intermediate portion and the mating portion, wherein: the intermediate portion has a first width, and the mating portion has a second width, the second width being greater than the first width; and the second plurality of conductive elements comprises signal conductors and reference conductors, each reference conductor comprising: an intermediate portion disposed within the second housing; a mating portion extending from the second housing; and a transition portion between the intermediate portion and the mating portion, wherein: the intermediate portion has a first separation from an adjacent signal conductor of the signal conductors of the second plurality of conductive elements; and the mating portion has a second separation from an adjacent signal conductor of the signal conductors of the first plurality of conductive elements.

In some embodiments, an interconnection system is provided, comprising a first component comprising a first plurality of conductive elements held by a first housing and a second component comprising a second plurality of conductive elements held by a second housing, the interconnection system comprising a separable interface between the first plurality of conductive elements and the second plurality of conductive elements, wherein: the first plurality of conductive elements comprises signal conductors and reference conductors and the second plurality of conductive elements comprises signal conductors and reference conductors; the first plurality of conductive elements, the second plurality of conductive elements, the first housing, and the second housing are configured to provide a mating region having a length that varies in relation to separation between the first component and the second component; and the interconnection system comprises a plurality of dielectric members in the mating region positioned to separate reference conductors and adjacent signal conductors for at least a portion of the signal conductors, each dielectric member being shaped to provide a volume of dielectric material between a reference conductor and an adjacent signal conductor, the volume of dielectric material varying along the length of the mating region when the first component and the second component are separated.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 21B illustrates an alternative embodiment of a portion of a module of a two-piece, high speed, high density connector, with the components fully mated;

FIG. 21A is a side, cross sectional view of the connector of FIG. 21B; and FIG. 21C illustrates the connector of FIGS. 21A and 21B with the connector components separated.

DESCRIPTION OF PREFERRED EMBODIMENTS

Figure 1:
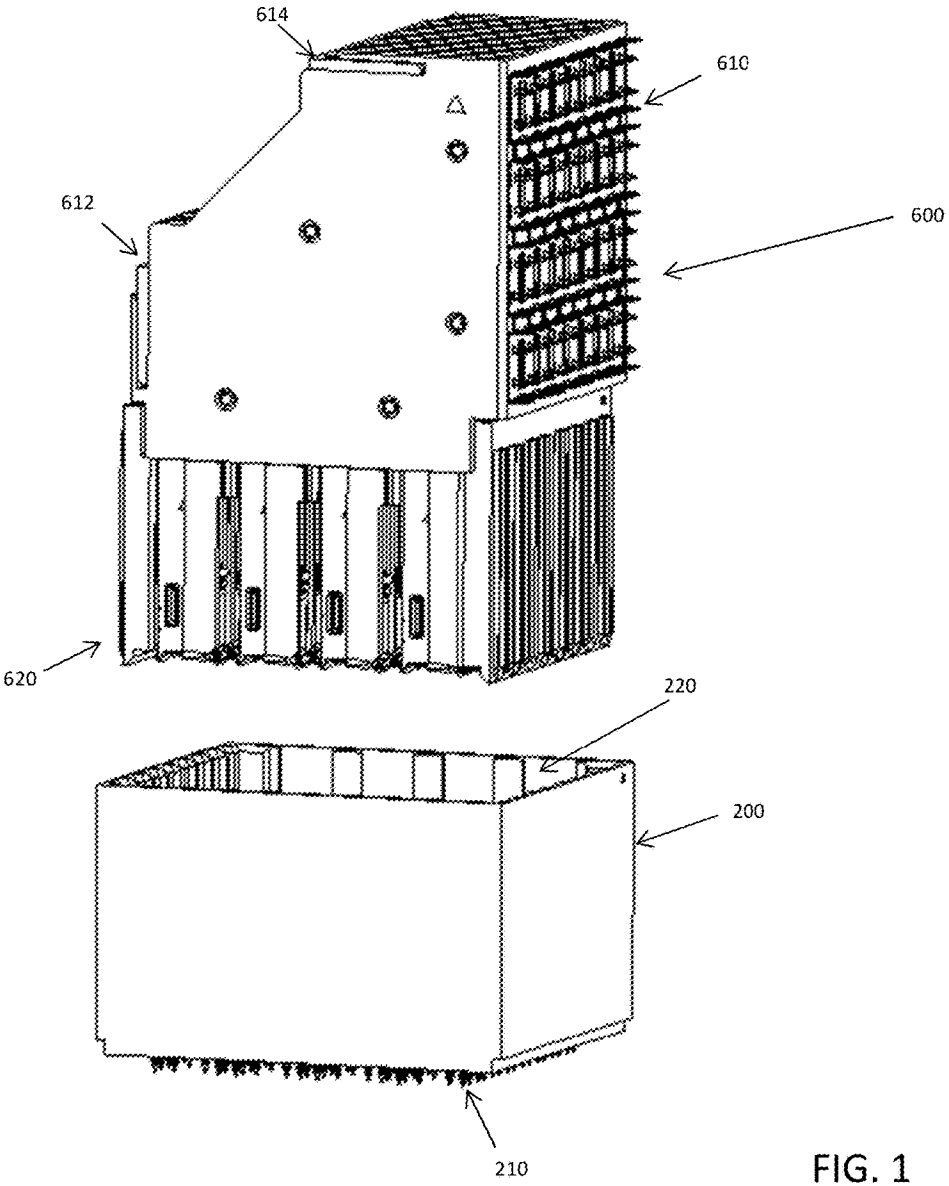
FIG. 1 is an isometric view of an illustrative electrical interconnection system, in accordance with some embodiments.

The inventors have recognized and appreciated that performance of a high density interconnection system may be increased, particularly those that carry very high frequency signals that are necessary to support high data rates, with designs that reduce effects of impedance discontinuities associated with variable separation of separable components that form a mating interface. Such impedance discontinuities may create signal reflections that increase near end cross talk, attenuate signals passing through the interconnect, cause electromagnetic radiation that gives rise to far end cross talk or otherwise degrades signal integrity. Separable electrical connectors are used herein as an example of an interconnection system. The mating interfaces of some electrical connectors have been designed such that the impedance of signal conductors thorough a mating region, when the connectors are in a designed mating position, matches the impedance of intermediate portions of those signal conductors within the connectors. For low density interconnects, such as coaxial connectors that have a single signal conductor, it may be possible to construct and operate the mating connectors such that the designed mating position is reliably achieved. Greater design flexibility in choice of material or shaping and positioning of components to avoid impedance discontinuities is possible with such low density connectors.

However, for high density interconnects having multiple signal conductors, it is difficult to achieve a designed mating position for all of the signal conductors simultaneously. Additionally, the constraints imposed by meeting mechanical requirements to accurately position numerous signal conductors, with appropriate grounding and shielding in a small volume, forecloses many design techniques that might be used in cables or in connectors that connect one or a small number of signal conductors. For example, a high density connector may have an array of signal conductors spread out over a connector length of 6 inches or more. Such connectors may have a width on the order of an inch or more, providing literally hundreds of signal conductors to be mated at a separable interface. Normal manufacturing tolerances of the connectors may preclude all the signal conductors mating in the designed mating position over such a wide area, because, when some portions of one connector press against a mating connector, other portions of those connectors may be separated.

The force required to press the connectors together may also lead to variability in the separation between connectors, such that all portions of the connector are not in the designed mating position. The force required to push the connectors together increases in proportion to the number of signal conductors that mate. For a high density connector with numerous signal conductors, the force may be on the order of tens of pounds or more. An interconnection system may be designed to rely on human action to press components together in a way that generates the required mating force. However, because of variability in the way an operator assembles the system or many other possible factors, the required force may not always be generated when connectors are mated, such that the connectors are not fully pressed together in practice.

Further contributing to variability in separation of connectors, the level of force needed to force the connectors fully together may also create flex in the substrates, such as printed circuit boards, to which the connectors are attached. A printed circuit board, for example, may flex more at the center than the ends, and portions of the connectors mounted near the middle of a printed circuit board may be separated more than portions of the connectors near the sides of the printed circuit board.

To accommodate for the components mating in other than the designed mating position, many high density connectors are designed to have a "functional mating range" of approximately 2-5 mm. "Functional mating range" means the amount that one conductive element is designed to slide over a mating conductive element to reach a designed mating position from a point where the conductive elements engage with sufficient normal force to provide a reliable connection. In many embodiments, the connectors are fully pressed-together in the designed mating position, and a fully pressed together position is used as an example of a designed mating position herein.

Because sliding the contacts relative to one another can remove oxide or contamination on the mating contacts, some portion of the functional mating range provides "wipe," which is desirable because sliding conductive elements in contact can remove contaminants from the mating contact portions and make a more reliable connection. However, the functional mating range in a high density connector is typically larger than needed for "wipe". In high density connectors, the functional mating range provides the additional benefit of enabling the mating signal conductors to be in electrical contact, even when the connector components are separated by a distance up to the amount of the "functional mating range."

The inventors have recognized and appreciated a problem with designing connectors, particularly very high speed, high density connectors, with a large functional mating range. Conventionally, connectors designed to accommodate mating at any point over a range of positions, particularly when operated at high frequencies, provide signal paths with variations in impedance, whether those variations are relative to a nominal designed value or are variations along the length of the signal conductors, or both.

If the mating connectors are separated by less than the amount of "functional mating range" supported by the connector, the conductive elements of the mating connectors should make electrical contact at some point in the mating region, which is desired. However, when mated at that point, the signal conductors may not have the same relative position to other portions of the connector that they would in a fully mated position, which may impact impedance.

For example, spacing between signal conductors in one connector and certain reference conductors or dielectric material in a mating electrical connector can affect impedance of the signal conductors. When there is variation in spacing between the connectors, there may also be variation in spacing between the signal conductors in one connector and these other structures that are in an impedance affecting position. Thus, the impedance may vary depending on the separation between the mating connectors.

When the connectors are separated, portions of the signal conductors may not be surrounded by material with the same effective dielectric constant as when the connectors are pressed fully together. Likewise, the separation between signal conductors and adjacent ground conductors may be different than when the connectors are pressed fully together. As a result, when the connectors are separated, though still close enough together to be within the functional mating range, the impedance of the signal conductors within the mating region may be different than the designed impedance, and the resulting impedance may depend on the separation between the components.

The impedance in the mating region may result from a signal path geometry in which portions of the interconnection system are positioned as designed, while other portions are displaced from their designed positions. One such difference results from a different effective dielectric constant of material surrounding signal conductors when two components are fully pressed together relative to when there is separation between the components.

For example, portions of signal conductors may pass through regions in which the signal conductors are surrounded by dielectric structures that are part of the same connector such that, regardless of the relative separation between two connectors, the relative position of the signal conductors and these structures is preserved. When dielectric material is between the signal conductors and adjacent reference conductors, the dielectric may affect impedance. A fixed relationship of signal conductor, reference conductor and dielectric, for example, may occur for the intermediate portions of signal conductors in a connector module in which the signal conductor is embedded in a dielectric portion to which reference conductors are attached.

In the mating region, however, at least portions of the conductive elements must be exposed to make electrical connection to mating contact portions in a mating module. These structures might not be surrounded by dielectric members that form a portion of the same module as the signal conductor. When two mating connectors are fully pressed together, the extending mating contact portions of one connector may be inserted into the mating contact portions of another connector. In this configuration, the impedance of the signal path through the mating contact portion may be impacted by the relative positioning of a signal conductor in one connector and an adjacent reference conductor or dielectric material from the mating connector.

In the nominal mating position, the extending portion may be inserted into a mating contact portion of a mating connector. In some embodiments, the mating connector may have mating contact portions serving as receptacles. For any portions of the extending contact within the receptacle, the impedance of the signal path may be defined by the positioning of the receptacle relative to impedance affecting structures, such as dielectric material and reference conductors, in the mating connector. These relationships may be designed to provide a desired impedance, which, because it is determined by relative position of components within one connector, may be independent of separation between the mating connectors.

In some embodiments, the receptacle may be held within a dielectric housing. Thus, extending portions of the mating contact portions from a first connector may pass through the dielectric housing of a second connector before reaching the receptacles. In this region, the dielectric constant, as well as position of reference conductors, of the mating connector may be set such that the impedance has a desired value when the connectors are in a fully mated position.

In a conventional connector design, when there is separation between the mating connectors, the portion of the mating contact portion of one connector that relies on structures in the mating connector to achieve a desired impedance will not be in the designed position with respect to these impedance affecting structures in the mating connector. As a result, separation between the connectors will lead to an impedance in that region different than the designed impedance. This impedance may vary based on the amount of separation, introducing greater variability.

For example, two connectors may have mating interface surfaces that butt together when the connectors are fully mated. A mating contact portion extending from one connector may have an impedance that varies along its length, with different impedance in different regions in relation to those mating interface surfaces. The impedance of that signal path within the connector, up to the mating interface surface of that connector, may be controlled to have a nominal value based on values of design parameters within that connector. The mating interface of the connector may be designed such that, when the dielectric portions butt against one another, the impedance has a value such as 50, 85 or 100 Ohms or other suitable value, in order to match the impedance in other portions of the interconnection system. Likewise, the impedance of the signal path for the portion of the extending contact that extends through the mating interface surface of the mating connector may be controlled to have the nominal value based on values of design parameters within the mating connector.

However, any portion of the signal path between the two mating interface surfaces may have an impedance that differs from the nominal value. Such a portion of the signal path may exist as a result of separation between the connectors, which deviates from a designed separation for the fully mated connectors. In this region, there may be no dielectric members or reference conductors placed in an impedance affecting position with respect to the signal conductor. Frequently, the material surrounding the mating contact portions is air. In contrast to the insulator used in forming the connector housing that may have a relative dielectric constant in the range of 2-4, for example, air has a dielectric constant that is close to 1. As a result, a signal conductor designed to have a nominal impedance when passing through a dielectric housing, may have a different impedance when passing through air, meaning that a signal conductor may have a different impedance between the mating interface surfaces than within the housing of either connector.

Other design parameters may lead to a different impedance along a signal path in the region between mating interface surfaces than within the connectors. For example, reference conductors positioned to provide a nominal impedance within the connector housings may have a different spacing relative to the signal conductor in the region between the mating interface surfaces than within the connector housing. Because the impedance of a signal conductor may depend on the separation between the signal conductor and an adjacent reference conductor, different spacing in one region than another may result in a change in impedance along the signal path from one region to another. For a conventional high speed, high density connector, in which the reference conductors are fixed to the connectors, this spacing between signal and reference conductors, and therefore impedance, in the region between the mating interface surfaces, will be different when the connectors are fully mated than when separated.

The fact that impedance in the mating region is impacted by separation between components means that, particularly for high speed connectors that have been designed to have a uniform impedance in the intermediate portions and through the mating region, when the components of the interconnection system are not in their designed mating positions, there will be a change in impedance along the length of each signal conductor. The impedance in at least a portion of the mating region will be different than in the intermediate portion, where impedance is dictated by structures within each connector, and is unaffected by the amount of separation between components.

The impact of a change in impedance may depend on the amount of separation between the components or the operating frequency range of the connector. For a small separation, or for a low frequency signal, such a change in impedance may have no discernable performance impact. At low frequencies, a separation, even if equal to the full functional mating range of the connector, may give rise to a very small difference in impedance relative to the intermediate portions of the signal conductors that are within the connector housings. Moreover, at lower frequencies, such a change in impedance may be effectively averaged along the length of the signal paths through the interconnection system such that the change in impedance has little impact.

At higher frequencies, however, the change in impedance associated with separation of the connectors may be more significant, to the point of limiting performance of the connector. Such an impact may result because the difference in impedance, caused by the separation, between a mating region and the intermediate portions of the signal conductors is greater at higher frequencies. Moreover, at higher frequencies, a change in impedance attributable to separation of the components presents a localized impedance discontinuity rather than a change that is averaged over the length of the entire signal conductor. For example, in a high-speed interconnection system, a connector may be designed such that a fully mated connector may provide an impedance in the mating region that differs from the impedance in the intermediate portion by 3 ohms or less at the higher range of operating frequencies of the connector. However, when the mating connectors are separated by up to the functional mating range distance, the impedance difference between portions of the signal conductors in the mating region and the intermediate portions of the signal conductors may differ by two, three or more times the intended difference. This difference between the actual impedance of signal conductors and designed impedance may give rise to signal integrity problems, depending on the frequency range of interest.

The frequency range of interest may depend on the operating parameters of the system in which such a connector is used, but may generally have an upper limit between about 15 GHz and 50 GHz, such as 25 GHz, 30 or 40 GHz, although higher frequencies or lower frequencies may be of interest in some applications. Some connector designs may have frequency ranges of interest that span only a portion of this range, such as 1 to 10 GHz or 3 to 15 GHz or 5 to 35 GHz. The impact of variations in impedance may be more significant at these higher frequencies.

The operating frequency range for an interconnection system may be determined based on the range of frequencies that can pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. Two examples of such criteria are the attenuation of a signal along a signal path or the reflection of a signal from a signal path.

Other criteria may relate to interaction of multiple distinct signal paths. Such criteria may include, for example, near end cross talk, defined as the portion of a signal injected on one signal path at one end of the interconnection system that is measurable at any other signal path on the same end of the interconnection system. Another such criterion may be far end cross talk, defined as the portion of a signal injected on one signal path at one end of the interconnection system that is measurable at any other signal path on the other end of the interconnection system.

As specific examples, it could be required that signal path attenuation be no more than 3 dB power loss, reflected power ratio be no greater than −20 dB, and individual signal path to signal path crosstalk contributions be no greater than −50 dB. Because these characteristics are frequency dependent, the operating range of an interconnection system is defined as the range of frequencies over which the specified criteria are met.

Accordingly, the inventors have recognized and appreciated the desirability of using techniques in separable interfaces of high speed, high density interconnection systems to reduce the impact of changes in impedance attributable to variable separation of components that form the interface. Such techniques may provide an impedance in the mating region that is independent of separation between the separable components. Alternatively or additionally, such techniques may provide an impedance that varies smoothly over the mating region, regardless of separation between the separable components, to avoid discontinuities of a magnitude that impact performance.

Designs that reduce or eliminate impedance discontinuities or the effects of such discontinuities in the mating region, regardless of separation between components, may be achieved by selection of the shape and/or position of one or more conductive elements and/or dielectric elements. In accordance with some techniques, impedance control may be provided by members, projecting from one connector, partially or fully through the space separating the mating connectors. Accordingly, these members may have dimensions that are on the order of the functional mating range of the connector, such as 1-3 mm or, in some embodiments, at least 2 mm. These projecting members may be dielectric and/or conductive. Accordingly, these members will be positioned within the space between connectors when the connectors are de-mated by a distance up to the functional mating range. When the connectors are separated by less than the functional mating range, the projecting members of one connector may project into the mating connector. Though, it should be appreciated that the projecting members may extend by more than the functional mating range, such that they will project into the mating connector even if the connectors are separated by the functional mating range.

The projecting members may be positioned to reduce or substantially eliminate changes in impedance associated with variable separation of connectors. Such a result may be achieved by having the projecting members in an impedance affecting relationship with the signal conductors in the mating region between the connectors, when the connectors are separated. The shape and position of the projecting members may be such that the impedance of the signal conductors in this mating region provides a desired impedance, regardless of separation between the connectors. The connector may be designed such that the projecting member does not impact the impedance in either connector, regardless of separation between the connectors.

For example, the projecting members may be conductive and may be configured as reference conductors. In some embodiments, the conductive members may be configured to provide a nominal impedance within the connector to which they are attached, but to have little or no impact on the impedance in the other connector, regardless of the separation between connectors. Such a result may be achieved by having the projecting member adjacent to a reference conductor in that connector such that, regardless of the amount of separation between connectors, there is no significant difference in the distance between the signal conductors in that connector and the nearest reference conductor.

In contrast, the projecting member may be shaped and positioned to impact impedance along the signal path between connectors. For example, in the region between the mating connectors when separated, the projecting members may be shaped and positioned to provide a spacing between signal conductors and reference conductors that, in combination with other parameters, provides the nominal impedance in that region. Such other parameters may include thickness or shape of the signal conductor and/or dielectric constant of material in that region.

The projecting members may alternatively or additionally be dielectric, and may be formed, for example, from dielectric material of the type forming a connector housing. The dielectric projecting member may be shaped and positioned to lessen the impact of changes in impedance that might arise from separation of the connectors by distributing those changes across the mating interface region of the connector. For example, the dielectric projecting member from one connector may extend into an impedance affecting position with respect to a signal conductor in a mating connector when the connectors are fully mated. When partially demated, that dielectric projecting member will not extend all the way into the mating connector, occupying less of the impedance affecting position, and leaving a region with a void. Because the void may fill with air, separation means that more air is in an impedance affecting position with respect to the signal conductor within that connector, lowering the effective dielectric constant and impacting impedance in that region.

That dielectric projecting member, if it does not extend fully into the connector as a result of separation between the connectors, instead fills at least a portion of the space between the two connectors, thereby replacing air that might otherwise exist in that separation with a dielectric member. As a result, the projecting member raises the effective dielectric constant in the space between connectors, relative to what it would have been had the space been entirely filled with air. Because this dielectric constant is closer to what would be experienced had the entire signal conductor been within a connector housing, such as occurs when there is no separation between the connectors, the magnitude of any change in impedance as a result of separation is less than had the entire space been filled with air.

Moreover, the impact of the separation between the connectors is spread over a longer distance. Changes in the amount of dielectric material in impedance affecting positions impact both the impedance along a signal path in the space between the connectors as well as within one of the connectors. By distributing changes in impedance over a greater distance along the signal path, the abruptness of the change in impedance at any given location may be less, and the impact of that change may likewise be less.

These techniques may be used alone or in any suitable combination. Accordingly, in some embodiments, signal conductor pairs may be enclosed by or adjacent to, on one or more sides, reference conductors. The shape of some or all of the reference conductors, including their separation from the axis of the signal conductors, may vary over the signal path through the mated connectors. The shape of the signal conductors, including their width, may also vary. Likewise, the amount of insulating material relative to the amount of air adjacent a signal conductor may also vary over the mating region. Values of these design parameters at different locations along the length of the mating region may be selected, alone or in combination, to provide an impedance along the signal conductors within the mating region that either does not vary as a function of separation of the mating components or in which such a variation is distributed to reduce impedance discontinuities.

In some embodiments, some or all of the reference conductors, signal conductors and insulative portions may vary in shape over the mating region so as to define sub-regions. The length of at least some of the sub-regions may depend on the separation between components, and the components may be shaped to provide smooth transitions between the sub-regions. A first such sub-region may exist within the first component. A second sub-region may exist within the second component. The second sub-region may include a portion of the mating interface in which a signal conductor with flex is surrounded by adequate space for flexing as required to generate contract force. The third sub-region may be between the first and second sub-regions. The length of the third sub-region may depend on the separation between the components.

In the first sub-region, the reference conductors may be separated from the axis of the signal conductors (referred to herein as the "signal conductor axis") by a first distance. This distance may be appropriate to provide a desired impedance given the average dielectric constant of the material and the shape of the signal conductor in the first sub-region. In the second sub-region, which in the example above has air surrounding the signal conductors, the reference conductors may be separated from the signal conductor axis by a second distance. This second distance may be appropriate to provide the desired impedance given the average dielectric constant of the material and the shape of the signal conductor in the second sub-region.

In the third sub-region, the separation between the reference conductors and the signal conductor axis may transition from the first distance, adjacent the first sub-region, to the second distance, adjacent the second sub-region. The width of the signal conductor extending from the first component may also transition from a first width, in the first sub-region, to a second width in the second sub-region. This transition in signal conductor width may be coordinated with changes in separation between the reference conductors and the signal conductor axis and/or changes in the effective dielectric constant of material adjacent the signal conductors so as to reduce or eliminate changes in impedance.

Moreover, the dielectric members within the mating region may be designed to provide a smooth transition of impedance. For example, in some embodiments, the dielectric members may be designed such that, when the connectors are in a nominal mating position, the effective dielectric constant of material surrounding signal conductors in the mating region provides the same impedance as in the intermediate portions. This effective dielectric constant may be provided by overlap of dielectric members from the two mating connectors. These members may be shaped so that the amount of overlap decreases smoothly as the separation between the connectors increases. In this way, any impedance discontinuity that might otherwise arise from the connectors being mated while in a position other than the nominal mating positioned may be lessened.

Designs of an electrical connector are described herein that improve signal integrity for high frequency signals, such as at frequencies in the GHz range, including up to about 25 GHz or up to about 40 GHz or higher, while maintaining high density, such as with a spacing between adjacent mating contacts on the order of 2 mm or less, including center-to-center spacing between adjacent contacts in a column of between 0.75 mm and 1.85 mm or between 1 mm and 1.75 mm, for example. Spacing between columns of mating contact portions may be similar, although there is no requirement that the spacing between all mating contacts in a connector be the same.

FIG. 1 illustrates an electrical interconnection system of the form that may be used in an electronic system. In this example, the electrical interconnection system includes a right angle connector and may be used, for example, in electrically connecting a daughtercard to a backplane. These figures illustrate two mating connectors. In this example, connector 200 is designed to be attached to a backplane and connector 600 is designed to attach to a daughtercard. As can be seen in FIG. 1, daughtercard connector 600 includes contact tails 610 designed to attach to a daughtercard (not shown). Backplane connector 200 includes contact tails 210, designed to attach to a backplane (not shown). These contact tails form one end of conductive elements that pass through the interconnection system. When the connectors are mounted to printed circuit boards, these contact tails will make electrical connection to conductive structures within the printed circuit board that carry signals or are connected to a reference potential.

Each of the connectors also has a mating interface where that connector can mate—or be separated from—the other connector. Daughtercard connector 600 includes a mating interface 620. Backplane connector 200 includes a mating interface 220. Though not fully visible in the view shown in FIG. 1, mating contact portions of the conductive elements are exposed at the mating interface, which as will be appreciated from the description below and accompanying, may include a mating interface surface on daughtercard connector 600 with openings sized and positioned to receive mating contact portions from backplane connector 200.

Each of these conductive elements includes an intermediate portion that connects a contact tail to a mating contact portion. The intermediate portions may be held within a connector housing, at least a portion of which may be dielectric so as to provide electrical isolation between conductive elements. Additionally, the connector housings may include conductive or lossy portions, which in some embodiments may provide conductive or partially conductive paths between some of the conductive elements. In some embodiments, the conductive portions may provide shielding. The lossy portions may also provide shielding in some instances and/or may provide desirable electrical properties within the connectors.

In various embodiments, dielectric members may be molded or over-molded from a dielectric material such as plastic or nylon. Examples of suitable materials include, but are not limited to, liquid crystal polymer (LCP), polyphenyline sulfide (PPS), high temperature nylon or polypropylene (PPO). Other suitable materials may be employed, as aspects of the present disclosure are not limited in this regard.

All of the above-described materials are suitable for use as binder material in manufacturing connectors. In accordance some embodiments, one or more fillers may be included in some or all of the binder material. As a non-limiting example, thermoplastic PPS filled to 30% by volume with glass fiber may be used to form the entire connector housing or dielectric portions of the housings.

Alternatively or additionally, portions of the housings may be formed of conductive materials, such as machined metal or pressed metal powder. In some embodiments, portions of the housing may be formed of metal or other conductive material with dielectric members spacing signal conductors from the conductive portions. In the embodiment illustrated, for example, a housing of backplane connector 200 may have regions formed of a conductive material with insulative members separating the intermediate portions of signal conductors from the conductive portions of the housing.

The housing of daughtercard connector 600 may also be formed in any suitable way. In the embodiment illustrated, daughtercard connector 600 may be formed from multiple subassemblies, referred to herein as "wafers." Each of the wafers (700, FIG. 7) may include a housing portion, which may similarly include dielectric, lossy and/or conductive portions. One or more members may hold the wafers in a desired position. For example, support members 612 and 614 may hold top and rear portions, respectively, of multiple wafers in a side-by-side configuration. Support members 612 and 614 may be formed of any suitable material, such as a sheet of metal stamped with tabs, openings or other features that engage corresponding features on the individual wafers.

Other members that may form a portion of the connector housing may provide mechanical integrity for daughtercard connector 600 and/or hold the wafers in a desired position. For example, a front housing portion 640 (FIG. 6) may receive portions of the wafers forming the mating interface. Any or all of these portions of the connector housing may be dielectric, lossy and/or conductive, to achieve desired electrical properties for the interconnection system.

In some embodiments, each wafer may hold a column of conductive elements forming signal conductors. These signal conductors may be shaped and spaced to form single ended signal conductors. However, in the embodiment illustrated in FIG. 1, the signal conductors are shaped and spaced in pairs to provide differential signal conductors. Each of the columns may include or be bounded by conductive elements serving as ground conductors. It should be appreciated that ground conductors need not be connected to earth ground, but are shaped to carry reference potentials, which may include earth ground, DC voltages or other suitable reference potentials. The "ground" or "reference" conductors may have a shape different than the signal conductors, which are configured to provide suitable signal transmission properties for high frequency signals.

Conductive elements may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

The spacing between adjacent columns of conductors is not critical. However, a higher density may be achieved by placing the conductors closer together. As a non-limiting example, the conductors may be stamped from 0.4 mm thick copper alloy, and the conductors within each column may be spaced apart by 2.25 mm and the columns of conductors may be spaced apart by 2 mm. However, in other embodiments, smaller dimensions may be used to provide higher density, such as a thickness between 0.2 and 0.4 mm or spacing of 0.7 to 1.85 mm between columns or between conductors within a column. Moreover, each column may include four pairs of signal conductors, such that it density of 60 or more pairs per linear inch is achieved for the interconnection system illustrated in FIG. 1. However, it should be appreciated that more pairs per column, tighter spacing between pairs within the column and/or smaller distances between columns may be used to achieve a higher density connector.

The wafers may be formed any suitable way. In some embodiments, the wafers may be formed by stamping columns of conductive elements from a sheet of metal and over molding dielectric portions on the intermediate portions of the conductive elements. In other embodiments, wafers may be assembled from modules each of which including a single, single-ended signal conductor, a single pair of differential signal conductors or any suitable number of single ended or differential pairs.

The inventors have recognized and appreciated that assembling wafers from modules may aid in reducing "skew" in signal pairs at higher frequencies, such as between about 25 GHz and 40 GHz, or higher. Skew, in this context, refers to the difference in electrical propagation time between signals of a pair that operates as a differential signal. Modular construction that reduces skew is designed described, for example in co-pending US application, Publication Number 2015/0236452, which is incorporated herein by reference.

In accordance with techniques described in that co-pending application, in some embodiments, connectors may be formed of modules, each carrying a signal pair. The modules may be individually shielded, such as by attaching shield members to the modules and/or inserting the modules into an organizer or other structure that may provide electrical shielding between pairs and/or ground structures around the conductive elements carrying signals.

In some embodiments, signal conductor pairs within each module may be broadside coupled over substantial portions of their lengths. Broadside coupling enables the signal conductors in a pair to have the same physical length. To facilitate routing of signal traces within the connector footprint of a printed circuit board to which a connector is attached and/or constructing of mating interfaces of the connectors, the signal conductors may be aligned with edge to edge coupling in one or both of these regions. As a result, the signal conductors may include transition regions in which coupling changes from edge-to-edge to broadside or vice versa. As described below, these transition regions may be designed to prevent mode conversion or suppress undesired propagation modes that can interfere with signal integrity of the interconnection system.

The modules may be assembled into wafers or other connector structures. In some embodiments, a different module may be formed for each row position at which a pair is to be assembled into a right angle connector. These modules may be made to be used together to build up a connector with as many rows as desired. For example, a module of one shape may be formed for a pair to be positioned at the shortest rows of the connector, sometimes called the a-b rows. A separate module may be formed for conductive elements in the next longest rows, sometimes called the c-d rows. The inner portion of the module with the c-d rows may be designed to conform to the outer portion of the module with the a-b rows.

Figure 8:
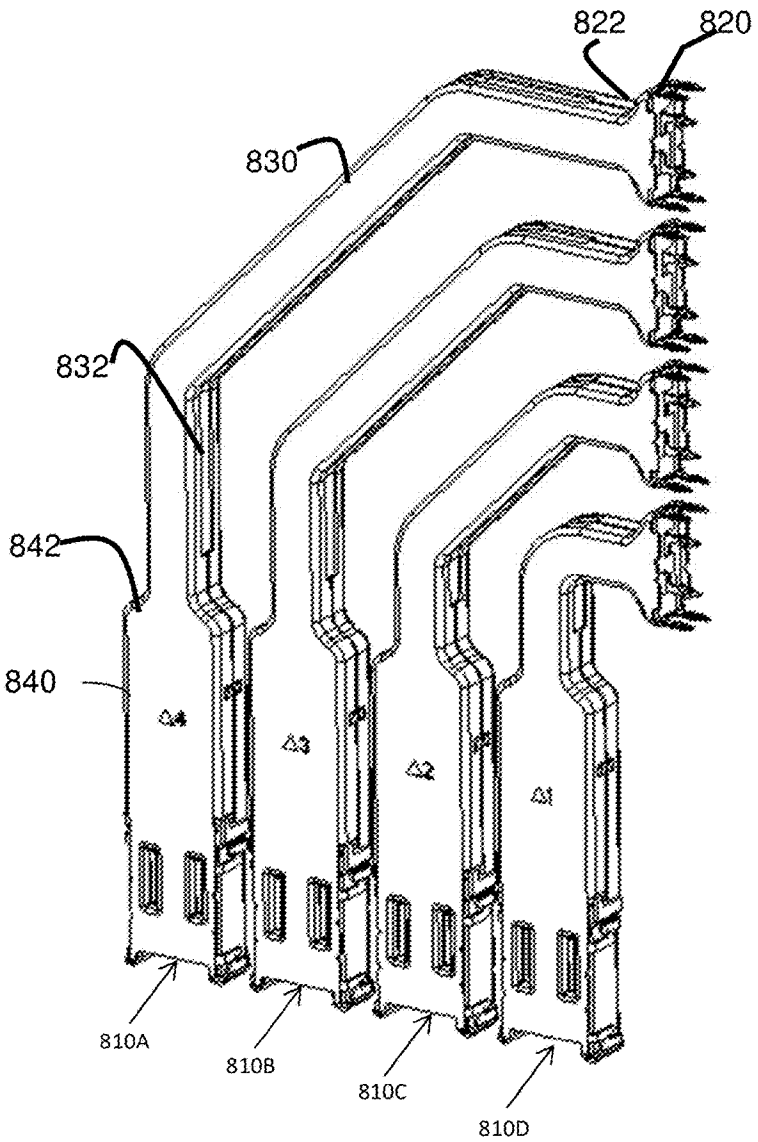
FIG. 8 is an isometric view of wafer modules of the wafer assembly of FIG. 7.

This pattern may be repeated for any number of pairs. Each module may be shaped to be used with modules that carry pairs for shorter and/or longer rows. To make a connector of any suitable size, a connector manufacturer may assemble into a wafer a number of modules to provide a desired number of pairs in the wafer. In this way, a connector manufacturer may introduce a connector family for a widely used connector size—such as 2 pairs. As customer requirements change, the connector manufacturer may procure tools for each additional pair, or, for modules that contain multiple pairs, group of pairs to produce connectors of larger sizes. The tooling used to produce modules for smaller connectors can be used to produce modules for the shorter rows even of the larger connectors. Such a modular connector is illustrated in FIG. 8.

Figure 2:
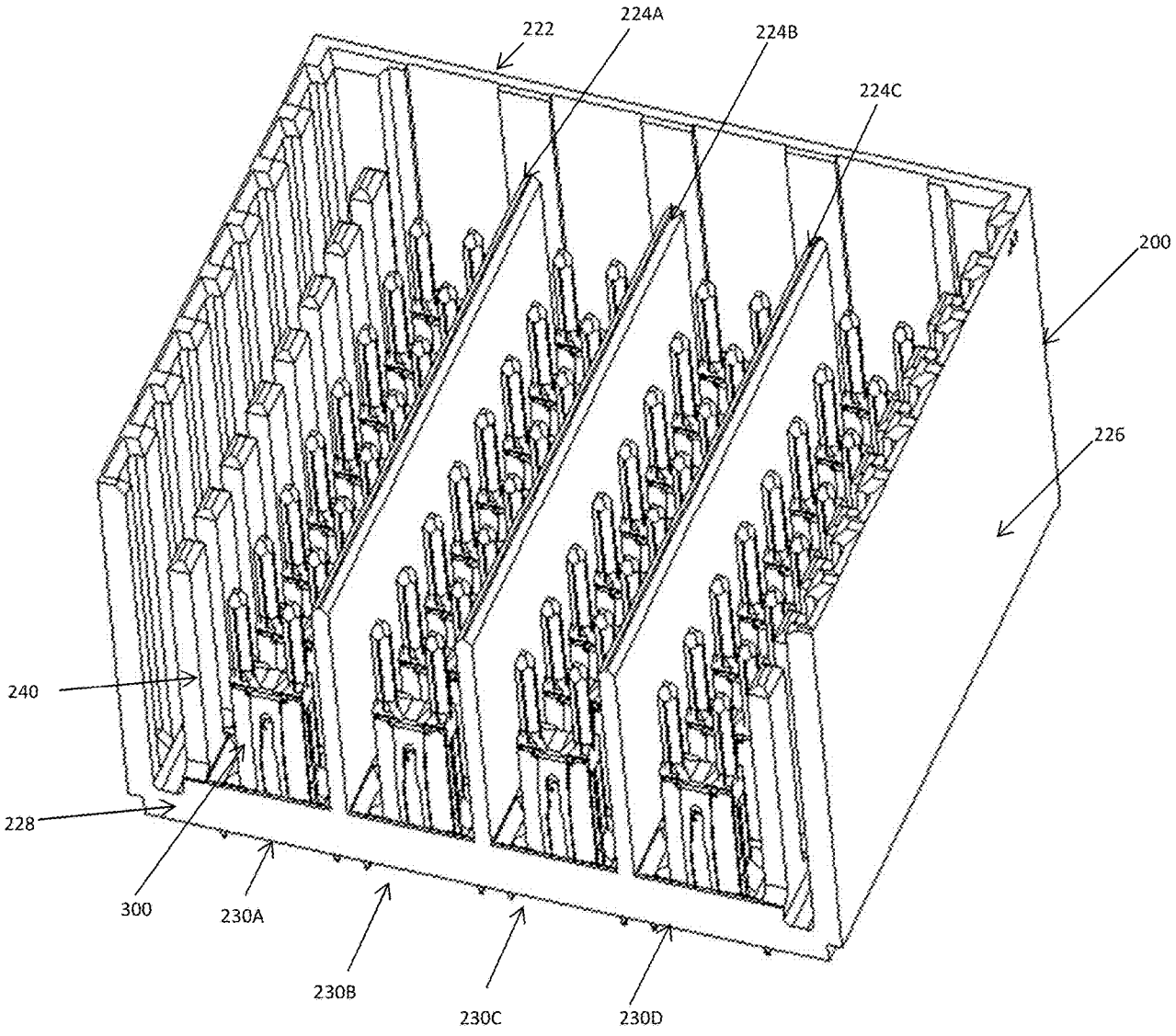
FIG. 2 is an isometric view, partially cutaway, of the backplane connector of FIG. 1.

Further details of the construction of the interconnection system of FIG. 1 are provided in FIG. 2, which shows backplane connector 200 partially cutaway. In the embodiment illustrated in FIG. 2, a forward wall of housing 222 is cut away to reveal the interior portions of mating interface 220.

In the embodiment illustrated, backplane connector 200 also has a modular construction. Multiple pin modules 300 are organized to form an array of conductive elements. Each of the pin modules 300 may be designed to mate with a module of daughtercard connector 600.

In the embodiment illustrated, four rows and eight columns of pin modules 300 are shown. With each pin module having two signal conductors, the four rows 230A, 230B, 230C and 230D of pin modules create columns with four pairs or eight signal conductors, in total. It should be appreciated, however, that the number of signal conductors per row or column is not a limitation of the invention. A greater or lesser number of rows of pin modules may be include within housing 222. Likewise, a greater or lesser number of columns may be included within housing 222. Alternatively or additionally, housing 222 may be regarded as a module of a backplane connector, and multiple such modules may be aligned side to side to extend the length of a backplane connector.

In the embodiment illustrated in FIG. 2, each of the pin modules 300 contains conductive elements serving as signal conductors. Those signal conductors are held within insulative members, which may serve as a portion of the housing backplane connector 200. The insulative portions of the pin modules 300 may be positioned to separate the signal conductors from other portions of housing 222. In this configuration, other portions of housing 222 may be conductive or partially conductive, such as may result from the use of lossy materials.

In some embodiments, housing 222 may contain both conductive and lossy portions. For example, a shroud including walls 226 and a floor 228 may be pressed from a powdered metal or formed from conductive material in any other suitable way. Pin modules 300 may be inserted into openings within floor 228.

Lossy or conductive members may be positioned adjacent rows 230A, 230B, 230C and 230D of pin modules 300. In the embodiment of FIG. 2, separators 224A, 224B and 224C are shown between adjacent rows of pin modules. Separators 224A, 224B and 224C may be conductive or lossy, and may be formed as part of the same operation or from the same member that forms walls 226 and floor 228. Alternatively, separators 224A, 224B and 224C may be inserted separately into housing 222 after walls 226 and floor 228 are formed. In embodiments in which separators 224A, 224B and 224C formed separately from walls 226 and floor 228 and subsequently inserted into housing 222, separators 224A, 224B and 224C may be formed of a different material than walls 226 and/or floor 228. For example, in some embodiments, walls 226 and floor 228 may be conductive while separators 224A, 224B and 224C may be lossy or partially lossy and partially conductive.

In some embodiments, other lossy or conductive members may extend into mating interface 220, perpendicular to floor 228. Members 240 are shown adjacent to end-most rows 230A and 230D. In contrast to separators 224A, 224B and 224C, which extend across the mating interface 220, separator members 240, approximately the same width as one column, are positioned in rows adjacent row 230A and row 230D. Daughtercard connector 600 may include, in its mating interface 620, slots to receive, separators 224A, 224B and 224C. Daughtercard connector 600 may include openings that similarly receive members 240. Members 240 may have a similar electrical effect to separators 224A, 224B and 224C, in that both may suppress resonances, crosstalk or other undesired electrical effects. Members 240, because they fit into smaller openings within daughtercard connector 600 than separators 224A, 224B and 224C, may enable greater mechanical integrity of housing portions of daughtercard connector 600 at the sides where members 240 are received.

Figure 3:
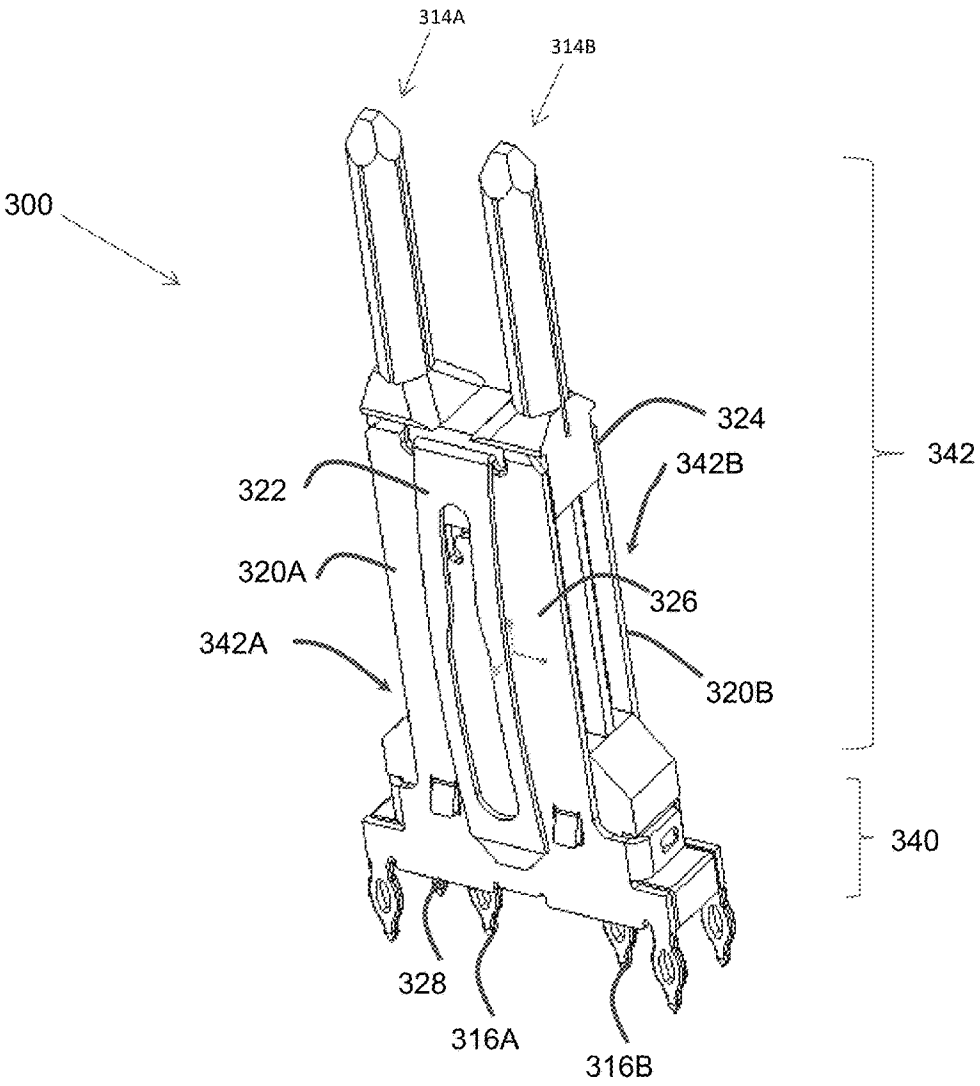
FIG. 3 is an isometric view of a pin assembly of the backplane connector of FIG. 2.

FIG. 3 illustrates a pin module 300 in greater detail. In this embodiment, each pin module includes a pair of conductive elements acting as signal conductors 314A and 314B. Each of the signal conductors has a mating interface portion shaped as a pin. Opposing ends of the signal conductors have contact tails 316A and 316B. In this embodiment, the contact tails are shaped as press fit compliant sections. Intermediate portions of the signal conductors, connecting the contact tails to the mating contact portions, pass through pin module 300.

Conductive elements serving as reference conductors 320A and 320B are attached at opposing exterior surfaces of pin module 300. Each of the reference conductors has contact tails 328, shaped for making electrical connections to vias within a printed circuit board. The reference conductors also have making contact portions. In the embodiment illustrated, two types of mating contact portions are illustrated. Compliant member 322 may serve as a mating contact portion, pressing against a reference conductor in daughtercard connector 600. In some embodiments, surfaces 324 and 326 alternatively or additionally may serve as mating contact portions, where reference conductors from the mating conductor may press against reference conductors 320A or 320B. However, in the embodiment illustrated, the reference conductors may be shaped such that electrical contact is made only at compliant member 322.

Figure 4:
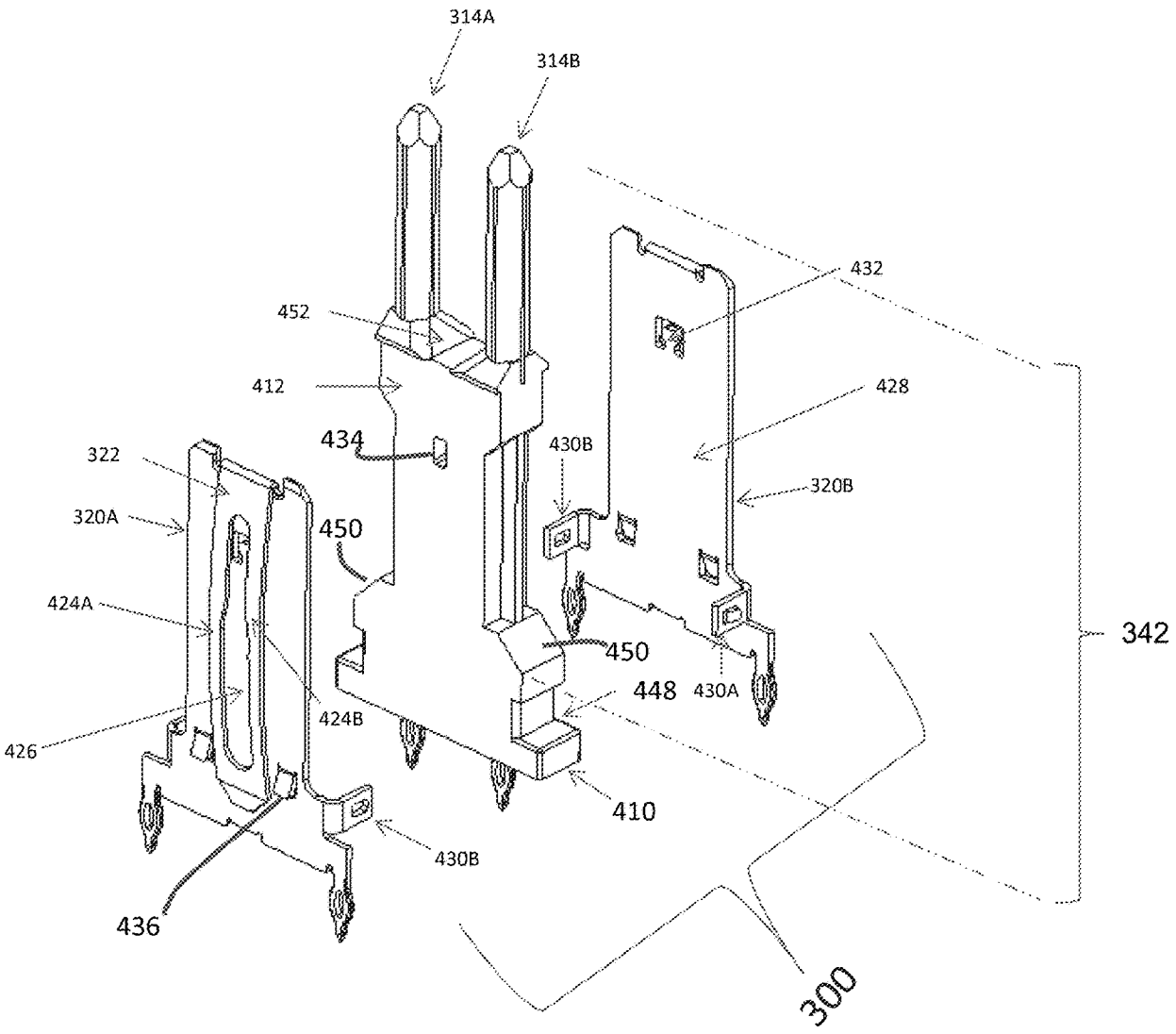
FIG. 4 is an exploded view of the pin assembly of FIG. 3.

FIG. 4 shows an exploded view of pin module 300. Intermediate portions of the signal conductors 314A and 314B are held within an insulative member 410, which may form a portion of the housing of backplane connector 200. Insulative member 410 may be insert molded around signal conductors 314A and 314B. A surface 412 against which reference conductor 320B presses is visible in the exploded view of FIG. 4. Likewise, the surface 428 of reference conductor 320A, which presses against a surface of insulative member 410 not visible in FIG. 4, can also be seen in this view.

As can be seen, the surface 428 is substantially unbroken. Attachment features, such as tab 432 may be formed in the surface 428. Such a tab may engage an opening (not visible in the view shown in FIG. 4) in insulative member 410 to hold reference conductor 320A to insulative member 410. A similar tab (not numbered) may be formed in reference conductor 320B. As shown, these tabs, which serve as attachment mechanisms, are centered between signal conductors 314A and 314B where radiation from or affecting the pair is relatively low. Additionally, tabs, such as 436, may be formed in reference conductors 320A and 320B. Tabs 436 may engage insulative member 410 to hold pin module 300 in an opening in floor 228.

In the embodiment illustrated, compliant member 322 is not cut from the planar portion of the reference conductor 320B that presses against the surface 412 of the insulative member 410. Rather, compliant member 322 is formed from a different portion of a sheet of metal and folded over to be parallel with the planar portion of the reference conductor 320B. In this way, no opening is left in the planar portion of the reference conductor 320B from forming compliant member 322. Moreover, as shown, compliant member 322 has two compliant portions 424A and 424B, which are joined together at their distal ends but separated by an opening 426. This configuration may provide mating contact portions with a suitable mating force in desired locations without leaving an opening in the shielding around pin module 300. However, a similar effect may be achieved in some embodiments by attaching separate compliant members to reference conductors 320A and 320B.

The reference conductors 320A and 320B may be held to pin module 300 in any suitable way. As noted above, tabs 432 may engage an opening 434 in the housing portion of backplane connector 200. Additionally or alternatively, straps or other features may be used to hold other portions of the reference conductors. As shown each reference conductor includes straps 430A and 430B. Straps 430A include tabs while straps 430B include openings adapted to receive those tabs. Here reference conductors 320A and 320B have the same shape, and may be made with the same tooling, but are mounted on opposite surfaces of the pin module 300. As a result, a tab 430A of one reference conductor aligns with a tab 430B of the opposing reference conductor such that the tab 430A and the tab 430B interlock and hold the reference conductors in place. These tabs may engage in an opening 448 in the insulative member, which may further aid in holding the reference conductors in a desired orientation relative to signal conductors 314A and 314B in pin module 300.

FIG. 4 further reveals a tapered surface 450 of the insulative member 410. In this embodiment surface 450 is tapered with respect to the axis of the signal conductor pair formed by signal conductors 314A and 314B. Surface 450 is tapered in the sense that it is closer to the axis of the signal conductor pair closer to the distal ends of the mating contact portions and further from the axis further from the distal ends. In the embodiment illustrated, pin module 300 is symmetrical with respect to the axis of the signal conductor pair and a tapered surface 450 is formed adjacent each of the signal conductors 314A and 314B.

In accordance with some embodiments, some or all of the adjacent surfaces in mating connectors may be tapered. Accordingly, though not shown in FIG. 4, surfaces of the insulative portions of daughtercard connector 600 that are adjacent to tapered surfaces 450 may be tapered in a complementary fashion such that the surfaces from the mating connectors conform to one another when the connectors are in the designed mating positions.

As is described in greater detail below, tapered surfaces in the mating interfaces may avoid abrupt changes in impedance as a function of connector separation. Accordingly, other surfaces designed to be adjacent a mating connector may be similarly tapered. FIG. 4 shows such tapered surfaces 452. As shown, tapered surfaces 452 are between signal conductors 314A and 314B. Surfaces 450 and 452 cooperate to provide a taper on the insulative portions on both sides of the signal conductors.

Figure 5:
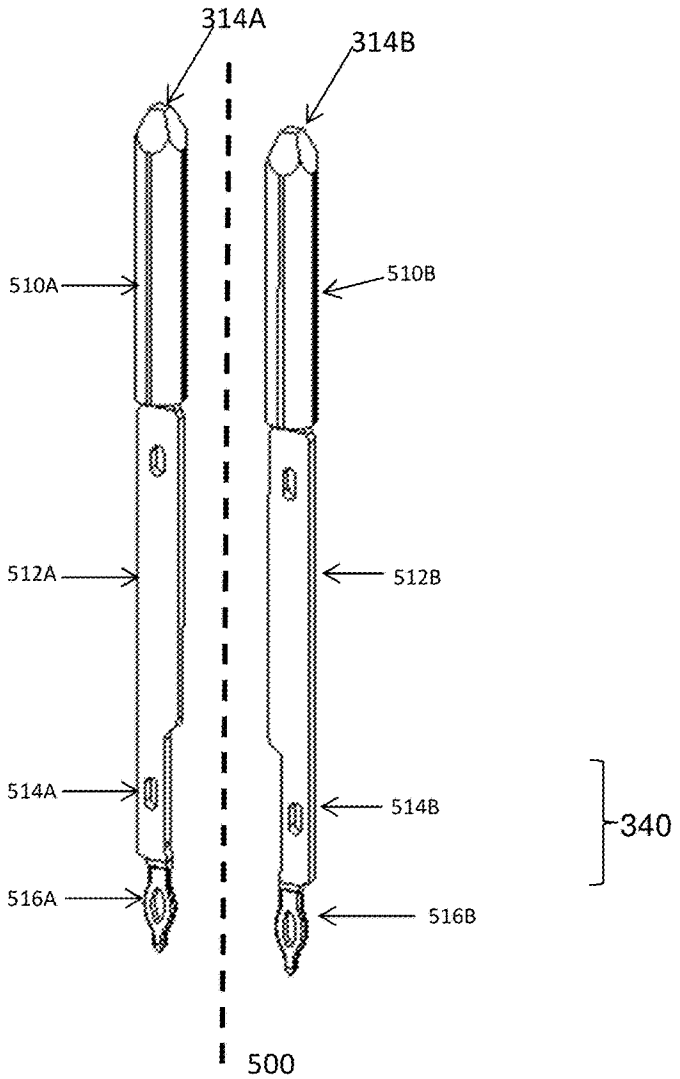
FIG. 5 is an isometric view of signal conductors of the pin assembly of FIG. 3.

FIG. 5 shows further detail of pin module 300. Here, the signal conductors are shown separated from the pin module. FIG. 5 may represent the signal conductors before being over molded by insulative portions or otherwise being incorporated into a pin module 300. However, in some embodiments, the signal conductors may be held together by a carrier strip or other suitable support mechanism, not shown in FIG. 5, before being assembled into a module.

In the illustrated embodiment, the signal conductors 314A and 314B are symmetrical with respect to an axis 500 of the signal conductor pair. Each has a mating contact portion, 510A or 510B shaped as a pin. Each also has an intermediate portion 512A or 512B, and 514A or 514B. Here, different widths are provided to provide for matching impedance to a mating connector and a printed circuit board, despite different materials or construction techniques in each. A transition region may be included, as illustrated, to provide a gradual transition between regions of different width. Contact tails 516A or 516B may also be included.

In the embodiment illustrated, intermediate portions 512A, 512B, 514A and 514B may be flat, with broadsides and narrower edges. The signal conductors of the pairs are, in the embodiment illustrated, aligned edge-to-edge and are thus configured for edge coupling. In other embodiments, some or all of the signal conductor pairs may alternatively be broadside coupled.

Mating contact portions may be of any suitable shape, but in the embodiment illustrated, they are cylindrical. The cylindrical portions may be formed by rolling portions of a sheet of metal into a tube or in any other suitable way. Such a shape may be created, for example, by stamping a shape from a sheet of metal that includes the intermediate portions. A portion of that material may be rolled into a tube to provide the mating contact portion. Alternatively or additionally, a wire or other cylindrical element may be flattened to form the intermediate portions, leaving the mating contact portions cylindrical. One or more openings (not numbered) may be formed in the signal conductors. Such openings may ensure that the signal conductors are securely engaged with the insulative member 410.

Figure 6:
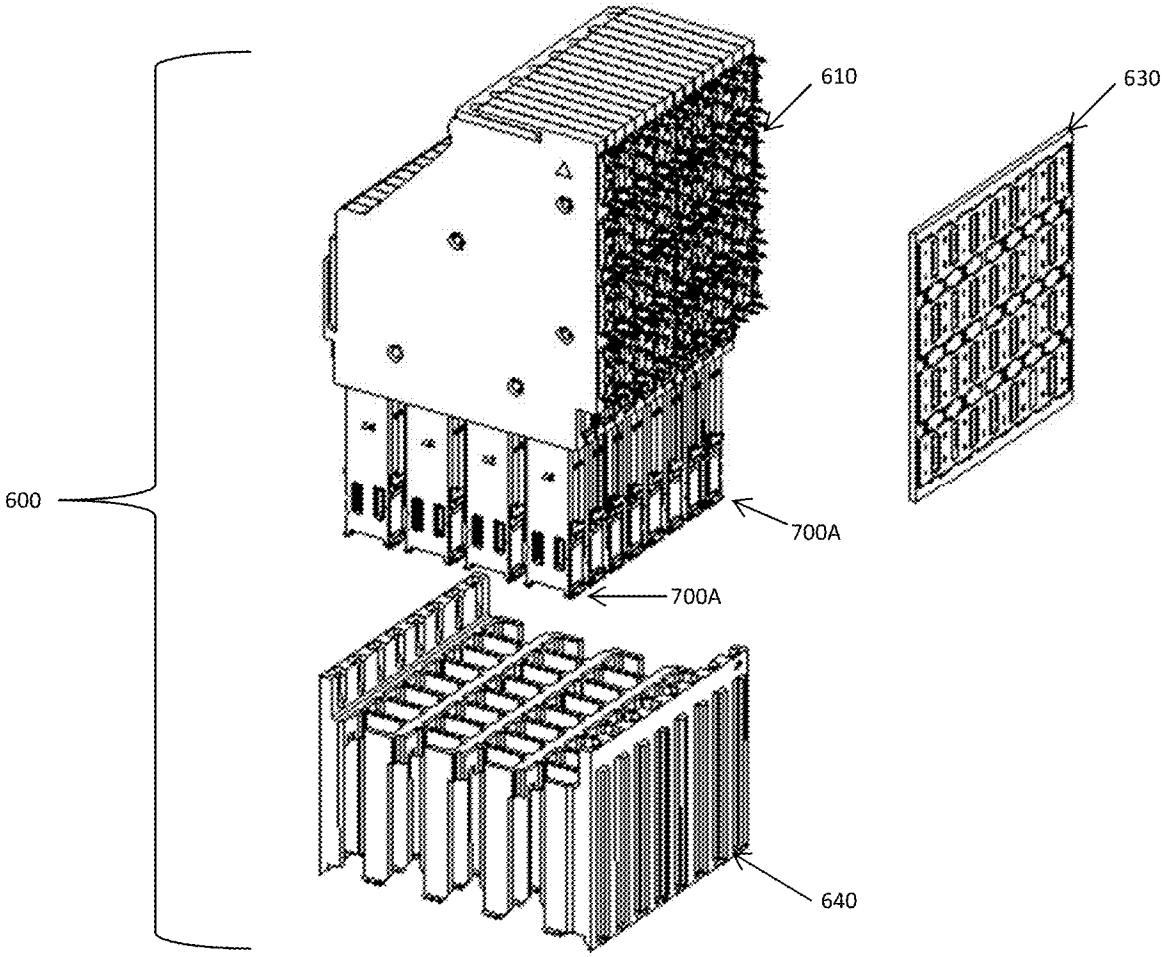
FIG. 6 is an isometric view, partially exploded, of the daughtercard connector of FIG. 1.

Turning to FIG. 6, further details of daughtercard connector 600 are shown in a partially exploded view. As shown, connector 600 includes multiple wafers 700A held together in a side-by-side configuration. Here, eight wafers, corresponding to the eight columns of pin modules in backplane connector 200, are shown. However, as with backplane connector 200, the size of the connector assembly may be configured by incorporating more rows per wafer, more wafers per connector or more connectors per interconnection system.

Conductive elements within the wafers 700A may include mating contact portions and contact tails. Contact tails 610 are shown extending from a surface connector 600 adapted for mounting against a printed circuit board. In some embodiments, contact tails 610 may pass through a member 630. Member 630 may include insulative, lossy or conductive portions. In some embodiments, contact tails associated with signal conductors may pass through insulative portions of member 630. Contact tails associated with reference conductors may pass through lossy or conductive portions.

In some embodiments, the conductive portions may be compliant, such as may result from a conductive elastomer or other material that may be known in the art for forming a gasket. The compliant material may be thicker than the insulative portions of member 630. Such compliant material may be positioned to align with pads on a surface of a daughtercard to which connector 600 is to be attached. Those pads may be connected to reference structures within the printed circuit board such that, when connector 600 is attached to the printed circuit board, the compliant material makes contact with the reference pads on the surface of the printed circuit board.

The conductive or lossy portions of member 630 may be positioned to make electrical connection to reference conductors within connector 600. Such connections may be formed, for example, by contact tails of the reference conductors passing through the lossy of conductive portions. Alternatively or additionally, in embodiments in which the lossy or conductive portions are compliant, those portions may be positioned to press against the mating reference conductors when the connector is attached to a printed circuit board.

Mating contact portions of the wafers 700A are held in a front housing portion 640. The front housing portion may be made of any suitable material, which may be insulative, lossy or conductive or may include any suitable combination or such materials. For example the front housing portion may be molded from a filled, lossy material or may be formed from a conductive material, using materials and techniques similar to those described above for the housing walls 226. As shown, the wafers are assembled from modules 810A, 810B, 810C and 810D (FIG. 8), each with a pair of signal conductors surrounded by reference conductors. In the embodiment illustrated, front housing portion 640 has multiple passages, each positioned to receive one such pair of signal conductors and associated reference conductors. However, it should be appreciated that each module might contain a single signal conductor or more than two signal conductors.

Figure 7:
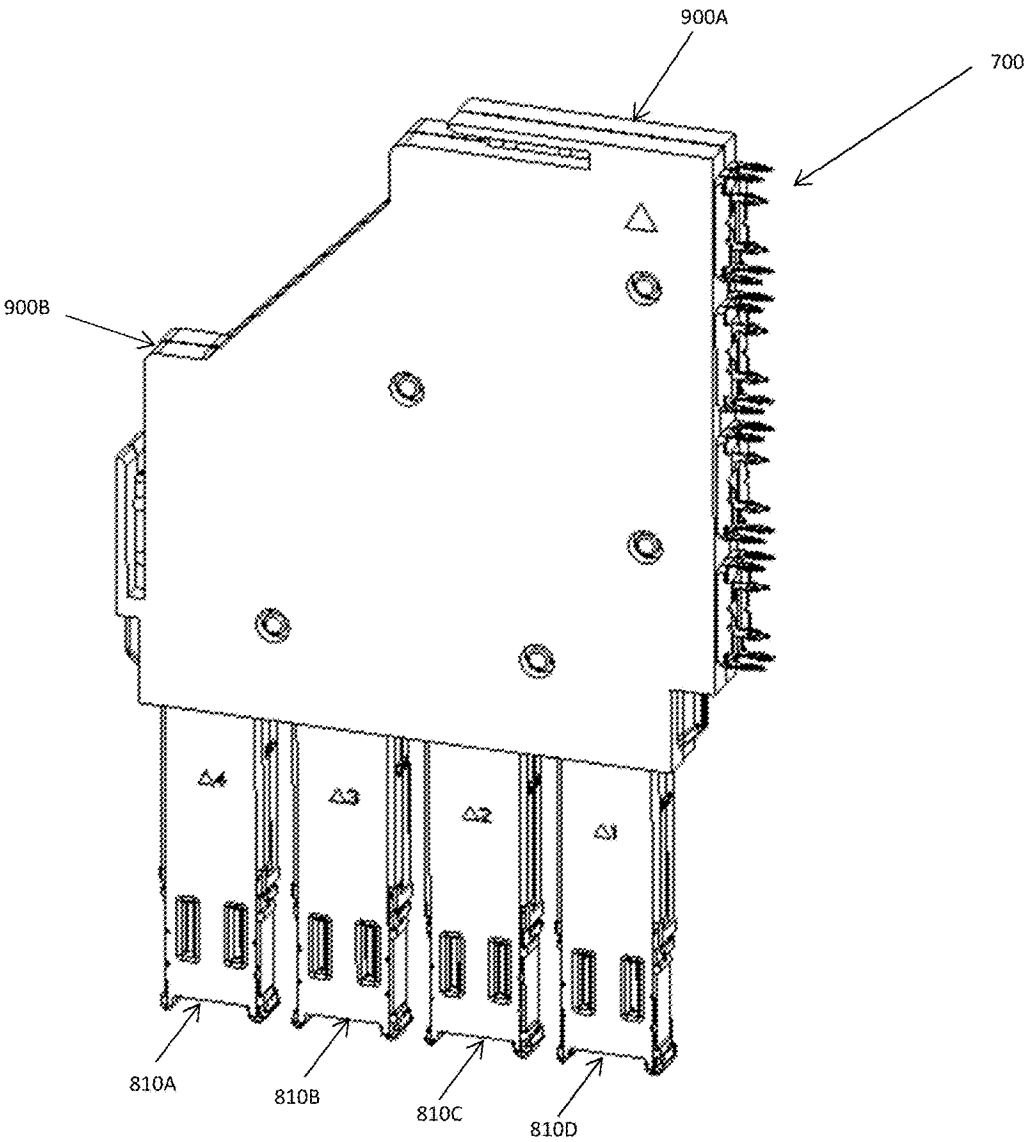
FIG. 7 is an isometric view of a wafer assembly of the daughtercard connector of FIG. 6.

FIG. 7 illustrates a wafer 700. Multiple such wafers may be aligned side-by-side and held together with one or more support members, or in any other suitable way, to form a daughtercard connector. In the embodiment illustrated, wafer 700 is formed from multiple modules 810A, 810B, 810C and 810D. The modules are aligned to form a column of mating contact portions along one edge of wafer 700 and a column of contact tails along another edge of wafer 700. In the embodiment in which the wafer is designed for use in a right angle connector, as illustrated, those edges are perpendicular.

In the embodiment illustrated, each of the modules includes reference conductors that at least partially enclose the signal conductors. The reference conductors may similarly have mating contact portions and contact tails.

The modules may be held together in any suitable way. For example, the modules may be held within a housing, which in the embodiment illustrated is formed with members 900A and 900B. Members 900A and 900B may be formed separately and then secured together, capturing modules 810A . . . 810D between them. Members 900A and 900B may be held together in any suitable way, such as by attachment members that form an interference fit or a snap fit. Alternatively or additionally, adhesive, welding or other attachment techniques may be used.

Members 900A and 900B may be formed of any suitable material. That material may be an insulative material. Alternatively or additionally, that material may be or may include portions that are lossy or conductive. Members 900A and 900B may be formed, for example, by molding such materials into a desired shape. Alternatively, members 900A and 900B may be formed in place around modules 810A . . . 810D, such as via an insert molding operation. In such an embodiment, it is not necessary that members 900A and 900B be formed separately. Rather, a housing portion to hold modules 810A . . . 810D may be formed in one operation.

FIG. 8 shows modules 810A . . . 810D without members 900A and 900B. In this view, the reference conductors are visible. Signal conductors (not visible in FIG. 8) are enclosed within the reference conductors, forming a waveguide structure. Each waveguide structure includes a contact tail region 820, an intermediate region 830 and a mating contact region 840. Within the mating contact region 840 and the contact tail region 820, the signal conductors are positioned edge to edge. Within the intermediate region 830, the signal conductors are positioned for broadside coupling. Transition regions 822 and 842 are provided to transition between the edge coupled orientation and the broadside coupled orientation. These regions may be configured to avoid mode conversion upon transition between coupling orientations.

Though the reference conductors may substantially enclose each pair, it is not a requirement that the enclosure be without openings. In the embodiment illustrated, the reference conductors may be shaped to leave openings 832. These openings may be in the narrower wall of the enclosure. Such openings may suppress undesired modes of energy propagation. In embodiments in which members 900A and 900B are formed by over molding lossy material on the modules, lossy material may be allowed to fill openings 832, which may further suppress propagation of undesired modes of signal propagation, that can decrease signal integrity.

Figure 9:
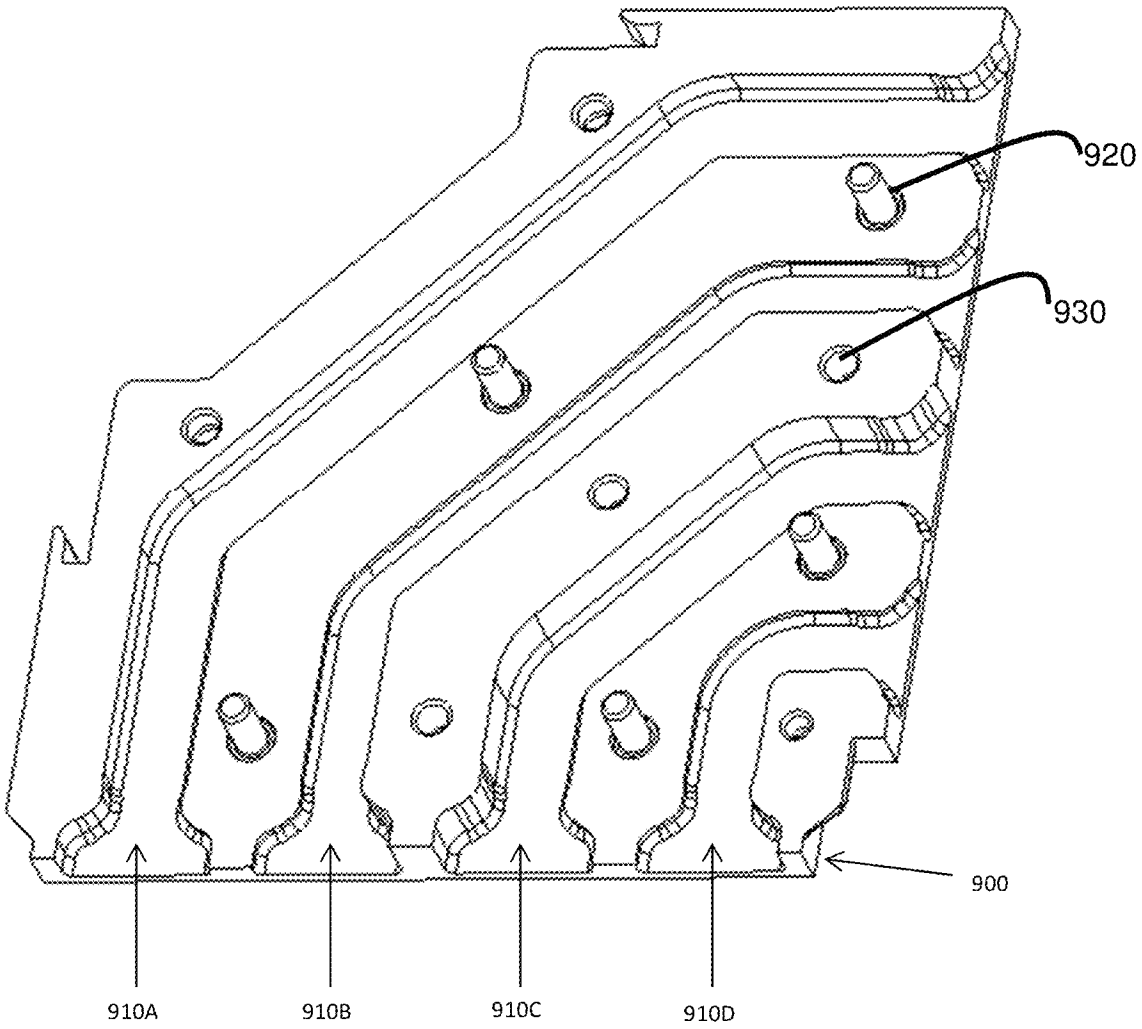
FIG. 9 is an isometric view of a portion of the insulative housing of the wafer assembly of FIG. 7.

FIG. 9 illustrates a member 900, which may be a representation of member 900A or 900B. As can be seen, member 900 is formed with channels 910A . . . 910D shaped to receive modules 810A . . . 810D shown in FIG. 8. With the modules in the channels, member 900A may be secured to member 900B. In the illustrated embodiment, attachment of members 900A and 900B may be achieved by posts, such as post 920, in one member, passing through a hole, such as hole 930, in the other member. The post may be welded or otherwise secured in the hole. However, any suitable attachment mechanism may be used.

Members 900A and 900B may be molded from or include a lossy material. Any suitable lossy material may be used for these and other structures that are "lossy." Materials that conduct, but with some loss, or material which by other physical mechanisms absorb electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest. Electrically lossy materials typically have a bulk conductivity of about 1 siemen/meter to about 100,000 siemens/meter and preferably about 1 siemen/meter to about 10,000 siemens/meter. In some embodiments material with a bulk conductivity of between about 10 siemens/meter and about 200 siemens/meter may be used. As a specific example, material with a conductivity of about 50 siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US may also be used. This preform can include an epoxy binder filled with carbon fibers and/or other carbon particles. The binder surrounds carbon particles, which act as a reinforcement for the preform. Such a preform may be inserted in a connector wafer to form all or part of the housing. In some embodiments, the preform may adhere through the adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy member may be manufactured by stamping a preform or sheet of lossy material. For example, an insert may be formed by stamping a preform as described above with an appropriate pattern of openings. However, other materials may be used instead of or in addition to such a preform. A sheet of ferromagnetic material, for example, may be used.

However, lossy members also may be formed in other ways. In some embodiments, a lossy member may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

Figure 10:
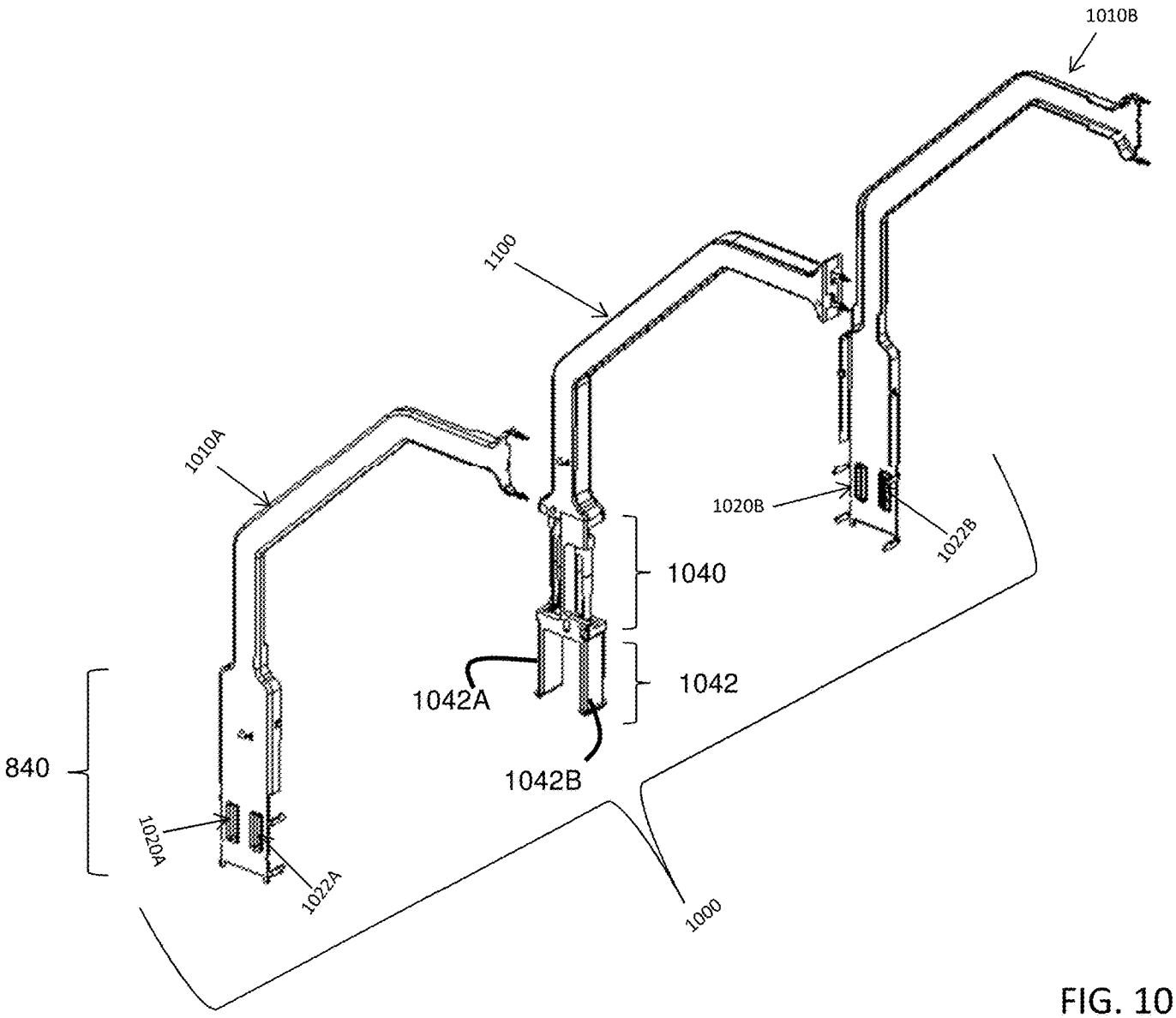
FIG. 10 is an isometric view, partially exploded, of a wafer module of the wafer assembly of FIG. 7.

FIG. 10 shows further details of construction of a wafer module 1000. Module 1000 may be representative of any of the modules in a connector, such as any of the modules 810A . . . 810D shown in FIGS. 7-8. Each of the modules 810A . . . 810D may have the same general construction, and some portions may be the same for all modules. For example, the contact tail regions 820 and mating contact regions 840 may be the same for all modules. Each module may include an intermediate portion region 830, but the length and shape of the intermediate portion region 830 may vary depending on the location of the module within the wafer.

Figure 11:
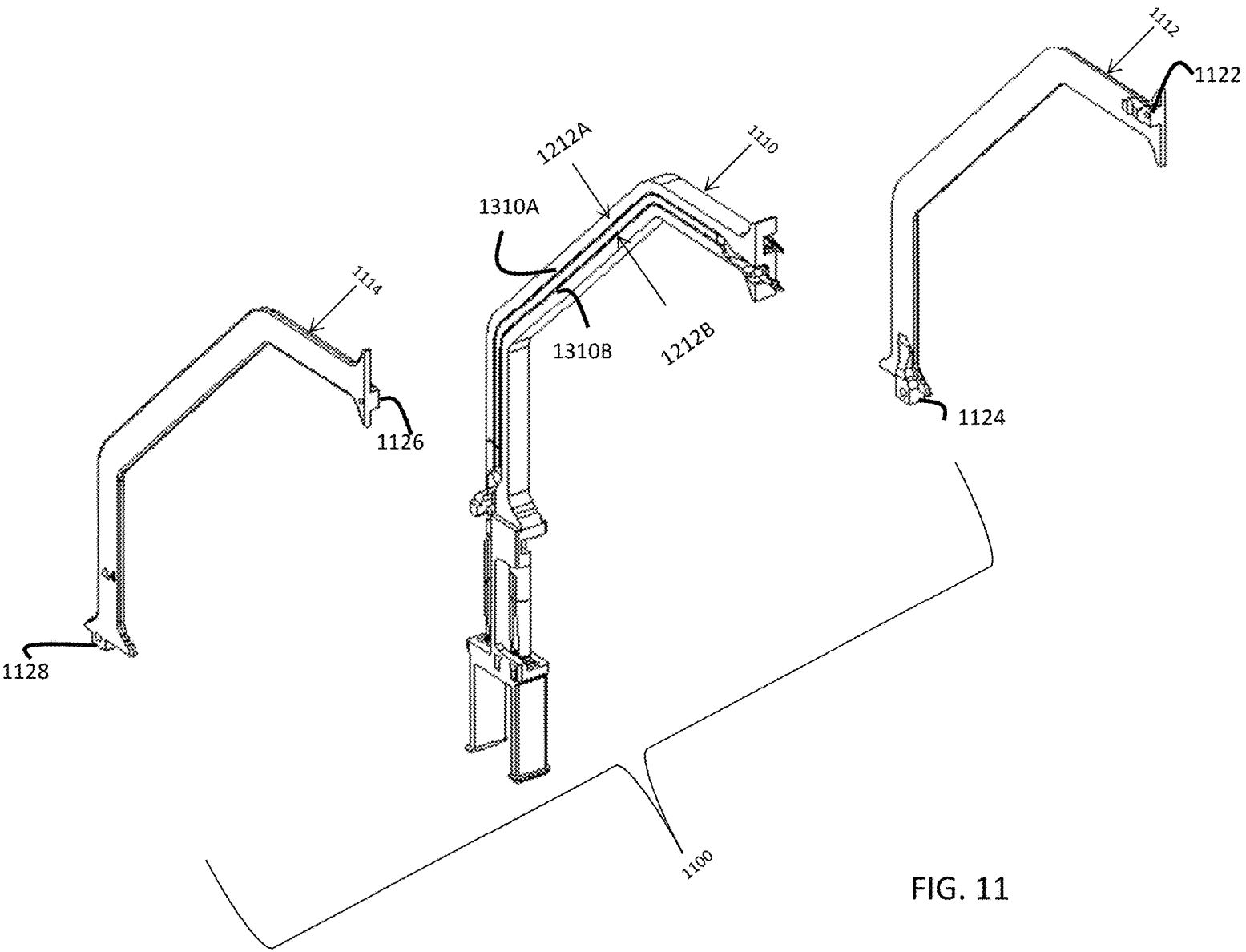
FIG. 11 is an isometric view, partially exploded, of a portion of a wafer module of the wafer assembly of FIG. 7.

In the embodiment illustrated, module 1000 includes a pair of signal conductors 1310A and 1310B (FIG. 13) held within an insulative housing portion 1100 (see FIG. 11). Insulative housing portion 1100 is enclosed, at least partially, by reference conductors 1010A and 1010B. This subassembly may be held together in any suitable way. For example, reference conductors 1010A and 1010B may have features that engage one another. Alternatively or additionally, reference conductors 1010A and 1010B may have features that engage insulative housing portion 1100. As yet another example, the reference conductors may be held in place once members 900A and 900B are secured together as shown in FIG. 7.

The exploded view of FIG. 10 reveals that mating contact region 840 includes subregions 1040 and 1042. Subregion 1040 includes mating contact portions of module 1000. When mated with a pin module 300, mating contact portions from the pin module will enter subregion 1040 and engage the mating contact portions of module 1000. These components may be dimensioned to support a "functional mating range," such that, if the module 300 and module 1000 are fully pressed together, the mating contact portions of module 1000 will slide along the pins from pin module 300 by a distance equal to the "functional mating range" during mating.

The impedance of the signal conductors in subregion 1040 will be largely defined by the structure of module 1000. The separation of signal conductors of the pair as well as the separation of the signal conductors from reference conductors 1010A and 1010B will set the impedance. The dielectric constant of the material surrounding the signal conductors, which in this embodiment is air, will also impact the impedance. In accordance with some embodiments, design parameters of module 1000 may be selected to provide a nominal impedance within region 1040. That impedance may be designed to match the impedance of other portions of module 1000, which in turn may be selected to match the impedance of a printed circuit board or other portions of the interconnection system such that the connector does not create impedance discontinuities.

If the modules 300 and 1000 are in their nominal mating position, which in this embodiment is fully pressed together, the pins will be within mating contact portions of the signal conductors of module 1000. The impedance of the signal conductors in subregion 1040 will still be driven largely by the configuration of subregion 1040, providing a matched impedance to the rest of module 1000.

A subregion 340 (FIG. 3) may exist within pin module 300. In subregion 340, the impedance of the signal conductors will be dictated by the construction of pin module 300. The impedance will be determined by the separation of signal conductors 314A and 314B as well as their separation from reference conductors 320A and 320B. The dielectric constant of insulative member 410 may also impact the impedance. Accordingly, these parameters may be selected to provide, within subregion 340, an impedance, which may be designed to match the nominal impedance in subregion 1040.

The impedance in subregions 340 and 1040, being dictated by construction of the modules, is largely independent of any separation between the modules during mating. However, modules 300 and 1000 have, respectively, subregions 342 and 1042 in which the components from that module interact with components from the mating module in a way that could influence impedance. Because the positioning of components in two modules could influence impedance, the impedance could vary as a function of separation of the mating modules. In some embodiments, these components are shaped or positioned to reduce changes of impedance, regardless of separation distance, or to reduce the impact of changes of impedance by distributing the change across the mating region.

When pin module 300 is pressed fully against module 1000, the components in subregions 342 and 1042 may combine to provide the nominal mating impedance. Because the modules are designed to provide a functional mating range, signal conductors within pin module 300 and module 1000 may mate, even if those modules are separated by an amount up to the functional mating range, such that separation between the modules can lead to changes in impedance, relative to the nominal value, at one or more places along the signal conductors in the mating region. Appropriate shape and positioning of these members can reduce that change or reduce the effect of the change by distributing it over portions of the mating region.

In the embodiments illustrated in FIG. 3 and FIG. 10, subregion 1042 is designed to overlap pin module 300 when module 1000 is pressed fully against pin module 300. Projecting insulative members 1042A and 1042B are sized to fit within spaces 342A and 342B, respectively. With the modules pressed together, the distal ends of insulative members 1042A and 1042B press against surfaces 450 (FIG. 4). Those distal ends may have a shape complementary to the taper of surfaces 450 such that insulative members 1042A and 1042B fill spaces 342A and 342B, respectively. That overlap creates a relative position of signal conductors, dielectric, and reference conductors that may approximate the structure within subregion 340. These components may be sized to provide the same impedance as in subregion 340 when modules 300 and 1000 are fully pressed together. When the modules are fully pressed together, which in this example is the nominal mating position, the signal conductors will have the same impedance across the mating region made up by subregions 340, 1040 and where subregions 342 and 1042 overlap.

As described in greater detail below, these components also may be sized and may have material properties that provide impedance control as a function of separation of modules 300 and 1000. Impedance control may be achieved by providing approximately the same impedance through subregions 342 and 1042, even if those subregions do not fully overlap, or by providing gradual impedance transitions, regardless of separation of the modules.

In the illustrated embodiment, this impedance control is provided in part by projecting insulative members 1042A and 1042B, which fully or partially overlap module 300, depending on separation between modules 300 and 1000. These projecting insulative members can reduce the magnitude of changes in relative dielectric constant of material surrounding pins from pin module 300.

Impedance control may also be provided by the shape or position of conductive elements. Impedance control is also provided by projections 1020A and 1022A and 1020B and 1022B in the reference conductors 1010A and 1010B. These projections impact the separation, in a direction perpendicular to the axis of the signal conductor pair, between portions of the signal conductors of the pair and the reference conductors 1010A and 1010B. This separation, in combination with other characteristics, such as the width of the signal conductors in those portions, may control the impedance in those portions such that it approximates the nominal impedance of the connector or does not change abruptly in a way that may cause signal reflections. Other parameters of either or both mating modules may be configured for such impedance control.

Turning to FIG. 11, further details of exemplary components of a module 1000 are illustrated. FIG. 11 is an exploded view of module 1000, without reference conductors 1010A and 1010B shown. Insulative housing portion 1100 is, in the illustrated embodiment, made of multiple components. Central member 1110 may be molded from insulative material. Central member 1110 includes two grooves 1212A and 1212B into which conductive elements 1310A and 1310B, which in the illustrated embodiment form a pair of signal conductors, may be inserted.

Covers 1112 and 1114 may be attached to opposing sides of central member 1110. Covers 1112 and 1114 may aid in holding conductive elements 1310A and 1310B within grooves 1212A and 1212B and with a controlled separation from reference conductors 1010A and 1010B. In the embodiment illustrated, covers 1112 and 1114 may be formed of the same material as central member 1110. However, it is not a requirement that the materials be the same, and in some embodiments, different materials may be used, such as to provide different relative dielectric constants in different regions to provide a desired impedance of the signal conductors.

In the embodiment illustrated, grooves 1212A and 1212B are configured to hold a pair of signal conductors for edge coupling at the contact tails and mating contact portions. Over a substantial portion of the intermediate portions of the signal conductors, the pair is held for broadside coupling. To transition between edge coupling at the ends of the signal conductors to broadside coupling in the intermediate portions, a transition region may be included in the signal conductors. Grooves in central member 1110 may be shaped to provide this transition region. Projections 1122, 1124, 1126 and 1128 on covers 1112 and 1114 may press the conductive elements against central portion 1110 in these transition regions.

Figure 12:
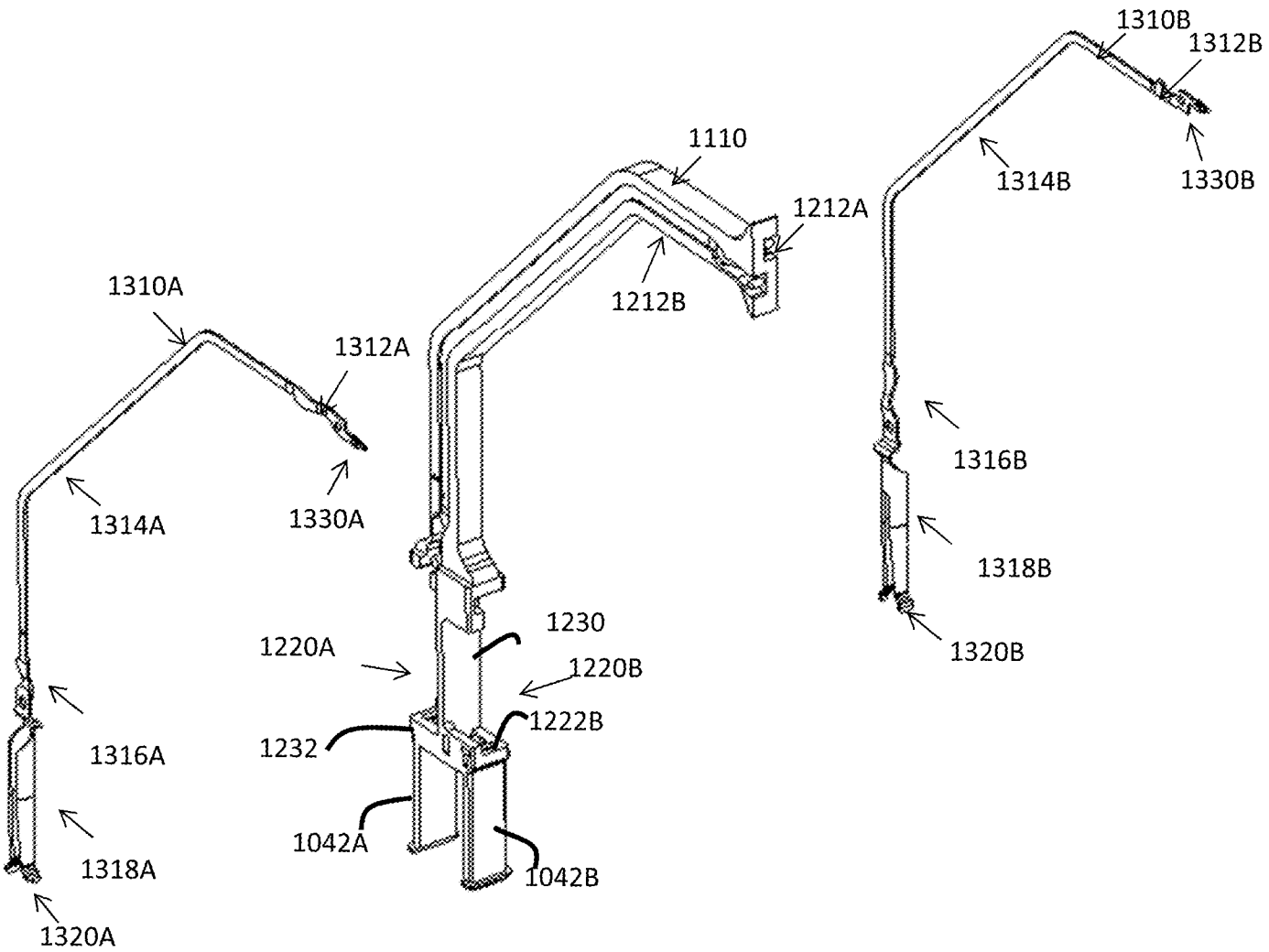
FIG. 12 is an isometric view, partially exploded, of a portion of a wafer module of the wafer assembly of FIG. 7.

FIG. 12 shows further detail of a module 1000. In this view, conductive elements 1310A and 1310B are shown separated from central member 1110. For clarity, covers 1112 and 1114 are not shown. Transition region 1312A between contact tail 1330A and intermediate portion 1314A is visible in this view. Similarly, transition region 1316A between intermediate portion 1314A and mating contact portion 1318A is also visible. Similar transition regions 1312 B and 1316B are visible for conductive element 1310B, allowing for edge coupling at contact tails 1330B and mating contact portions 1318B and broadside coupling at intermediate portion 1314B.

The mating contact portions 1318A and 1318 B may be formed from the same sheet of metal as the conductive elements. However, it should be appreciated that, in some embodiments, conductive elements may be formed by attaching separate mating contact portions to other conductors to form the intermediate portions. For example, in some embodiments, intermediate portions may be cables such that the conductive elements are formed by terminating the cables with mating contact portions.

In the embodiment illustrated, the mating contact portions are tubular. Such a shape may be formed by stamping the conductive element from a sheet of metal and then forming to roll the mating contact portions into a tubular shape. The circumference of the tube may be large enough to accommodate a pin from a mating pin module, but may conform to the pin. The tube may be split into two or more segments, forming compliant beams. Two such beams are shown in FIG. 12. Bumps or other projections may be formed in distal portions of the beams, creating contact surfaces. Those contact surfaces may be coated with gold or other conductive, ductile material to enhance reliability of an electrical contact.

When conductive elements 1310A and 1310B are mounted in central member 1110, mating contact portions 1318A and 1318B fit within openings 1220A 1220B. The mating contact portions are separated by wall 1230. The distal ends 1320A and 1320B of mating contact portions 1318A and 1318 B may be aligned with openings, such as opening 1222B, in platform 1232. These openings may be positioned to receive pins from the mating pin module 300. Wall 1230, platform 1232 and insulative projecting members 1042A and 1042B may be formed as part of portion 1110, such as in one molding operation. However, any suitable technique may be used to form these members.

Figure 13:
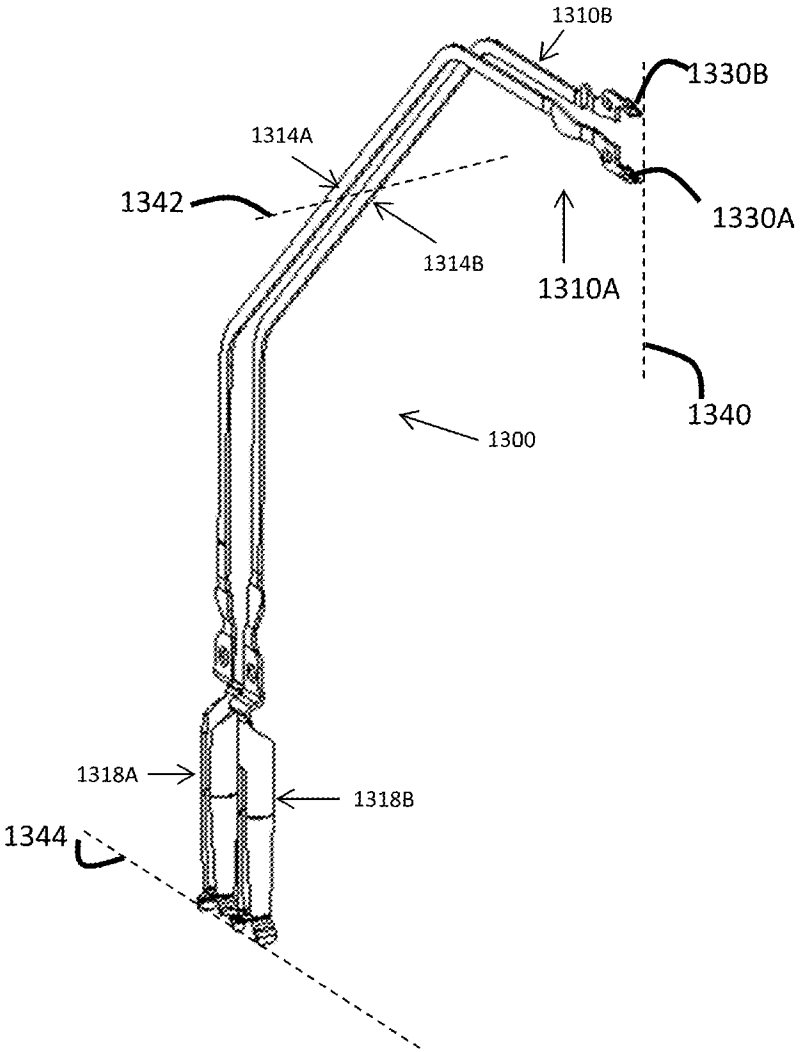
FIG. 13 is an isometric view of a pair of conducting elements of a wafer module of the wafer assembly of FIG. 7.

FIG. 13 shows in greater detail the positioning of conductive members 1310A and 1310B, forming a pair 1300 of signal conductors. In the embodiment illustrated, conductive elements 1310A and 1310B each have edges and broader sides between those edges. Contact tails 1330A and 1330B are aligned in a column 1340. With this alignment, edges of conductive elements 1310A and 1310B face each other at the contact tails 1330A and 1330B. Other modules in the same wafer will similarly have contact tails aligned along column 1340. Contact tails from adjacent wafers will be aligned in parallel columns. The space between the parallel columns creates routing channels on the printed circuit board to which the connector is attached. Mating contact portions 1318A and 1318B are aligned along column 1344. Though the mating contact portions are tubular, the portions of conductive elements 1310A and 1310B to which mating contact portions 1318A and 1318B are attached are edge coupled. Accordingly, mating contact portions 1318A and 1318B may similarly be said to be edge coupled.

In contrast, intermediate portions 1314A and 1314B are aligned with their broader sides facing each other. The intermediate portions are aligned in the direction of row 1342. In the example of FIG. 13, conductive elements for a right angle connector are illustrated, as reflected by the right angle between column 1340, representing points of attachment to a daughtercard, and column 1344, representing locations for mating pins attached to a backplane connector.

In a conventional right angle connector in which edge coupled pairs are used within a wafer, within each pair the conductive element in the outer row at the daughtercard is longer. In FIG. 13, conductive element 1310B is attached at the outer row at the daughtercard. However, because the intermediate portions are broadside coupled, intermediate portions 1314A and 1314B are parallel throughout the portions of the connector that traverse a right angle, such that neither conductive element is in an outer row. Thus, no skew is introduced as a result of different electrical path lengths.

Moreover, in FIG. 13, a further technique for avoiding skew is introduced. While the contact tail 1330B for conductive element 1310B is in the outer row along column 1340, the mating contact portion of conductive element 1310B (mating contact portion 1318 B) is at the shorter, inner row along column 1344. Conversely, contact tail 1330A conductive element 1310A is at the inner row along column 1340 but mating contact portion 1318A of conductive element 1310A is in the outer row along column 1344. As a result, longer path lengths for signals traveling near contact tails 1330B relative to 1330A may be offset by shorter path lengths for signals traveling near mating contact portions 1318B relative to mating contact portion 1318A. Thus, the technique illustrated may further reduce skew.

Figure 14B:
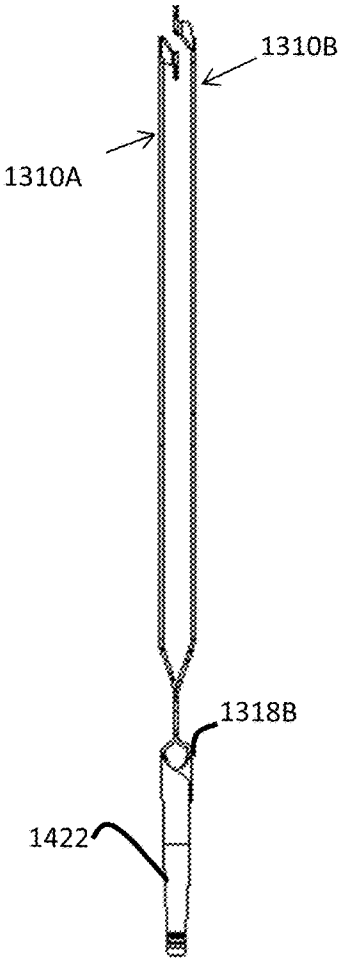
FIG. 14B is an end view of the pair of conducting elements of FIG. 13 taken along the line B-B of FIG. 14 A.
Figure 14A:
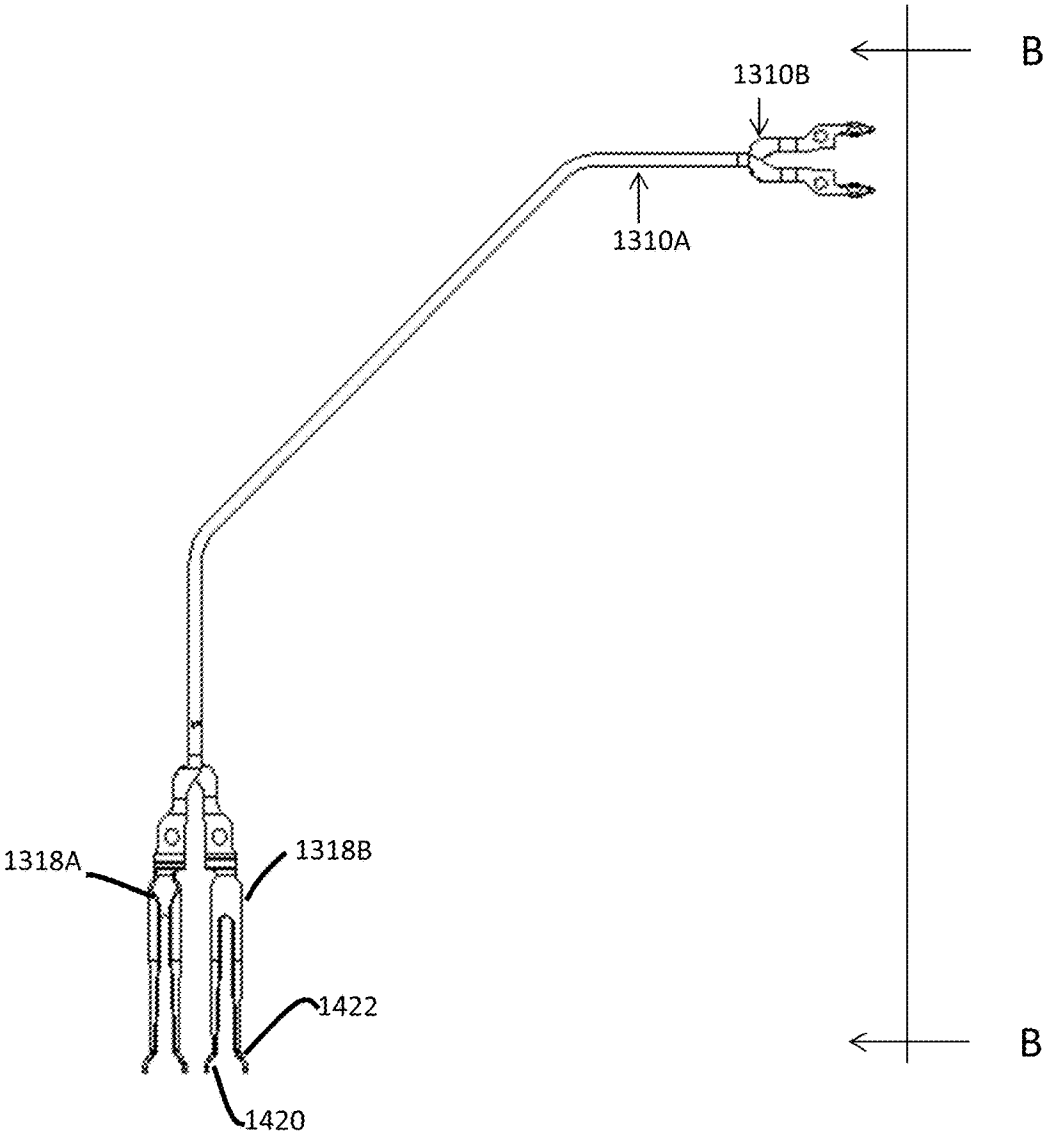
FIG. 14A is a side view of the pair of conducting elements of FIG. 13.

FIGS. 14A and 14B illustrate the edge and broadside coupling within the same pair of signal conductors. FIG. 14A is a side view, looking in the direction of row 1342. FIG. 14B is an end view, looking in the direction of column 1344. FIGS. 14A and 14B illustrate the transition between edge coupled mating contact portions and contact tails and broadside coupled intermediate portions.

Additional details of mating contact portions such as 1318A and 1318B are also visible. The tubular portion of mating contact portion 1318A is visible in the view shown in FIG. 14A and of mating contact portion 1318B in the view shown in FIG. 14B. Beams, of which beams 1420 and 1422 of mating contact portion 1318B are numbered, are also visible.

Figure 15C:
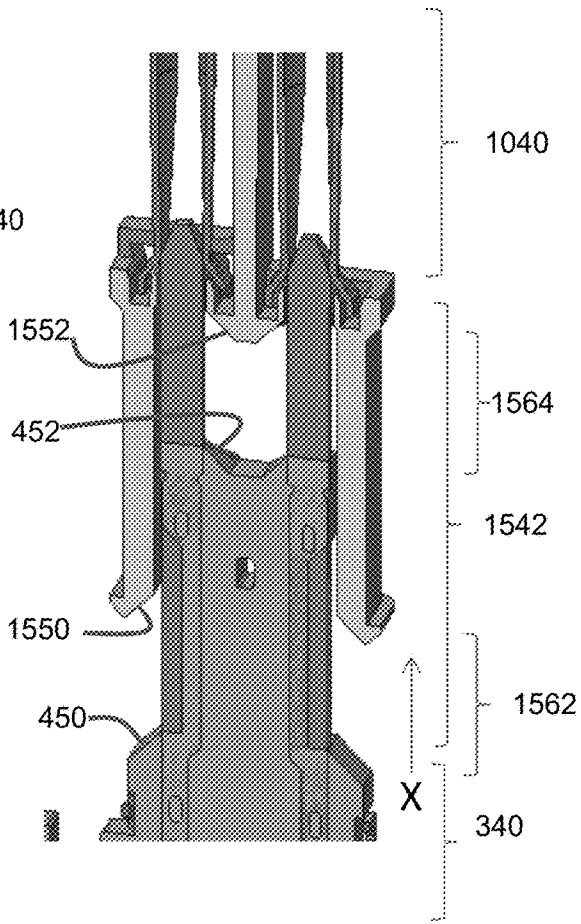
FIG. 15C is a cross sectional view of a wafer module, as shown in FIG. 8, mated to a pin assembly, as shown in FIG. 3, with shields cut away and separation between the mating components.
Figure 15B:
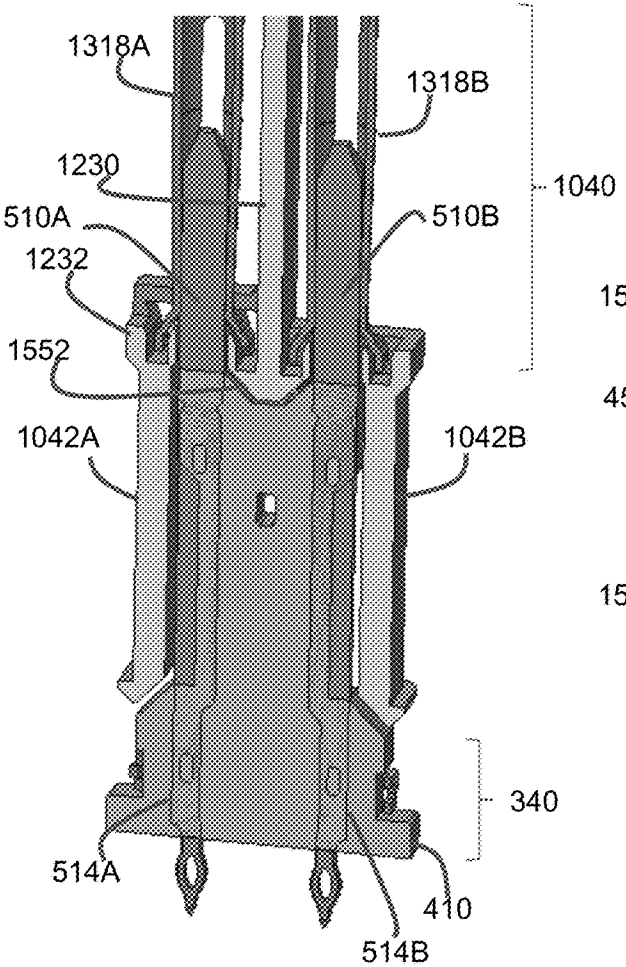
FIG. 15B is a cross sectional view of a wafer module, as shown in FIG. 8, mated to a pin assembly, as shown in FIG. 3, with shields cut away and no separation between the mating components.
Figure 15A:
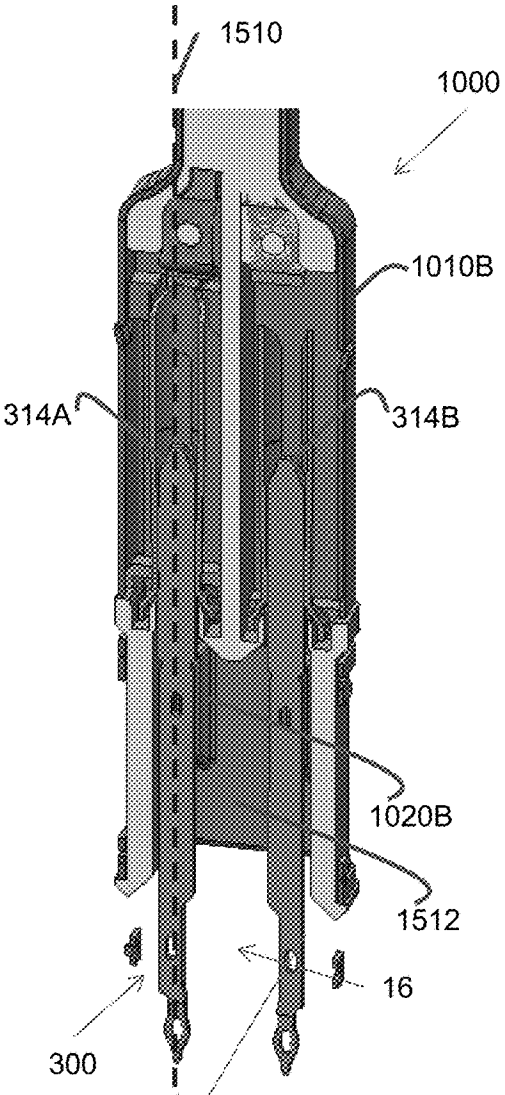
FIG. 15A is a cross sectional view of a wafer module, as shown in FIG. 8, mated to a pin assembly, as shown in FIG. 3, with insulative portions of the pin assembly cut away and no separation between the mating components.

Turning to FIGS. 15A-15C, further details are shown of the manner in which impedance may be controlled, despite deviations in mating positions of the mating connectors relative to a nominal mating position. In FIGS. 15A-15C, some connector components are omitted or partially cut away to reveal multiple techniques used to provide impedance control across the functional mating range of the connector. In this embodiment, the shape of both the conductive elements and the dielectric members impacts the impedance in the mating region.

FIG. 15A shows the mating interface region when a pin module 300 is mated to a wafer module 1000. As can be readily understood from the figure, module 1000 comprises a cavity 1512 adapted to receive a portion of the pin module 300. To reveal internal structural components, reference conductor 1010A of module 1000 is not shown. Portions of the pin module 300 are also not shown such that the signal conductors 314A and 314B are visible. The positioning of projection 1020B of the reference conductor 1010B relative to signal conductor 314A is visible in FIG. 15A. Projection 1020B is disposed approximately the same distance from the axis 1510 (in a direction perpendicular to the axis) of signal conductor 314A as reference conductor 320B. A corresponding projection 1020A on a reference conductor 1010A (not visible in FIG. 15A) is separated by approximately the same distance from signal conductor 314A. The same spacing is provided between signal conductor 314B and projection 1020B. Similar projections 1022A and 1022B are positioned symmetrically around signal conductors 314A and 314B.

FIG. 15A shows modules 300 and 1000 pressed together, representing the nominal mating position of those modules. In this position, though not visible in FIG. 15A, reference conductors 320A and 320B of pin module 300 will be closer to signal conductors 314A and 314B than projections 1020A and 1020B and projections 1022A and 1022B. Accordingly, in the portions of the mating interface adjacent to those projections, the impedance along the signal conductors 314A and 314B will be determined, in part, by the separation, in a direction perpendicular to axis 1510, between the signal conductors 314A and 314B and the reference conductors 320A and 320B of pin module 300.

Figure 16B:
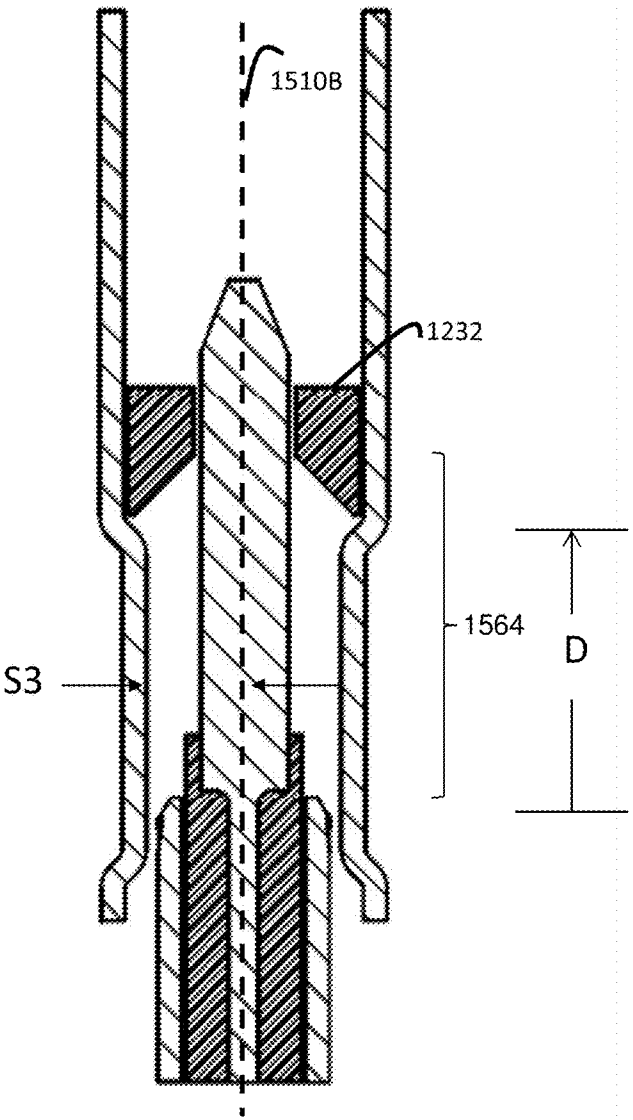
FIG. 16B is a side, cross sectional view through a plane of a wafer module, as shown in FIG. 8, mated to a pin assembly, as shown in FIG. 3, with separation between the mating components.
Figure 16A:
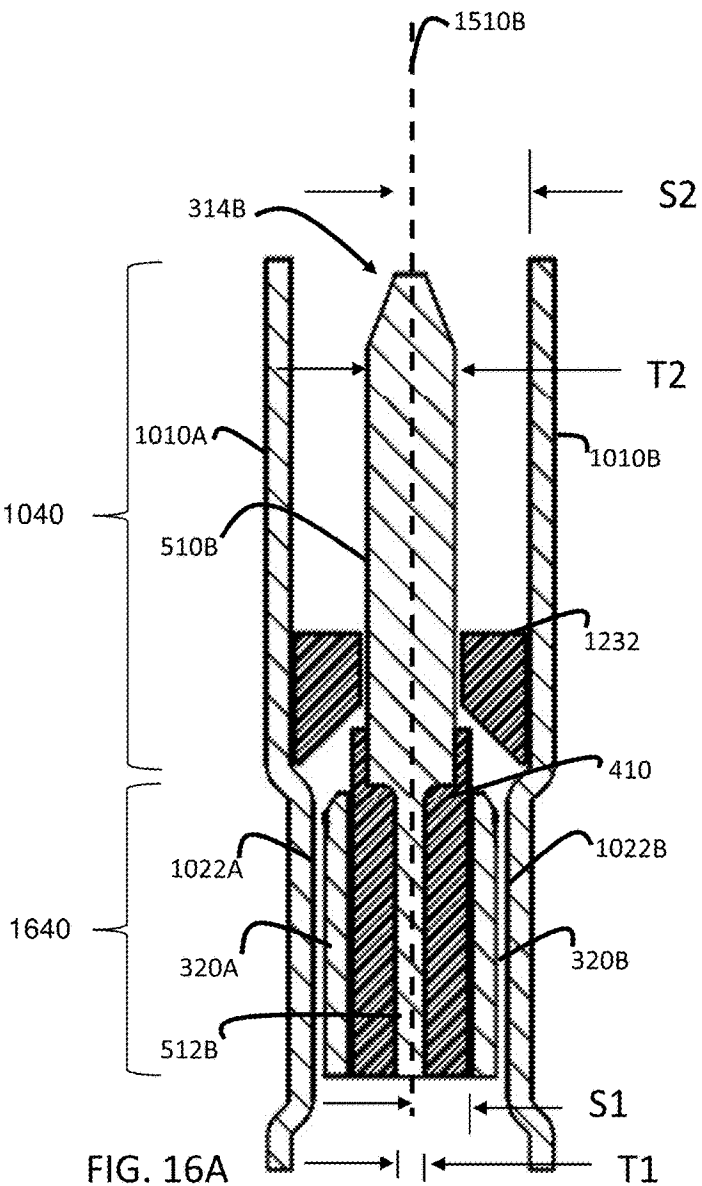
FIG. 16A is a side, cross sectional view through a plane of a wafer module, as shown in FIG. 8, mated to a pin assembly, as shown in FIG. 3, with no separation between the mating components.

FIG. 16A shows a cross section through the mated modules in a direction illustrated by the line 16-16 in FIG. 15A. In FIG. 16A, intermediate portion 512B is shown positioned between reference conductors 320A and 320B. Separation S1, between intermediate portion 512B and reference conductor 320A and 320B, is shown in FIG. 16A. Projections 1022A and 1022B are outside of the reference conductors 320A and 320B, but have surfaces that are at approximately separation S1. In the embodiment illustrated, projections 1022A and 1022B do not contact reference conductors 320A and 320B, which enables relative motion of these components during mating and un-mating.

Projections 1022A and 1022B may nonetheless be electrically connected to reference conductors 320A and 320B. Electrical connection may be made through compliant members or in any other suitable way. For example, compliant members 322 (FIG. 4, not shown in FIG. 16A) may make such contact.

FIG. 15B shows the mating contact portions of modules 300 and 1000. The mating contact portions 510A and 510B of the signal conductors in pin module 300 are shown inserted into module 1000 such that they engage the mating contact portions 1318A and 1318B of the signal conductors in module 1000. In the illustrated embodiment, mating contact portions 510A and 510B are round, such as pins. The tubular beams, such as 1420 and 1422 wrap around and contact mating contact portions 510A and 510B. In region 1040, the signals travel along paths dictated by mating contact portions 1318A and 1318B or mating contact portions 510A and 510B. Each of the mating contacts is approximately the same distance from adjacent reference conductors, which in this example are reference conductors 1010A and 1010B of module 1000. This separation is impacted by the position of the reference conductors relative to the axis of the signal conductor, designated S2 (FIG. 16A) in region 1040. This distance S2 determines, in part, the impedance of the signal conductors in region 1040.

Other parameters may also impact impedance in this region, including the thickness of intermediate portions 512A and 512B, separation between intermediate portions 512A and 512B and width of intermediate portions 512A and 512B. The effective dielectric constant of the material surrounding the signal conductors may also impact the impedance. In some embodiments, these parameters may be set to provide a desired nominal impedance to signal conductors within region 1040. That nominal impedance may be any suitable value, but may be selected to match impedance of a printed circuit board to which the connector is to be attached.

In region 1040, these connector design parameters that affect impedance are substantially independent of the separation between modules 300 and 1000. Because mating contacts 510A and 510B fit inside mating contacts 1318A and 1318B, the separation between the signal conductors and the closest reference conductor will be dictated by the shape and position of mating contacts 1318A and 1318B. Inserting mating contacts 510A and 510B further or a shorter distance into mating contacts 1318A and 1318B does not change the distance S2. Rather, the amount of insertion only changes the location on mating contacts 510A and 510B at which the signal conductors make contact, which does not have a material impact on impedance. Therefore within region 1040, the impedance is substantially independent of the separation between modules 300 and 1000.

Pin module 300 similarly includes a region 340 in which the impedance of the signal path is independent of the separation between modules 300 and 1000. In region 340, the impedance is determined by parameters of pin module 300. Because parameters of mating module 1000 do not have a substantial impact on the impedance, the impedance in region 340 is independent of the separation between modules 300 and 1000. Rather, the shape and separation between portions 514A and 514B as well as separation between portions 514A and 514B and reference conductors 320A and 320B all contribute to the impedance in region 340. Values of these parameters may be selected to provide a desired or nominal impedance. In some embodiments, the desired or nominal impedance may match that in region 1040.

However, as shown by a comparison of FIG. 15B and FIG. 15C, as well as a comparison of FIGS. 16A and 16B, in region 1542, values of parameters that might impact impedance on the signal conductors may depend on the position of module 300 with respect to module 1000. In region 1542, impedance is impacted by position of components in one of the modules with respect to the other module. For example, in at least portions of region 1542, the closest reference conductors to the signal conductors 314A and 314B in pin module 300 are reference conductors 1010A and 1010B from module 1000. Additionally, in some portions of region 1542, dielectric material that is attached to module 1000 is in an impedance affecting position with respect to conductive elements 314A and 314B. In the embodiment illustrated, dielectric material is in an impedance affecting position when it dictates, at least in part, the relative dielectric constant between the signal conductors 314A and 314B or the relative dielectric constant between either of the signal conductors 314A or 314B and a closest reference conductor, for at least some positions of the modules 300 and 1000 in the functional working range of the connector.

For example, projections 1042A and 1042B are in an impedance affecting position because they are between one of the signal conductors and a closest reference conductor. For example, projection 1042A is between signal conductor 314A and the reference conductors formed by the combination of reference conductors 1010A and 1010B (not shown in FIGS. 15B and 15C). It can be seen from a comparison of FIGS. 15B and 15C that projections 1042A and 1042B impact impedance in multiple ways.

FIG. 15B shows modules 300 and 1000 in a nominal mating position. In this configuration, the dielectric portions, such as platform 1232, are adjacent insulative member 410 of module 300. In this nominal mating position, these dielectric portions are designed to press against one another or to be separated by such a small distance that they do not have a significant impact on impedance of the signal conductors. In this nominal mating position, projections 1042A and 1042B extend along sides of insulative member 410, occupying space between intermediate portions of signal conductors 314A and 314B and the reference conductors 1010A and 1010B (not shown in FIG. 15B). This position of projections 1042A and 1042B in the fully mated position impacts the relative dielectric constant of material surrounding intermediate portions 512A and 512B of signal conductors 314A and 314B, which may be used in computing values of other parameters (such as width or thickness of the signal conductors, separation between signal conductors or separation between signal conductors and reference conductors).

As shown in FIG. 15C, when modules 300 and 1000 are separated by less than the functional working range of the connector, a sub-region 1562 appears. This sub-region is formed by separation, in the direction labeled X, of modules 300 and 1000. That separation means that portions of intermediate portions 512A and 512B are separated from an adjacent reference conductor by air rather than dielectric material of projections 1042A and 1042B. As a result, the relative dielectric constant surrounding those signal conductors has decreased in sub-region 1562, which will increase the impedance in that sub-region 1562.

The length of that sub-region 1562 may depend on separation between modules 300 and 1000. Projections 1042A and 1042B may be on the order of the functional working range of the connector such that, in some operating states of the connector, sub-region 1562 may have a length on the order of the functional working range.

While potentially increasing impedance over such a large distance may be counter to a desire to provide a connector that provides an impedance that is independent of separation of modules 300 and 1000, projections 1042A and 1042B provide a compensating advantage of distributing the change of impedance over a longer distance. Because gradual changes in impedance provide less impact on signal integrity than abrupt changes of the same magnitude, distributing the impedance change over a longer distance has less impact on signal integrity.

Moreover, projections 1042A and 1042B, in the embodiment illustrated, are configured to reduce the increase in impedance that might otherwise occur in sub-region 1564 as a result of separation between modules 300 and 1000. Sub-region 1564, shown in FIG. 15C, includes the portions of mating contact portions 510A and 510B, that extend from insulative member 410, that are not within mating contact portions 1318A and 1318B. In the embodiment shown in FIG. 15B, when modules 300 and 1000 are in the nominal mating position, little or none of mating contact portions 510A and 510B is outside mating contact portions 1318A and 1318B in region 1040. Accordingly, the impedance along mating contact portions 510A and 510B is dictated by the impedance of region 1040. As described above, values of multiple connector parameters in region 1040 may be selected to provide a desired impedance in region 1040, which is not impacted by separation of modules 300 and 1000.

However, as the separation between modules 300 and 1000 increases, larger portions of mating contact portions 510A and 510B extending from insulative member 410 are outside region 1040. With this separation, air that might otherwise surround portions of mating contact portions 510A and 510B extending from insulative member 410 is displaced by projections 1042A and 1042B. As shown, these projections occupy a portion of the space between mating contact portions 510A and 510B and adjacent reference conductors 1010A and 1010B (not shown in FIGS. 15B and 15C). Moreover, because, in the embodiment illustrated, projections 1042A and 1042B have a length on the order of the functional mating range, these projections will be adjacent mating contact portions 510A and 510B regardless of separation.

FIGS. 17A-17D to FIGS. 18A-18D illustrate schematically how the shape and position of extending insulative portions can reduce the impact of changes in impedance caused by separation of the connectors when mated. Comparison of FIGS. 17A-17D to FIGS. 18A-18D in combination with FIGS. 19A-19C illustrate how positioning of dielectric material may decrease the magnitude and/or impact of impedance change across the mating region as a function of separation of mating modules. FIGS. 17A-17D illustrate a connector without dielectric portions from one connector module in an impedance affecting position in a mating module. Connector modules 1710 and 1720 are shown schematically with flat, opposing mating interface surfaces. It should be appreciated, however, that the mating face of a connector may not be flat as illustrated. A mating face of a connector, for example, may include gathering features that aid in guiding mating contacts from a mating connector into cavities of the connector. Alternatively or additionally, a connector may include alignment features or polarizing features that aid in aligning the mating connectors or ensuring that only connectors that are designed to mate can mate. Also, it should be recognized that connector modules will include conductive elements, which are not illustrated for simplicity.

Figure 17A:
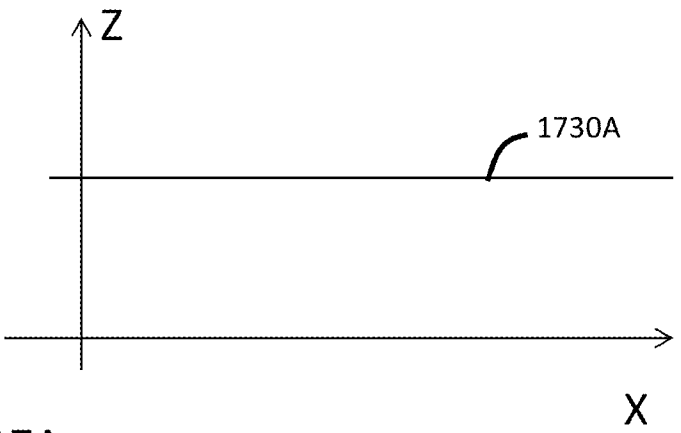
FIG. 17A is a plot showing impedance as a function of distance through a mating region of two electrical connectors with non-overlapping dielectric portions at no separation.

FIG. 17A shows modules 1710 and 1720 butted against each other. A signal path through modules 1710 and 1720 can be designed to have a generally uniform impedance through the mating region illustrated in FIG. 17A, because the relative positioning of the signal conductors, reference conductors and dielectric material is fixed within each module. Each of modules 1710 and 1720 may be designed with the same nominal impedance, such that the impedance of a signal path through modules 1710 and 1720 may be represented by plot 1730A.

Plot 1730A shows impedance as a function of distance X through the mating region of the connectors. Plot 1730A is an idealized impedance plot, discounting the effects of impedance discontinuities associated with compliant members that provide for mating between the conductive elements in modules 1710 and 1720 or other impedance artifacts. However, it shows a uniform impedance through modules 1710 and 1720.

Figure 17B:
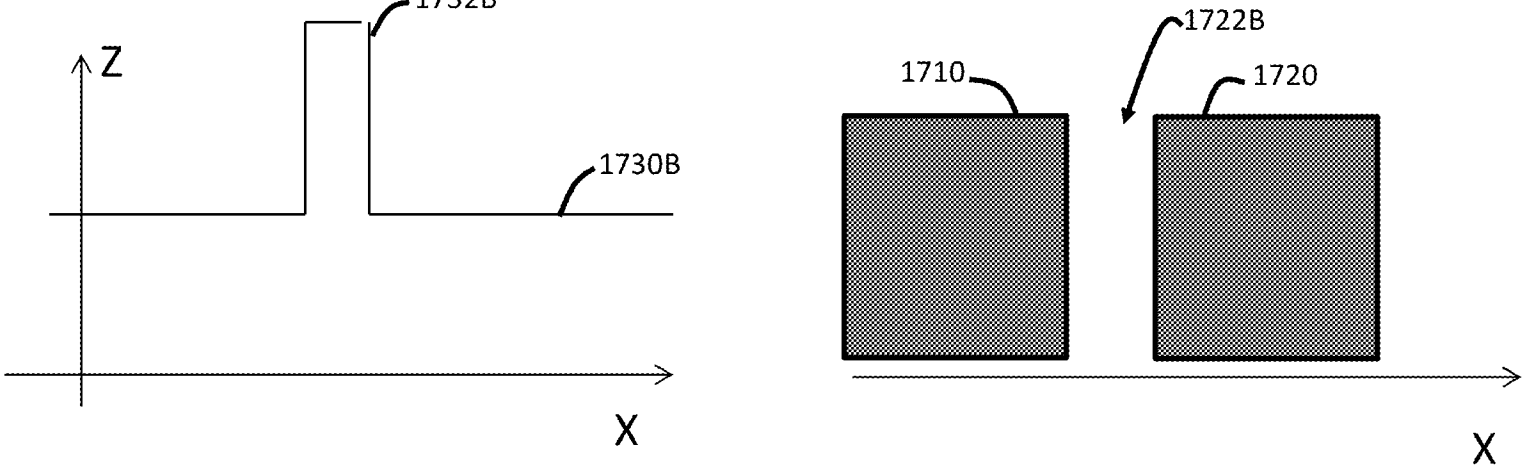
FIG. 17B is a plot showing impedance as a function of distance through a mating region of two electrical connectors with non-overlapping dielectric portions at a first amount of separation.

FIG. 17B shows the same modules 1710 and 1720 when slightly de-mated. The modules are separated by less than the functional mating range such that electrical contact may nonetheless be made between conductive elements in the modules, allowing a signal path to exist through those two modules. Plot 1730B is also an idealized plot of this impedance across the mating region of the connectors, highlighting the variation in impedance caused by separation of the connectors.

Plot 1730B, at each end, shows an impedance approximately equal to the uniform impedance of plot 1730A. This impedance reflects that, within each of the modules, the impedance of the signal path is dictated by values of structural parameters such as width and thickness of the signal conductors and separation between the signal conductors and a nearest reference conductor in the same module. Other parameters include the effective dielectric constant of the material separating the signal conductors and reference conductors. For signal conductors carrying differential signals, these parameters may also include the separation between signal conductors of a pair and the effective dielectric constant between the signal conductors of a pair. The values of these parameters do not depend on separation of the connector modules such that the impedance through these portions of the connector is the same regardless of separation.

The separation between modules does, however, create a sub-region in which the relative dielectric constant, rather than being dictated by the dielectric constant of the material of the connector, is dictated by the dielectric constant of the air filling the space 1722B between modules 1710 and 1720. When the separation is less than the functional mating range of the connector, there will still be an electrical connection between the conductive elements in modules 1710 and 1720 such that a signal path is formed through space 1722B. Because the relative dielectric constant is lower in this region than within modules 1710 and 1720, the impedance is higher, as shown by spike 1732B in plot 1730B. For very high frequency signals, spike 1732B may impact signal integrity.

Figure 17C:
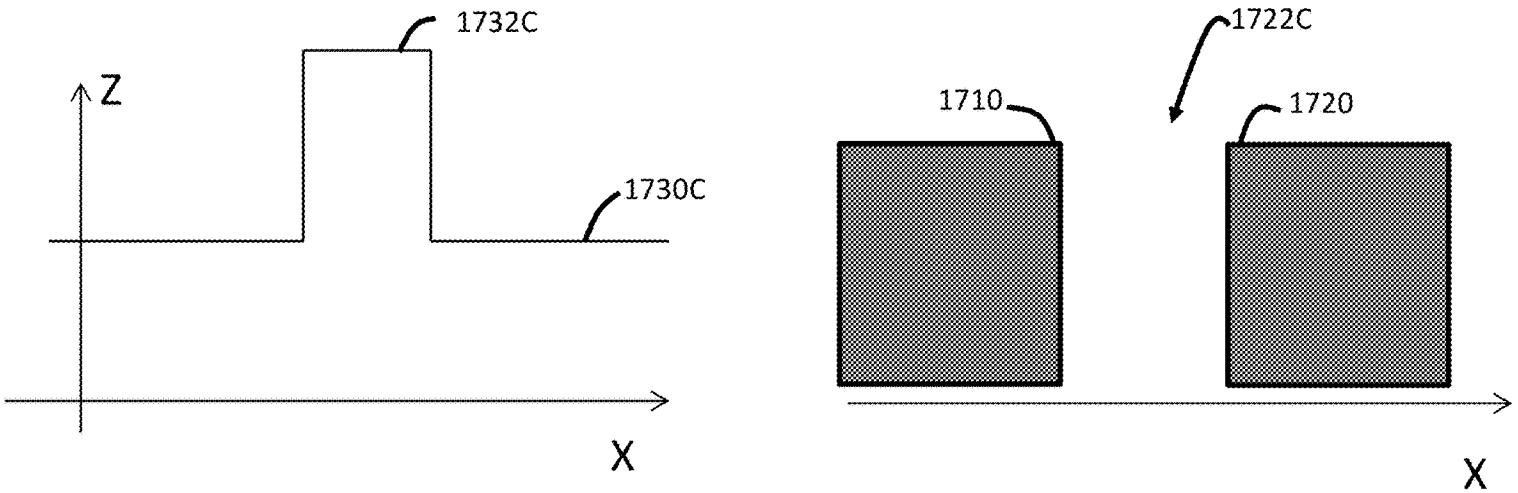
FIG. 17C is a plot showing impedance as a function of distance through a mating region of two electrical connectors with non-overlapping dielectric portions at a second amount of separation.

FIG. 17C shows modules 1710 and 1720 with a larger space 1722C. As can be seen in plot 1730C, that spike has the same magnitude as spike 1732B. However, that higher impedance exists over a larger distance in the mating region.

Figure 17D:
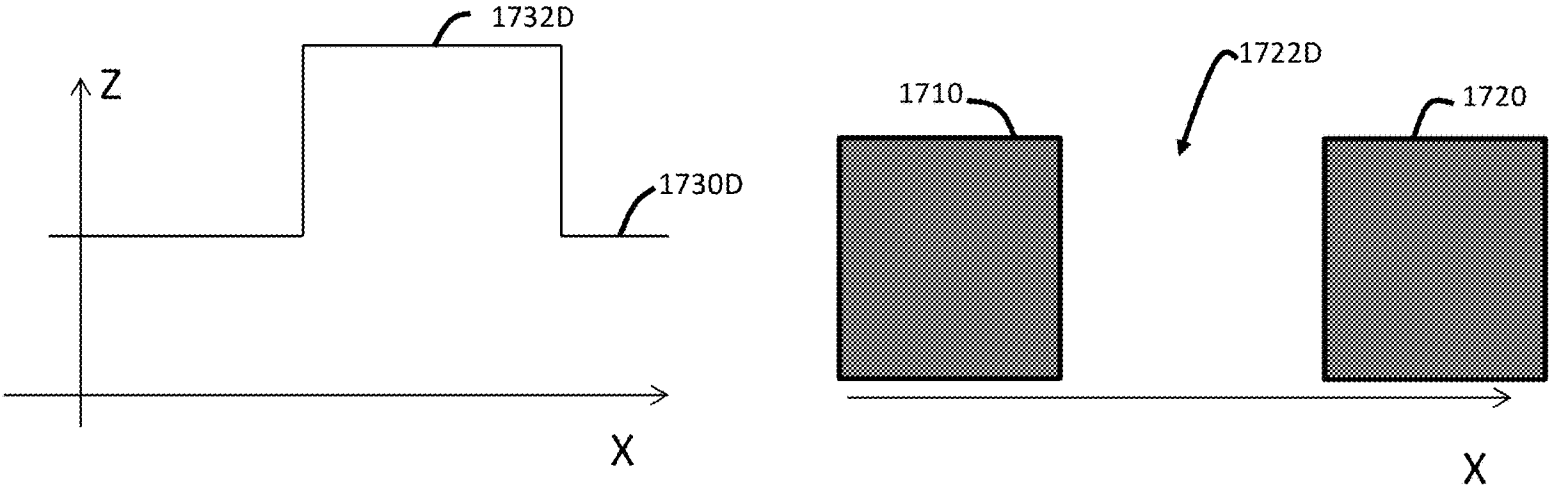
FIG. 17D is a plot showing impedance as a function of distance through a mating region of two electrical connectors with non-overlapping dielectric portions at a third amount of separation.

This pattern continues in FIG. 17D. A larger space 1722D leads to an impedance spike 1732D in plot 1730D with the same magnitude as spike 1732B, but that exists over a larger distance. This spike in impedance may exist over a distance that is as large as the functional mating range of the connector, and the connector should still meet connector specifications.

The inventors have recognized and appreciated, however, that the impact of an impedance spike on signal integrity may depend on the distance over which that impedance spike exists. Moreover, the magnitude of the impedance spike may depend on the frequency of the signals passing through the connector. Higher frequencies may lead to lager magnitude changes in impedance. Thus, impedance spikes as illustrated in FIGS. 17B-17D may be disruptive for very high frequency connectors.

FIGS. 18A-18D illustrate how positioning dielectric portions from one module in an impedance affecting position with respect to a mating module may reduce either the magnitude or impact of an impedance change associated with separation of the connector modules. As shown module 1810 has an opening into which portions of module 1820 may extend. In the embodiment illustrated, module 1820 extends beyond the nominal mating face 1812 of the modules into a portion of module 1810. As in FIGS. 17A-17D, the impedance along a signal path through modules 1810 and 1820 depends on the effective dielectric constant of the material adjacent the conductive elements forming that signal path. In this case, for the configurations shown, the effective dielectric constant depends on the amount of overlap of portions of module 1810 and 1820. For example, at the nominal mating interface 1812, the modules have complementary shapes that overlap such that the amount of dielectric material is approximately the same as in FIG. 17A. Moreover, this amount of dielectric material is present at all points through the mating region. As a result, the impedance through the mating region, as shown by plot 1830A is substantially uniform and substantially the same as the impedance shown by plot 1730A.

Figure 18A:
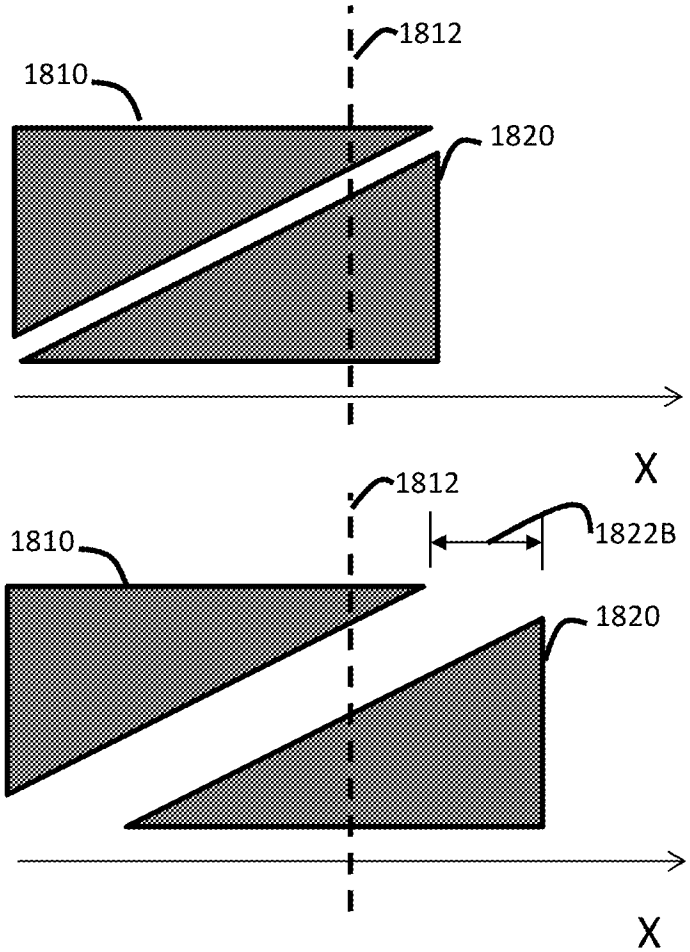
FIG. 18A is a plot showing impedance as a function of distance through a mating region of two electrical connectors with overlapping dielectric portions at no separation.
Figure 18A:
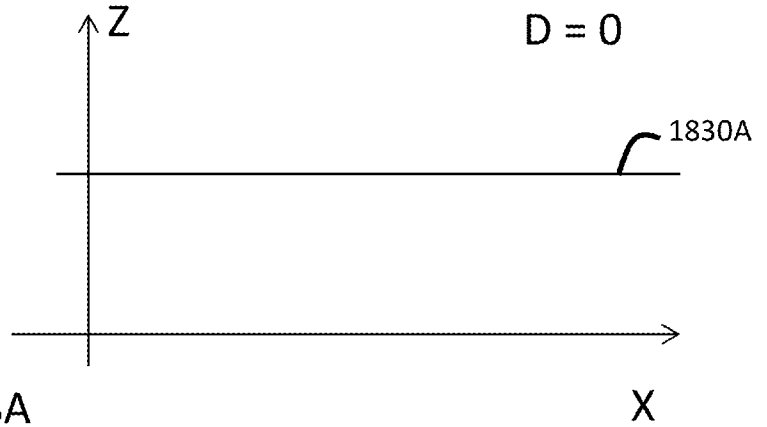
Figure 18B:
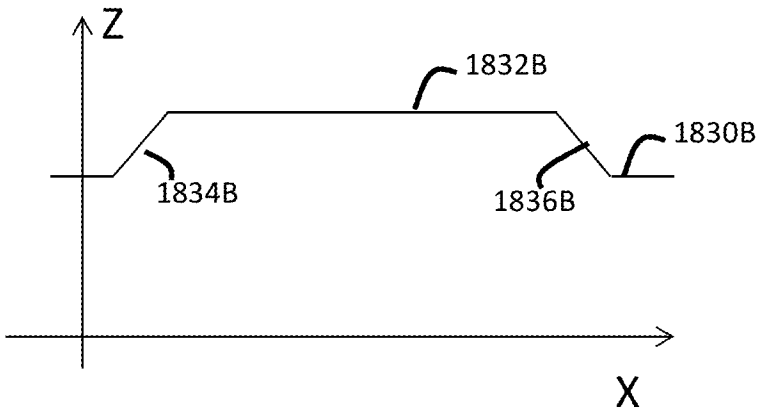
FIG. 18B is a plot showing impedance as a function of distance through a mating region of two electrical connectors with overlapping dielectric portions at a first amount of separation.
Figures 19A, 19B, 19C:
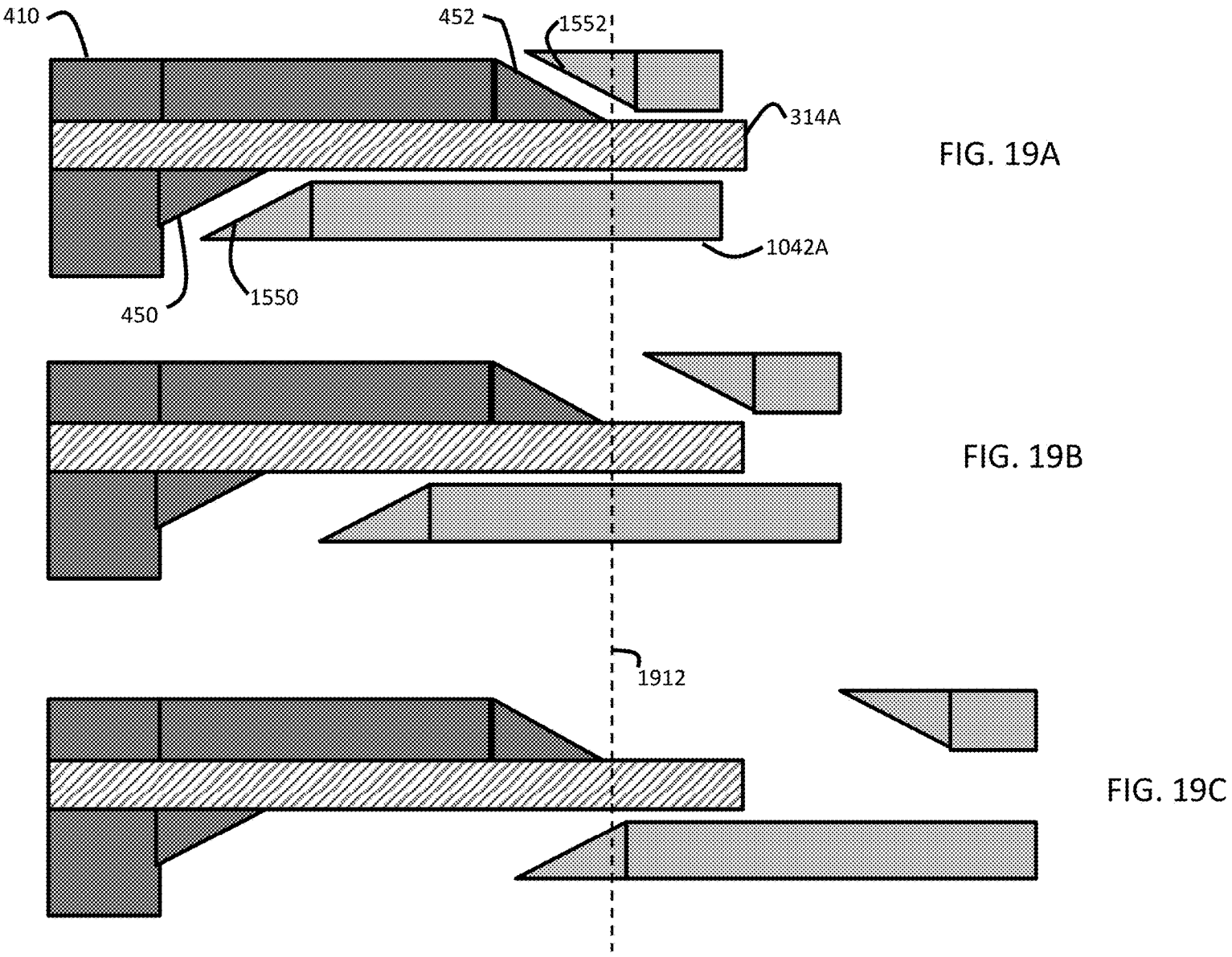
FIG. 19A is a schematic illustration of a mating region of two electrical connectors with overlapping dielectric portions at a first amount of separation.
FIG. 19B is a schematic illustration of a mating region of two electrical connectors with overlapping dielectric portions at a second amount of separation.
FIG. 19C is a schematic illustration of a mating region of two electrical connectors with overlapping dielectric portions at a third amount of separation.

FIG. 18B shows a space 1822B between modules 1810 and 1820. At multiple points along the mating region, such as at the nominal mating interface 1812, the effective dielectric constant of material adjacent a signal path will reflect an average of the dielectric constant of modules 1810 and 1820 as well as the air between those modules as a result of space 1822B. The effect on impedance of space 1822B is shown in plot 1830B.

As shown, the impedance at each end of the plot is at the same level as the baseline shown in plot 1830A. This impedance corresponds to an amount of dielectric material adjacent the signal conductors that occupies the space adjacent the signal conductors. However, as a result of space 1822B, though modules 1810 and 1820 overlap, the overlapping dielectric materials do not fully occupy the impedance affecting positions. Rather, air introduced as a result of space 1822B lowers the effective dielectric constant, thereby raising the impedance.

Space 1822B is on the same order as space 1722B. However, by comparison of FIGS. 18B and 17B, it can be seen that the impact of that space is less in FIG. 18B. First, a dielectric portion of at least one of modules 1810 and 1820 is in an impedance affecting relationship with the signal conductor at all locations across the mating region, and there is no location at which the effective dielectric constant is solely dictated by the air. As a result, the magnitude of the increase in impedance is less in FIG. 18B than in 17B. Second, there is no abrupt change in impedance in plot 18230B. To the contrary, plot 1830B includes more gradual transitions 1834B and 1836B, increasing and decreasing to and from plateau 1832B. The gradual transition provides less reflections than an abrupt change of the same magnitude, further reducing the impact of the impedance change associated with space 1822B.

Figure 18C:
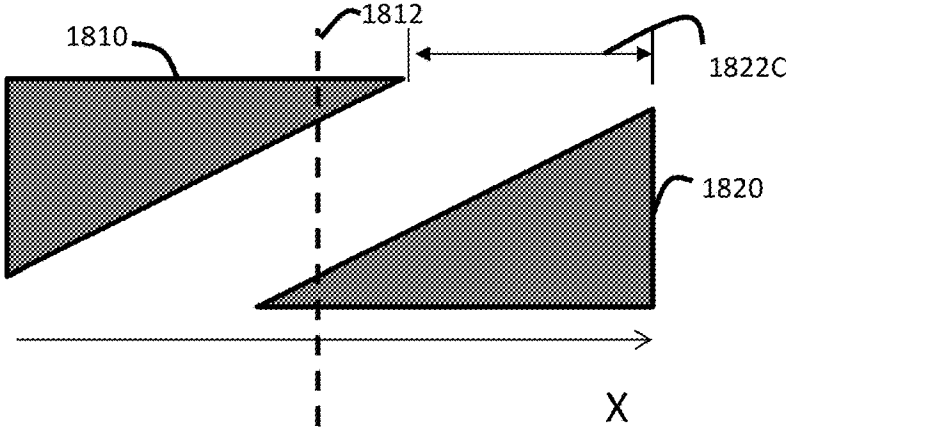
FIG. 18C is a plot showing impedance as a function of distance through a mating region of two electrical connectors with overlapping dielectric portions at a second amount of separation.
Figure 18C:
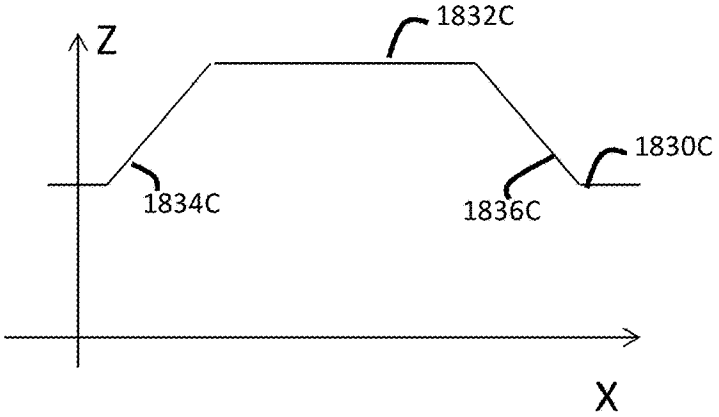
Figure 18D:
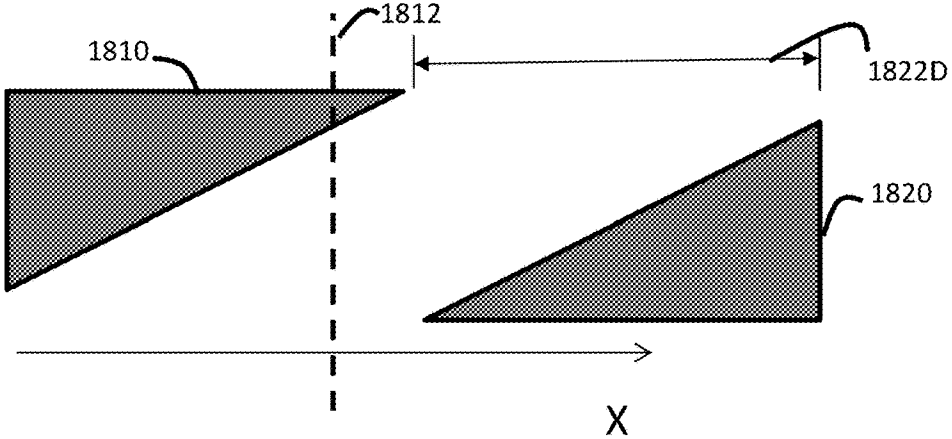
FIG. 18D is a plot showing impedance as a function of distance through a mating region of two electrical connectors with overlapping dielectric portions at a third amount of separation.
Figure 18D:
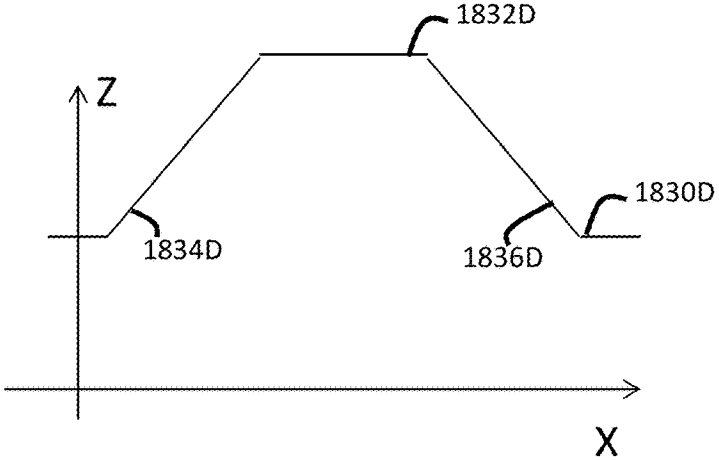

A similar pattern can be seen in FIGS. 18C and 18D. Space 1822C is larger than 1822B, resulting in a larger impedance at plateau 1832C than at 1832B. However, because modules 1810 and 1820 are shaped such that gradual transitions 1834C and 1836C distribute the change in impedance over a larger distance, similarly avoiding an abrupt transition in plot 1830C.

In FIG. 18D, modules 1810 and 1820 are fully separated by a space 1822D that exceeds the amount of overlap of modules 1810 and 1820. As a result, there is a portion of the mating region where there is all air, rather than dielectric material from either module 1810 or 1820. This region is reflected by plateau 1832D, which may represent a magnitude of impedance increase equal to the magnitude of impedance increase associated with spike 1732D. However, even with an increase in impedance of the same magnitude, the impact of that change is less because of the gradual transitions 1834D and 1836D.

As illustrated by FIGS. 18A-18D, overlapping insulative portions in impedance affecting positions may decrease the impact of separation between connectors. While the tapered shape of the modules shown in FIGS. 18A-18D facilitates gradual transitions, it is not a requirement that the modules have overlapping dielectric portions that are tapered or tapered over their entire lengths to achieve benefits. The benefits shown schematically in FIGS. 18A-18D are also achieved with projections, such as projection 1042A or 1042B. Comparison of FIGS. 17B-17D to FIGS. 18B-18D illustrate that techniques as disclosed herein may distribute a change in impedance across the mating interface. As seen in those figures, the impedance, at one end of the mating region, is equal to the impedance within the intermediate portions of the connector. In contrast to the abrupt increase and decrease of impedance illustrated in FIGS. 17B-17D, in FIGS. 18B-18D impedance increases monotonically across the mating region. The amount of increase depends on the amount of separation between the connectors, but regardless of the amount of increase, that increase is distributed across the mating region, providing a lesser impact on high frequency signals.

FIGS. 19A-19C illustrate, schematically, the configuration of dielectric portions adjacent signal conductor 314A when modules 300 and 1000 have varying degrees of separation. In the embodiment illustrated, the interfaces between modules 300 and 1000 occur at complementary tapered surfaces. FIG. 19A, for example, illustrates complementary tapered surfaces 452 and 1552. Likewise, other interface surfaces are tapered and complementary, such as tapered surfaces 450 and 1550.

While the tapers 450 and 1550 and 452 and 1552 do not extend over the full mating range, they can lessen the impact of impedance discontinuities associated with separation of the connector modules, by providing gradual transitions in the same way as in FIGS. 18B-18D.

Further, projection 1042A, in the illustrated embodiment, has a length that is comparable to the functional mating range. Regardless of the separation between module 300 and 1000 (e.g., even when separated by the full functional mating range), projection 1042A will be adjacent signal conductor 314A. In this way, even when modules 300 and 1000 are separated by the full mating range, there is no portion of signal conductor 314A that is fully surrounded by air. This makes the effective dielectric constant of material in an impedance affection position for signal conductor 314A more uniform, and more similar to the effective dielectric constant of regions 1040 and 340 (FIG. 15C). Therefore, changes of impedance across region 1542 are less than in a conventional connector in which dielectric members from mating connectors do not overlap and impact signal integrity less.

The construction of the reference conductors may also provide a desired impedance profile as a function of separation of modules 300 and 1000. Projections 1020A, 1020B, 1022A and 1022B, for example, may be shaped and position to provide a more uniform impedance across region 1542. In some embodiments, projections 1020A, 1020B, 1022A and 1022B may reduce the impedance in sub-region 1564, which, as shown in FIG. 17B may otherwise be higher than other sub-regions in the mating region. As a result, impedance discontinuities which might otherwise impact signal integrity are avoided. The way in which projections 1020A, 1020B, 1022A and 1022B achieve this effect may be seen by a comparison of FIGS. 16A and 16B.

FIG. 16A shows a single signal conductor 314B. In the embodiment illustrated, signal conductor 314B forms a pair with signal conductor 314A. For simplicity of illustration, only signal conductor 314B is illustrated, but it should be appreciated that structures comparable to those described in connection with signal conductor 314B may also be provided adjacent signal conductor 314A. Inclusion of such structures may provide a balanced electrical pair, which may be desirable in some embodiments.

In the nominal mating position of modules 300 and 1000 shown in FIG. 16A, the signal path travels through region 1040 and region 1640. In region 1040, the impedance is dictated by the structures in module 1000. Though mating contact 510B extends from module 300 into region 1040 in module 1000, it is contained within mating contact 1318B, and thus does not impact impedance along the signal path. Similarly, in region 1640, ignoring the impact of projections 1042A and 1042B which are discussed separately above, the impedance is dictated by structures in module 300.

In region 1040, for example, the impedance is dictated by dimensions such as T2, representing the thickness of the signal conductor in that region and S2, representing separation between the signal conductor and the nearest reference conductor. Though not visible in the view of FIG. 16A, in region 1040 mating contact portion 510 B is surrounded by mating contact 1318B. As a result, the effective separation between mating contact portion 510 B and adjacent reference conductors may be smaller than the spacing visible in FIG. 16 A.

In region 1640, impedance is dictated by dimensions such as T1, representing the thickness of the signal conductor in that region and S1, representing the position of the reference conductor relative to the axis of the signal conductor. The values of these, and possibly other parameters, may be selected to provide an impedance that is substantially the same in regions 1040 and 1640, so as to provide a uniform impedance through the connector.

The dimensions are different in regions 1040 and 1640. However, at least in part because different combinations of materials are present in those regions, the impedance may nonetheless be substantially the same despite different dimensions. For example, region 1040 is predominantly filled with air while region 1640 is predominantly filled with insulative member 410. Moreover, the signal conductors are wider in region 1040 than in region 1640. In addition to the greater diameter of mating contact portion 510B relative to intermediate portion 512B, mating contact portion 1318B (not visible in the cross section of FIG. 16A) may surround mating contact portion 510B, making it effectively larger. For these reasons, S2 may be larger than S1, while still providing substantially the same impedance.

The dimensions established for regions 1040 and 1640 when modules 300 and 1000 are pressed together may not provide the same desired impedance in sub-region 1564, which forms when the modules are separated. For example, where the separation between modules is a distance D, as shown in FIG. 16B, a portion of mating contact portion 510B is outside of any mating contact portion within module 1000. The diameter of mating contact portion 510B is uniform over the functional mating range to allow mating contact portion 1318B to engage any location on mating contact portion 510B. As a result, if reference conductors 1010A and 1010B were separated from signal conductor axis 1510B by the same distance S2 that provides the desired impedance in region 1040, the impedance would be too high. Accordingly, reference conductors 1010A and 1010B are shaped to provide a separation S3, smaller than S2. In this embodiment, S3 is also larger than S1.

As shown, distance S3 is determined by projections 1022A and 1022B. The distance S3 equals S2, less the height of projections 1022A and 1022B. Accordingly, the distance S3 may be set independently of S2. Also, because projections 1022A and 1022B are not required to contact reference conductors 320A and 320B, the distance S3 may also be set independent of the distance S1. As shown, projections 1022A and 1022B extend along the entire length of sub-region 1564. In the illustrated embodiment, projections 1022A and 1022B have a length that approximates the functional mating range of modules 300 and 1000. As a result, so long as the modules are separated by less than the functional mating range, the position of projections 1022A and 1022B will define the separation between the mating contact portion 510B and the nearest reference conductor. Accordingly, the dimensions of projections 1022A and 1022B may be selected to control that portion of the impedance impacted by separation between the reference conductor and the signal conductor in sub-region 1564, and this impedance may be provided regardless of where in the functional mating range modules 300 and 1000 mate.

Turning now to FIGS. 20A-20D, a computer simulation illustrating the effects of appropriate selection of parameters associated with the reference conductors and ground conductors and selection of parameters associated with dielectric material are illustrated. These figures are time domain reflectometry (TDR) plots. A TDR transmits a pulse along a signal path and measures the time at which energy of that pulse, reflected at various points along the signal path, is received back at the transmitter. Because reflections arise from changes in impedance, the amount of energy reflected indicates a magnitude of an impedance change. The time at which the reflected energy is received indicates the distance along the signal path to the location where a specific impedance change occurred. Thus, plotting out received energy as a function of time, as in FIGS. 20A-20D, reveals impedance as a function of distance along the signal path. The received signals may be filtered such that the plots represent impedance at a particular frequency. In this example, the frequency is appropriate for a very high frequency signal, such as 60 Ghz.

Figure 20A:
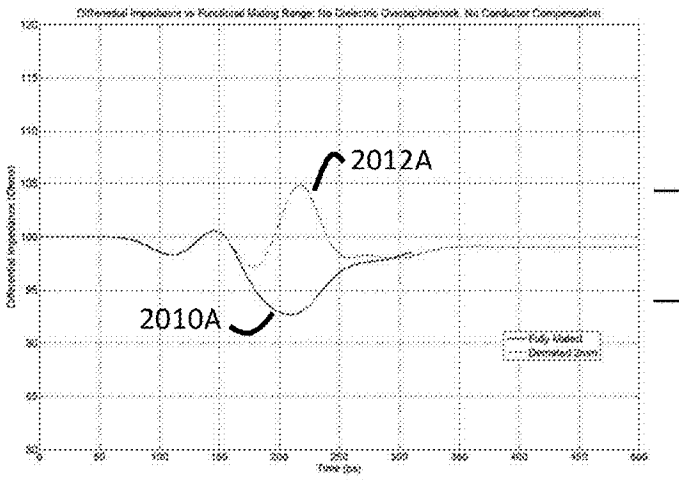
FIG. 20A shows simulated time domain reflectometry (TDR) plots of a reference two-piece connector, with the connector components fully pressed together and separated by the functional mating range of the connector.

In the simulation depicted in FIG. 20A, trace 2010A represents impedance along a signal path when the connector are fully pressed together. Trace 2012A represents the impedance when the connector is separated by its functional mating range. In the illustration, the functional mating range was 2 mm. Each trace shows some variation in impedance over the mating interface region. For example, the impedance dips in trace 2010A by approximately 7 Ohms, representing the impact of mating contact portions, such as mating contact portions 1318A and 1318B, or other structures that, for mechanical or other reasons are not shaped to provide exactly the desired impedance. In contrast, the impedance spikes in trace 2012A by approximately 5 Ohms, representing the impact of air, rather than dielectric material, along a portion of the signal path when the connector is de-mated. In total, there may be a change in impedance, Z1, of approximately 12 Ohms in this example, between the fully mated and de-mated position.

Figure 20B:
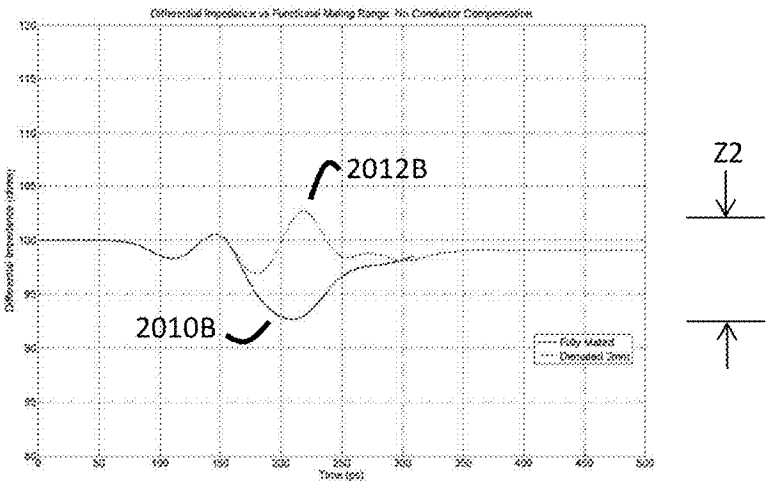
FIG. 20B shows simulated TDR plots for the reference two-piece connector of FIG. 20A modified to include tapered dielectric portions as illustrated in FIGS. 19A-19C, with the connector components fully pressed together and separated by the functional mating range of the connector.
Figure 20C:
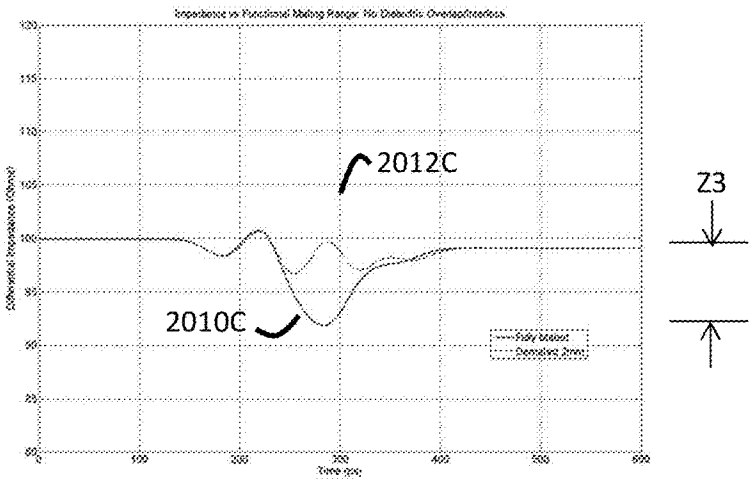
FIG. 20C shows simulated TDR plots for the reference two-piece connector of FIG. 20A modified to include conductive elements with positions and widths, as illustrated in FIGS. 16A and 16B, with the connector components fully pressed together and separated by the functional mating range of the connector.
Figure 20D:
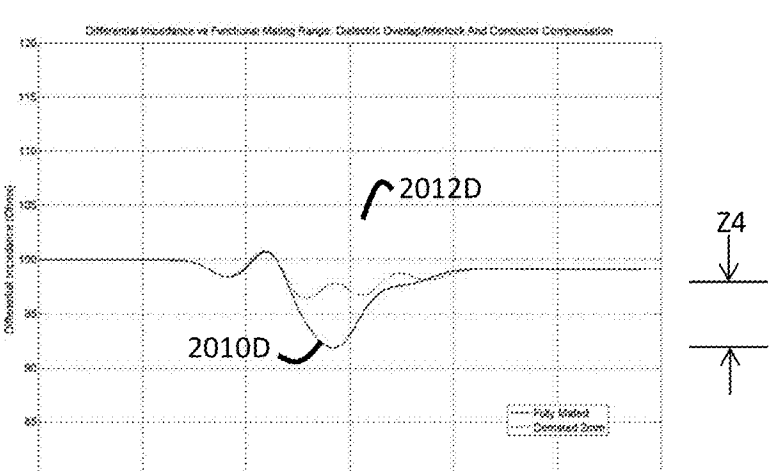
FIG. 20D shows simulated TDR plots for the reference two-piece connector of FIG. 20A modified to include both tapered dielectric components as in FIG. 20B and conductive elements with positions and widths as in FIG. 20C, with the connector components fully pressed together and separated by the functional mating range of the connector.

FIGS. 20B-20D show the same type of TDR plot with the connector model of FIG. 20A adjusted to include an impedance compensation technique. In FIG. 20B, the impedance compensation technique includes dielectric members that project from one connector to the mating connector. This technique may be implemented, for example, by projections 1042A and 1042B.

Trace 2010B in FIG. 20B illustrates impedance along the signal path when the connectors are fully pressed together. Accordingly, trace 2010B looks similar to trace 2010A. Trace 2012B represents the connector de-mated by the same distance that was used in making trace 2012A, and represents the maximum demating distance for which the connector is still within the functional mating range. Trace 2012B similarly shows an increase in impedance associated with air adjacent signal conductor portions de-mate that were adjacent higher relative dielectric constant material in the fully mated position. The increase in impedance on trace 2012B is less than on 2012A, revealing the impact of projections 1042A and 1042B by reducing the amount of air adjacent the signal conductors relative to the baseline configuration represented in FIG. 20A. In this case, the change of impedance, Z2, is between 9 and 10 Ohms, which is approximately 20% less than in the baseline.

FIG. 20C is a TDR plot when the baseline model of FIG. 20A is modified to include conductive elements, as shown, for example, in FIG. 16B, in which signal conductor thickness and signal-to-reference conductor spacing is set to compensate for differences, relative to regions 1040 and 1640, in dielectric constant and conductor spacing in subregion 1564, which is formed when the connectors are partially de-mated. For example, projections 1020A, 1020B, 1022A and 1022B are included in this model.

Trace 2010C in FIG. 20C illustrates impedance along the signal path when the connectors are fully pressed together. Accordingly, trace 2010C looks similar to trace 2010A. Trace 2012C represents the connector de-mated by the same distance that was used in making traces 2012A and 2012B. Trace 2012C similarly shows an increase impedance associated with different positions of the signal conductors and the reference conductors in the de-mated position relative to the fully mated position. The increase in impedance on trace 2012C is less than on 2012A, revealing the impact of projections 1020A, 1020B, 1022A and 1022B by reducing the change in relative positions of signal conductors and reference conductors relative to the baseline configuration represented in FIG. 20A. In this case, the change of impedance, Z3, is approximately 8 Ohms, which is approximately 33% less than in the baseline.

FIG. 20D is a TDR plot when the baseline model of FIG. 20A is modified to include both modifications of the dielectric structures, as represented in FIG. 20B and modifications of the structure of the conductive elements, as in FIG. 20C. FIGS. 20B and 20C illustrate that these techniques may advantageously be used separately. FIG. 20D illustrates that they may also be advantageously used together.

Trace 2010D in FIG. 20D illustrates impedance along the signal path when the connectors are fully pressed together. Accordingly, trace 2010D looks similar to trace 2010A. Trace 2012D represents the connector de-mated by the same distance that was used in making traces 2012A, 2012B and 2012C. Trace 2012D similarly shows an increase impedance associated with differences in values of impedance affecting parameters in region 1542, formed when the connector is partially de-mated, relative to the fully mated position. The increase in impedance on trace 2012D is less than on 2012A, revealing the impact of impedance compensation techniques that address changes in the values of impedance affecting parameters in region 1542 relative to regions 1040 and 1640. In this case, the change of impedance, Z4, between the fully mated and partially de-mated positions is approximately 6 Ohms, which is approximately 50% less than in the baseline.

The models used in generating FIGS. 20A-20D show a performance improvement. While a 50% improvement in impedance variability is significant, particularly for very high speed connectors, these examples are not intended to illustrate a limitation on the achievable performance improvement. Applying the design techniques revealed herein in combination with other optimization practices may provide an even greater reduction in impedance variation. In some embodiments, for example, the maximum difference in impedance between the fully mated and the position in which the connector is de-mated to the end of the functional mating range, may be greater than 50%, such as greater than 60%, 70% or 75%. In some embodiments, the difference in impedance may be in the range or 50-75% or 60-80%, for example.

Moreover, design techniques as described herein may result in a connector providing, in operation, predictable impedance for signal paths through a connector. A designer of an electronic system may design other portions of the system based on a nominal impedance of the connector. Deviations from this nominal impedance that occur in operation because the connector is not fully mated can impact the performance of the entire electronic system. Accordingly, it is desirable for the connector to provide an impedance that deviates as little as possible over specified operating conditions. In some embodiments, the deviation in impedance across the mating region, in either the fully mated or partially de-mated configuration, may be, in some embodiments, 3 Ohms or less at frequencies up to 60 GHz. In other embodiments, the change may be 4 Ohms or less or may 2 Ohms or less. In yet other embodiments, the deviation from the nominal impedance across the mating region may be in a range of 1-4 Ohms or 1-3 Ohms.

A further benefit may result from providing gradual changes in impedance. Gradual changes may have less of an impact on signal integrity than an abrupt change of similar magnitude. For example, the impact of impedance spikes may be lessened using techniques as described herein, providing, in some embodiments, no segment of the mating region of 0.5 mm in which the impedance changes more than 1 Ohm. In other embodiments, the change may be 2 Ohms or less or 0.5 Ohms or less. In other embodiments, the impedance change may be in the range of 0.5 to 2 Ohms or 0.1 to 1 Ohm.

It should be appreciated that other structures may be designed, according to the principles described herein, that provide impedance control. FIGS. 21A-21C illustrate an alternative design for conductive elements that also provides impedance control. In this embodiment, the mating contact portions of the signal conductors are cylindrical tubes. One connector has a tube of smaller diameter than the other connector such that the smaller tube fits inside the larger tube. Electrical contact between the tubes is ensured by outward projections on the smaller tube and/or inward projections on the larger tube. These projections may extend an amount greater than the difference in diameter between the larger and smaller tubes. Compliance to provide an adequate mating contact force may be generated at the mating contacts by having one or both of the tubes split. If the outer, larger tube is split, its diameter may increase slightly as the smaller tube is inserted, creating a spring force that provides a desirable mating contact force. Alternatively or additionally, if the inner, smaller tube is split, its diameter may be compressed as it is inserted into the larger tube, creating the required spring force.

FIGS. 21A-C illustrate in cross section the mating interface of a pair of signal conductors with mating contact portions shaped as tubes. FIG. 21B illustrates the pair, with the tubes shown side-by-side in the nominal mating position, which in the embodiment illustrated has the connectors fully pressed together. FIG. 21A is from the perspective of the line A-A in FIG. 21B, such that only the mating contact portion of one of the signal conductors of the pair is visible. FIG. 21C shows the same view as FIG. 21A, but with the connectors separated by the functional mating range.

Tubes 2118A and 2118B form a pair of mating contact portions for two conductive elements. The intermediate portions of those conductive elements are not visible, but they may be shaped as described above, or in any other suitable way. In the illustrated embodiment, tubes 2118A and 2118B may form a portion of a header designed for attachment to a backplane, like backplane connector 200 (FIG. 1). Those tubes may likewise be held in a conductive, lossy and/or dielectric housing.

Tubes 2138A and 2138B may form the mating contact portions of a mating connector such as daughtercard connector 600 (FIG. 1). Tubes 2138A and 2138B are attached to the ends of conductive elements 2136A and 2136B, respectively, which are held within a dielectric housing portion 2134.

In the embodiment illustrated, tubes 2138A and 2138B, are held at a proximal end within housing portion 2134. The rest of tubes 2138A and 2138B extend from housing portion 2134. As a result, the material surrounding both mating contact portions is air, which will define the effective dielectric constant in the impedance affecting positions for the mating contact portions of the pair, regardless of separation of the connectors.

The pairs of signal conductors in each connector are adjacent reference conductors. In some embodiments, each pair is surrounded by a reference conductor or combination of reference conductors. Pair of tubes 2118A and 2118B in the header, for example, may be surrounded by reference conductor 2110. Pair of tubes 2138A and 2138B is surrounded by reference conductor 2130. In the example illustrated, each reference conductor is indicated as a single structure. Such structures may be formed by rolling a sheet of metal into a tube or box or other suitable shape. In some embodiments, the ends of that sheet of metal may not be secured such that the dimensions of the structure may increase or decrease, which may provide compliance for mating. Alternatively or additionally, some or all of the structures may be formed from multiple pieces. For example, in the embodiment of FIG. 10, reference conductors 1010A and 1010B come together to form a structure surrounding a pair of signal conductors. Such a structure also may be used for contacts shaped as in FIGS. 21A-21C. Moreover, techniques as described for other embodiments, such as incorporating lossy material between reference conductors, may likewise be applied for conductive elements as shown in FIGS. 21A-21C.

To provide mating between conductive elements in mating connectors, tubes 2138A and 2138B fit within tubes 2118A and 2118B, respectively. Reference conductor 2110 fits within reference conductor 2130. To provide compliance between mating structures to ensure that a normal force is generated to provide sufficient contact force for reliable mating, these tubes and reference conductors may be split. For example, tubes 2138A and 2138B and tubes 2118A and 2118B may be formed by rolling sheets of conductive material into a tubular shape. The ends (not shown) of that material may be left unattached such that the ends may move to compress or expand the diameter of the tube.

Other techniques to provide compliance may alternatively or additionally be used. For example, portions of the reference conductors may be separated from the body of the reference conductor to be similarly compliant. In the embodiment illustrated, projections 2114 are provided on reference conductors 2110 for making electrical connection to reference conductors 2130 in a mating connector. Those projections may be formed adjacent one or more slits (not shown) cut in the body of reference conductor 2110. The slits may be arranged to separate the portion of the reference conductor 2110 carrying projection 2114 from the body of the reference conductor to form a cantilevered beam. Alternatively, the slits separating portions of the reference conductor may be sufficient to make the portion of the reference conductor containing the projection yieldable. Alternatively or additionally, compliant contact may be provided by yield of the projections 2114, themselves.

Regardless of the manner in which the projections have compliance, FIGS. 21A and 21C illustrate reference conductor 2110 inserted into reference conductor 2130. Projection 2114 presses against reference conductor 2130. In the cross section illustrated, two projections 2114 are visible. It should be appreciated that multiple projections, providing multiple points of contact, may be included but are not illustrated for simplicity. Some of all of these projections may be positioned to ensure contact regardless of the separation between connectors, so long as the connectors are pressed together enough to be within the functional mating range of the connector. For example, in an embodiment in which the functional mating range is 2 mm, region 2160 may be 2 mm long. Region 2160 represents the region of possible overlap of structures from mating connectors. In this example, it is the region in which reference conductors 2110 from one connector may be inserted into reference conductors 2130 of the other connector. As can be seen by comparison of FIGS. 21A and 21C, so long as the connectors are close enough together for projections 2114 to enter region 2160, contact between conductive elements in the mating connector may be formed. If the connectors are closer together, reference conductor 2110 will extend further into reference conductor 2130, but electrical connection will still be made.

Likewise, if connectors are close enough to be within the functional mating range, a tube forming the mating contact portion of a signal conductor for one connector will enter a tube forming the mating contact portion of a signal conductor in the other connector. For example, tube 2138B is shown entering tube 2118B, which serve as the mating contact portions. As with the reference conductors, projections and compliance may be provided to ensure sufficient mating force between the mating contact portions to provide a reliable connection. In the embodiment illustrated, tube 2138B has outwardly directed projections, and tube 2118B has inwardly directed projections. Moreover, one or both of the tubes may be formed by rolling a sheet of metal without securing the ends of the sheet such that the tube may be expended or compressed when tube 2138B is pressed into tube 2118B, generating compliance and a corresponding force for reliable mating.

In the embodiment illustrated, each of the tubes 2138B and 2118B has two projections, forming four points of contact between tubes 2138B and 2118B. Outwardly directed projections 2132 are formed on tube 2138B and inwardly directed projections 2112 are formed on tube 2118B. However, it should be appreciated that any suitable number of projections may be used to form any suitable number of contact points.

This configuration of mating contact portions and reference conductors provides a mating interface in which the impedance is largely independent of separation distance between the mating connectors. For example, in the configuration shown in FIG. 21A, in region 2160, the impedance is determined in large part by the separation between intermediate portions 2136A and 2136B and reference conductor 2110, which is only slightly smaller than separation to reference conductor 2130. The dielectric constant of insulative portion 2134 also impacts the impedance. Though there is a gap 2150 between reference conductor 2130 and insulative portion 2134, which introduces some air in an impedance affecting position, gap 2150 is relatively narrow such that the difference in dielectric constant between the air that fills the gap and the dielectric constant of insulative portion 2134 may have a negligible impact on impedance over the frequency range of interest. Gap 2150, for example, may be on the order of 0.2 mm or less. In some embodiments, gap 2150 may have a width on the order of 0.1 mm or less, and may, for example, be 10% or less than the width of insulative portion 2134.

When the connectors mate and a reference conductor 2110 enters gap 2150, the displacement of air from that gap may have only a negligible impact on the effective dielectric constant of the material separating intermediate portions 2136A and 2136B from reference conductor 2130. Thus, in the embodiment of FIGS. 21A-21C, changes in relative positioning of dielectric material resulting from mating connectors being partially de-mated rather than fully mated does not impact impedance in region 2160.

When reference conductor 2110 enters 2150, reference conductor 2110 is closer to intermediate portions 2136A and 2136B than reference conductor 2130 when the connectors are fully mated. However, the change in distance between intermediate portions 2136A and 2136B and a nearest reference conductor, as between a fully mated and partially de-mated position is relatively small as a percentage of that separation, such that any change in impedance between the fully mated and partially de-mated position is likewise small.

In region 2140, the impedance is dictated, in part, by the spacing between reference conductor 2110 and the signal conductors, such as signal conductor 2118B. As additionally, the dielectric constant of the material separating the signal conductors and the reference conductors may also impact the impedance in that region. In this embodiment, those conductors are separated by air. By comparing FIGS. 21A and 21C, it can be seen that these impedance affecting relationships are the same, regardless of whether the connectors are fully mated or partially de-mated. Accordingly, there is a negligible change of impedance in region 2140 between the fully mated and partially de-mated positions. Thus, in both regions 2140 and 2160, there is a relatively small change in impedance between the fully mated and partially de-mated positions. Values for the design parameters in these regions may be selected to provide an impedance that matches a desired value for the interconnection system. The impedance in both regions may be the same. However, this is not a requirement of the invention.

Region 2152, which forms between regions 2140 and 2160 in a partially de-mated position, may be designed to have an impedance that approximates the impedance in either or both of regions 2140 and 2160. In some embodiments, the impedance in region 2152 may be between the impedance in regions 2140 and 2160 in a partially de-mated position. That value, for example, may be intermediate the impedance in region 2140 and in region 2160, when the connectors are separated by the functional working range of the connector.

In the embodiment illustrated, such as in FIG. 21C, the impedance in region 2150 may be dictated in part by the spacing between mating contact portion 2138B of a signal conductor and reference conductor 2110. The dielectric separating these conductors is air, which may also impact the impedance. As shown, if the connectors are separated by less than the functional mating range, both mating contact portion 2138B and reference conductor 2110 extend fully across region 2152, regardless of the amount of separation between the connectors. The impedance affecting relationship between these conductive structures is thus preserved, independent of separation. Similarly, the dielectric in impedance affecting position with respect to these structures is air, regardless of separation. Accordingly, the impedance in region 2152 may be constant, regardless of separation between the connectors. Thus, across the three illustrated sub-regions of the mating region, the embodiment of FIGS. 21A-21C provides little or no changes in impedance, regardless of separation between connectors.

Although details of specific configurations of conductive elements, housings, and shield members are described above, it should be appreciated that such details are provided solely for purposes of illustration, as the concepts disclosed herein are capable of other manners of implementation. In that respect, various connector designs described herein may be used in any suitable combination, as aspects of the present disclosure are not limited to the particular combinations shown in the drawings.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, examples of techniques are described for improving signal quality at the mating interface of an electrical interconnection system. These techniques may be used alone or in any suitable combination. Furthermore, the size of a connector may be increased or decreased from what is shown. Also, it is possible that materials other than those expressly mentioned may be used to construct the connector. As another example, connectors with four differential signal pairs in a column are used for illustrative purposes only. Any desired number of signal conductors may be used in a connector.

Problems associated with changes in impedance across the mating interface region or deviations from a nominal or designed value as a function of separation of mating components may arise for many types of components that form a separable interface within an interconnection system. Separable connectors, such as those used to connect a daughtercard to a backplane in an electronic system, are used as an example of where this problem may arise. It should be appreciated, however, that use of connectors is exemplary rather than limiting of the invention. Similar techniques may be used with sockets, which may be mounted to a printed circuit board and form separable interfaces to components, such as semiconductor chips. Alternatively or additionally, these techniques may be applied where connectors, sockets or other components are attached to a printed circuit board. While such components are not intended to be separated from a printed circuit board during normal operation of an electronic system, separation of the components during operation is impacted by the relative positioning of the components that arise from their manufacture as separate components that are then brought together at an interface.

Manufacturing techniques may also be varied. For example, embodiments are described in which the daughtercard connector 600 is formed by organizing a plurality of wafers onto a stiffener. It may be possible that an equivalent structure may be formed by inserting a plurality of shield pieces and signal receptacles into a molded housing.

Further, changes of impedance between a fully mated position and a partially separated position of two mating components have been described. In some instances, that fully mated position has the housing of one component butted against the housing of the mating component. It should be appreciated that the principles described herein are applicable regardless of the designed separation between components in the designed mated position. For example, connector components may be designed to have a mated position in which the components are separated by 2 mm. If the separation is more or less, without techniques as described herein, the impedance may be different than in the designed mating position, leading to impedance discontinuities that impact performance.

As another example, connectors are described that are formed of modules, each of which contains one pair of signal conductors. It is not necessary that each module contain exactly one pair or that the number of signal pairs be the same in all modules in a connector. For example, a 2-pair or 3-pair module may be formed. Moreover, in some embodiments, a core module may be formed that has two, three, four, five, six, or some greater number of rows in a single-ended or differential pair configuration. Each connector, or each wafer in embodiments in which the connector is waferized, may include such a core module. To make a connector with more rows than are included in the base module, additional modules (e.g., each with a smaller number of pairs such as a single pair per module) may be coupled to the core module.

Furthermore, although many inventive aspects are shown and described with reference to a daughterboard connector having a right angle configuration, it should be appreciated that aspects of the present disclosure is not limited in this regard, as any of the inventive concepts, whether alone or in combination with one or more other inventive concepts, may be used in other types of electrical connectors, such as backplane connectors, cable connectors, stacking connectors, mezzanine connectors, I/O connectors, chip sockets, etc.

In some embodiments, contact tails were illustrated as press fit "eye of the needle" compliant sections that are designed to fit within vias of printed circuit boards. However, other configurations may also be used, such as surface mount elements, spring contacts, solderable pins, etc., as aspects of the present disclosure are not limited to the use of any particular mechanism for attaching connectors to printed circuit boards.

The present disclosure is not limited to the details of construction or the arrangements of components set forth in the following description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

What is claimed is:

1. An electrical connector, comprising:

a plurality of signal conductors, each signal conductor of the plurality of signal conductors comprising a mating contact portion, wherein the mating contact portions of the plurality of signal conductors are configured to mate with complementary mating contact portions of a mating connector when the connector and mating connector are moved together in a mating direction; and at least one reference conductor at least partially surrounding the mating contact portion of at least one signal conductor of the plurality of signal conductors, wherein:

the at least one reference conductor comprises a portion extending in the mating direction beyond the mating contact portion of at least one signal conductor so as to partially surround a space adapted to receive a portion of the mating connector; and the portion of the at least one reference conductor comprises at least one projection projecting into the space.

2. The electrical connector of claim 1, wherein:

the at least one projection is elongated in the mating direction.

3. The electrical connector of claim 2, wherein:

the at least one projection is aligned with the mating contact portion of the at least one signal conductor in the mating direction.

4. The electrical connector of claim 1, wherein the at least one reference conductor surrounds the mating contact portion of the at least one signal conductor on at least two sides.

5. The electrical connector of claim 4, wherein the at least one reference conductor is a first reference conductor, and the connector further comprises:

a second reference conductor adapted to engage with the first reference conductor with the at least one signal conductor therebetween.

6. The electrical connector of claim 1, wherein the at least one reference conductor extends along the mating direction beyond a distal end of the mating contact portion of the at least one signal conductor.

7. The electrical connector of claim 1, further comprising:

a housing portion holding the at least one signal conductor of the plurality of signal conductors, the housing portion comprising a mating region, wherein:

the mating contact portion of the at least one signal conductor is a first mating contact portion and is disposed in the mating region of the housing portion;

the housing portion comprises a mating interface surface having an opening therein, wherein the opening is sized and positioned to receive a complementary mating contact portion of the mating connector; and the mating region of the housing portion comprises at least one projecting member, the at least one projecting member extending in the mating direction beyond the mating interface surface and beyond a distal end of the first mating contact portion of the at least one signal conductor.

8. The electrical connector of claim 7, wherein the at least one reference conductor surrounds the housing portion on at least two sides.

9. An interconnection system comprising a first connector, the first connector comprising:

a plurality of first signal conductors, each first signal conductor of the plurality of first signal conductors comprising a contact tail adapted to be attached to a printed circuit board, a mating contact portion, and an intermediate portion electrically coupling the contact tail and the mating contact portion; and at least one reference conductor surrounding the mating contact portion of at least one first signal conductor of the plurality of first signal conductors, wherein the at least one reference conductor extends along a mating direction, wherein:

the first connector is adapted to mate with a second connector having a second signal conductor comprising a mating contact portion;

the mating contact portion of the at least one first signal conductor is adapted to form an electrical connection with the mating contact portion of the second signal conductor; and the at least one reference conductor comprises at least one projection projecting into a cavity of the first connector adapted to receive the mating contact portion of the second signal conductor.

10. The interconnection system of claim 9, wherein the at least one projection is disposed in a region that extends along the mating direction beyond a distal end of the mating contact portion of the at least one signal conductor.

11. The interconnection system of claim 10, wherein when the first connector is mated with the second connector, the mating contact portion of the second signal conductor forms a first separation along a first direction perpendicular to the mating direction from the at least one reference conductor at the region for the at least one projection, and forms a second separation along the first direction from the at least one reference conductor outside the region, wherein the first separation is smaller than the second separation.

12. The interconnection system of claim 9, wherein the at least one projection is aligned with the mating contact portion of the second signal conductor along a second direction perpendicular to the mating direction when the first connector is mated with the second connector.

13. The interconnection system of claim 9, wherein the at least one reference conductor is a first reference conductor, and the first connector further comprises:

a second reference conductor adapted to engage with the first reference conductor to capture the at least one signal conductor therebetween.

14. The interconnection system of claim 13, wherein the cavity is surrounded by the first reference conductor and the second reference conductor.

15. The interconnection system of claim 9 further comprising the second connector, mated to the first electrical connector, wherein the projections are shaped and positioned to provide a uniform impedance through the mated connectors when the second connector is partially demated from the first connector.

16. An electrical connector, comprising:

a plurality of signal conductors, each signal conductor of the plurality of signal conductors comprising a mating contact portion, wherein the mating contact portions of the plurality of signal conductors are configured to mate with complementary mating contact portions of a mating connector when the connector and mating connector are moved together in a mating direction, and wherein the plurality of signal conductors are arranged in a plurality of pairs; and a plurality of reference conductors at least partially surrounding mating contact portions of respective pairs of the plurality of pairs of signal conductors, wherein:

the plurality of reference conductors comprise portions extending in the mating direction beyond the mating contact portion of the respective pair of signal conductors so as to at least partially surround a respective space adapted to receive a portion of the mating connector; and the plurality of reference conductors comprise projections projecting into the respective space.

17. The electrical connector of claim 16, wherein:

the connector comprises a plurality of modules;

each module of the plurality of modules comprises an insulative housing holding a pair of the plurality of signal conductors; and at least one reference conductor of the plurality of reference conductors at least partially surrounds the insulative housing of each of the plurality of modules.

18. The electrical connector of claim 17, wherein:

each of the plurality of reference conductors comprises two projections projecting into a respective space.

19. The electrical connector of claim 18, wherein:

the at least one reference conductor of the plurality of reference conductors at least partially surrounding the insulative housing of each of the plurality of modules comprises two reference conductors; and the projections of the two reference conductors at least partially surrounding the insulative housing of each of the plurality of modules are symmetrically disposed with respect to the pair of signal conductors of the module.

20. The electrical connector of claim 19, wherein:

for each of the plurality of modules, projections of a first reference conductor of the two reference conductors are disposed on a first side of a respective space and projections of a second reference conductor of the two reference conductors are disposed on a second side, opposite the first side, of the respective space.

* * * * *